US012677950B2

(12) United States Patent
Nye et al.

(10) Patent No.: US 12,677,950 B2
(45) Date of Patent: Jul. 14, 2026

(54) CHAIR

(71) Applicant: LIFETIME PRODUCTS, INC., Clearfield, UT (US)

(72) Inventors: S. Curtis Nye, Clinton, UT (US); Mitch Johnson, South Weber, UT (US); Mohammadamir Safari, Austin, TX (US); Frank Clegg, Providence, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 85 days.

(21) Appl. No.: 18/599,170

(22) Filed: Mar. 7, 2024

(65) Prior Publication Data

US 2024/0298801 A1 Sep. 12, 2024

Related U.S. Application Data

(60) Provisional application No. 63/496,618, filed on Apr. 17, 2023, provisional application No. 63/489,071, filed on Mar. 8, 2023.

(51) Int. Cl.
*A47C 4/24* (2006.01)

(52) U.S. Cl.
CPC ..... *A47C 4/24* (2013.01)

(58) Field of Classification Search
CPC ..... A47C 4/02; A47C 4/025; A47C 4/028; A47C 4/04; A47C 4/08; A47C 4/10; A47C 4/14; A47C 4/18; A47C 4/20; A47C 4/24
See application file for complete search history.

(56) References Cited

U.S. PATENT DOCUMENTS 725,167 A * 4/1903 Southard ..... B62B 7/08 297/56
1,568,244 A * 1/1926 Rosenkranz ..... A47C 4/14 297/56
1,721,164 A * 7/1929 Newell ..... A47C 4/14 297/56

(Continued)

FOREIGN PATENT DOCUMENTS

CN 3677136 7/2004
CN 3381444 8/2007

(Continued)

OTHER PUBLICATIONS

Korean Pat. Pub. KR-2013-0005044-A to Kim, with English translation. (Year: 2013).*

(Continued)

*Primary Examiner* — Joshua J Michener
*Assistant Examiner* — Michael B. Kreiner
(74) *Attorney, Agent, or Firm* — Maschoff Brennan

(57) ABSTRACT

A folding chair may include a frame, brackets, and a seat. The chair may be assembled by connecting a first bracket to a first side of a frame and connecting a second bracket to a second side of the frame. The seat may be connected to the brackets by inserting downwardly extending portions of the seat into an upper portion of the brackets and pushing the seat downwardly towards a lower portion of the brackets. The seat may be connected to an at least substantially assembled frame, and the seat may be attached to the brackets while the frame is in a folded position.

20 Claims, 42 Drawing Sheets

(56) References Cited

U.S. PATENT DOCUMENTS

D107,545 S 12/1937 O'Connor
2,182,761 A * 12/1939 Johnson ..... A47C 4/14 297/56
2,294,340 A 8/1942 Irven
2,458,095 A 1/1949 O'Connor
2,649,141 A * 8/1953 Marshall ..... A47C 4/14 108/120
2,717,634 A * 9/1955 Lisi ..... A47C 4/028 297/440.16
3,139,307 A * 6/1964 Hawley ..... A47C 4/028 29/91
3,220,764 A * 11/1965 Duer ..... A47C 4/24 108/120
3,431,022 A 3/1969 Poppe
D214,267 S 5/1969 Fricke
D217,344 S 4/1970 Lindfors
3,695,687 A * 10/1972 Uyeda ..... A47C 4/24 297/56
D233,869 S 12/1974 Lopez-Leautaud
5,328,232 A * 7/1994 Whitehead ..... A47C 4/14 297/50
5,634,684 A 6/1997 Kojima
5,706,613 A 1/1998 Drake, Jr.
5,730,489 A 3/1998 Eberle
5,855,409 A * 1/1999 Tseng ..... A47C 4/14 297/27
D418,322 S 1/2000 Hock
6,027,171 A 2/2000 Partington
6,036,272 A 3/2000 Samples
6,149,240 A * 11/2000 Pietrzak ..... A47C 7/16 297/440.22
D435,977 S 1/2001 Ambasz
D436,457 S 1/2001 Ambasz
D443,429 S 6/2001 Mower et al.
6,273,510 B1 * 8/2001 Ehemann ..... B60N 2/68 297/440.22
D452,619 S 1/2002 Piretti
D455,568 S 4/2002 Leng
D457,336 S 5/2002 Leng
D465,665 S 11/2002 Ritchie
D466,712 S 12/2002 Haney et al.
D472,064 S 3/2003 Haney et al.
D472,723 S 4/2003 Haney et al.
D472,745 S 4/2003 Haney et al.
D473,059 S 4/2003 Haney et al.
6,543,842 B2 4/2003 Haney
6,568,752 B1 * 5/2003 Lu ..... A47D 1/023 297/42
D475,544 S 6/2003 Chadwick
D476,162 S 6/2003 Finazzi
D477,470 S 7/2003 Haney et al.
D477,926 S 8/2003 Haney et al.
D477,939 S 8/2003 Haney et al.
D481,550 S 11/2003 Astle
D482,540 S 11/2003 Ashby
D482,543 S 11/2003 Haney et al.
6,669,281 B1 * 12/2003 Huang ..... A47C 7/002 297/440.22
D489,192 S 5/2004 Jin
D495,891 S 9/2004 Ambasz
D498,071 S 11/2004 Ashby et al.
D501,613 S 2/2005 Kaltenmark
6,871,906 B2 3/2005 Haney
6,890,026 B1 * 5/2005 Shin ..... A47C 4/02 182/35
D505,800 S 6/2005 Lucci
D505,801 S 6/2005 Cesaroni
D506,325 S 6/2005 Farber
D507,425 S 7/2005 Ashby
D508,339 S 8/2005 Astle
7,014,261 B2 3/2006 Haney
7,017,986 B2 3/2006 Degen et al.
D519,292 S 4/2006 Ashby
7,021,705 B1 * 4/2006 Niermeyer ..... A47C 4/04 297/335
D523,254 S 6/2006 Nye et al.
7,069,865 B2 7/2006 Strong
7,080,877 B1 * 7/2006 Tsai ..... A47C 4/14 297/16.2
7,160,215 B2 1/2007 Mower
7,171,910 B2 2/2007 Neunzert
D544,225 S 6/2007 Cantarutti
7,331,297 B2 2/2008 Strong
7,331,628 B2 * 2/2008 Lin ..... A47C 4/24 297/16.2
7,399,036 B2 * 7/2008 Kowal ..... A47C 4/02 297/440.16
7,452,035 B2 11/2008 Astle et al.
7,476,164 B2 1/2009 Mower
7,568,767 B2 * 8/2009 Richardson ..... A47C 4/028 297/440.1
7,634,970 B2 12/2009 Strong
7,644,667 B2 1/2010 Strong
7,690,730 B2 * 4/2010 Yasuda ..... B60N 2/40 297/214
7,934,769 B1 * 5/2011 Lin ..... A47C 7/185 297/440.22
7,972,225 B2 7/2011 Mower
8,006,630 B2 8/2011 Strong
8,083,288 B1 * 12/2011 Warncke ..... A47C 3/20 297/130
D655,932 S 3/2012 Ashby
8,231,171 B2 * 7/2012 Leng ..... A47C 4/24 297/41
D667,649 S 9/2012 Waite et al.
8,342,107 B2 1/2013 Mower
8,353,560 B2 * 1/2013 Grove ..... A47C 7/00 297/440.16
8,397,652 B2 * 3/2013 Peery ..... A47B 3/0912 108/132
8,408,146 B2 * 4/2013 Peery ..... A47B 7/02 108/157.1
D686,007 S 7/2013 Johnson et al.
8,506,008 B2 * 8/2013 Pan ..... A47C 4/20 297/239
8,511,752 B2 * 8/2013 Grove ..... A47C 7/42 297/440.16
8,721,003 B2 5/2014 Waite et al.
D710,623 S 8/2014 Peery
8,851,561 B2 * 10/2014 Huang ..... A47C 4/24 297/23
8,870,278 B2 * 10/2014 Tsai ..... E05D 3/02 108/115
8,882,188 B2 * 11/2014 Jin ..... A47C 4/24 297/53
8,882,201 B2 * 11/2014 Gorza ..... A47C 4/03 297/440.22
D721,528 S 1/2015 Peery
D751,329 S 3/2016 Johnson et al.
D753,945 S 4/2016 Johnson et al.
9,609,943 B1 * 4/2017 Lin ..... A47C 4/14
D801,099 S 10/2017 Farber
D839,650 S 2/2019 Winter et al.
10,194,749 B1 2/2019 Doolan
10,448,744 B2 10/2019 Phillips
10,874,252 B2 12/2020 Colston
11,071,388 B2 7/2021 Leng
11,147,365 B2 * 10/2021 Jones ..... A47B 7/00
11,324,311 B2 * 5/2022 Johnson ..... B29C 49/0031
D972,874 S 12/2022 Anderson
D974,785 S 1/2023 Lin
D982,340 S 4/2023 Chen
11,730,262 B2 * 8/2023 Johnson ..... A47B 3/0912 428/35.7
11,766,116 B2 * 9/2023 Johnson ..... B29C 49/0031 108/115
D1,000,145 S 10/2023 Clegg
12,274,370 B2 * 4/2025 Yang ..... A47C 4/02
D1,125,907 S 5/2026 Safari et al.
D1,125,908 S 5/2026 Clegg

(56) References Cited

U.S. PATENT DOCUMENTS

| | | | | |
|---|---|---|---|---|
| 2001/0033100 | A1 | 10/2001 | Haney | |
| 2003/0168894 | A1* | 9/2003 | Lin | A47C 4/24 297/55 |
| 2004/0239153 | A1 | 12/2004 | Leng | |
| 2005/0104421 | A1 | 5/2005 | Astle | |
| 2005/0121947 | A1 | 6/2005 | Haney | |
| 2005/0206202 | A1 | 9/2005 | Winter | |
| 2007/0257524 | A1 | 11/2007 | Huang | |
| 2009/0146467 | A1 | 6/2009 | Waite | |
| 2011/0084537 | A1* | 4/2011 | Lin | A47C 7/185 297/452.18 |
| 2011/0198893 | A1 | 8/2011 | Leng | |
| 2014/0145480 | A1 | 5/2014 | Johnson | |
| 2015/0201759 | A1 | 7/2015 | Winters | |
| 2024/0298800 | A1 | 9/2024 | Nye et al. | |
| 2024/0298801 | A1 | 9/2024 | Nye et al. | |
| 2025/0017380 | A1 | 1/2025 | Leng | |
| 2025/0031852 | A1* | 1/2025 | Leng | A47C 4/24 |

FOREIGN PATENT DOCUMENTS

| | | |
|---|---|---|
| CN | 302878319 | 7/2014 |
| CN | 308164758 | 8/2023 |
| JP | D1413384 | 5/2011 |
| JP | HC650067900 | 9/2014 |
| JP | 20209377 | 7/2021 |
| KR | 3005844400000 | 1/2011 |
| TW | 461726 | 10/2001 |
| TW | 462651 | 11/2001 |
| TW | 462651 B | 5/2013 |
| TW | 461726 B | 11/2014 |

OTHER PUBLICATIONS https://www.amazon.com/Heavy-Plastic-Folding-Chair-Speckled/dp/B000H4GGUM/ref=sr_1_1crid=2U21991XX5BJRkeywords=4+pack+600+series+heavy+duty+plastic+folding+chair+specked+grey qid=1656450302 sprefix=4+pack+600+series+heavy+duty+plastic+folding+chair+specked+grey%2Caps%2C91 sr=8-1.

Taiwan Search Report and Written Opinion for 109302526 Mailed Jan. 15, 2021.

U.S. Appl. No. 29/879,163, filed Jul. 3, 2023.

U.S. Appl. No. 29/913,475, filed Oct. 2, 2023.

U.S. Appl. No. 29/933,819, filed Mar. 3, 2024.

U.S. Appl. No. 18/599,168, filed Mar. 7, 2024.

U.S. Appl. No. 18/599,170, filed Mar. 7, 2024.

International Search Report and Written Opinion mailed Jul. 24, 2024 in PCT Application No. PCT/US2024/019217.

International Search Report and Written Opinion mailed Jul. 24, 2024 in PCT Application No. PCT/US2024/019221.

Lifetime Classic Folding Chair (Commercial), posted Mar. 2, 2021 [online], [retrieved May 20, 2025]. Retrieved from internet, https://www.lifetime.com/lifetime-2802G-classic-folding-chair-commercial (Year: 2021).

Lifetime Folding Chair with Bypass Frame-4 Pk (Commercial), posted date not available [online], [retrieved May 20, 2025]. Retrieved from internet, https://www.lifetime.com/lifetime-81158-folding-chair-with-bypass-frame-4-pk-commercial (Year: 2025).

Lifetime Padded Folding Chair (Commercial), posted Aug. 9, 2020 [online], [retrieved Mar. 28, 2025]. Retrieved from internet, https://www.lifetime.com/lifetime-80426g-padded-folding-chair-commercial (Year: 2020).

Flash Furniture Plastic Armless Folding Chair, posted Oct. 20, 2021 [online], [retrieved Mar. 28, 2025]. Retrieved from internet, https://www.walmart.com/ip/Flash-Furniture-Plastic-Armless-Folding-Chair-With-Charcoal-Frame-Black-4-Pack-4DADYCD50/860548578 (Year: 2021).

Non-Final Office Action, U.S. Appl. No. 29/866,379, mailed Jun. 5, 2025.

Non-Final Office Action, U.S. Appl. No. 29/872,211, mailed May 21, 2025.

Non-Final Office Action, U.S. Appl. No. 29/879,163, mailed Jun. 5, 2025.

Non-Final Office Action, U.S. Appl. No. 29/910,317, mailed Apr. 8, 2025.

Non-Final Office Action, U.S. Appl. No. 29/910,315, mailed Apr. 8, 2025.

Non-Final Office Action, U.S. Appl. No. 29/913,475, mailed Jun. 4, 2025.

U.S. Appl. No. 29/933,822, filed Mar. 21, 2024.

U.S. Appl. No. 29/910,315, filed Aug. 17, 2023.

U.S. Appl. No. 29/910,317, filed Aug. 17, 2023.

U.S. Appl. No. 29/874,268, filed Apr. 17, 2023.

U.S. Appl. No. 29/874,269, filed Apr. 17, 2023.

U.S. Appl. No. 29/872,211, filed Mar. 8, 2023.

U.S. Appl. No. 29/869,534, filed Jan. 3, 2023.

U.S. Appl. No. 29/866,379, filed Sep. 9, 2022.

Taiwan Search Report 109302526 Mailed Jan. 15, 2021.

* cited by examiner

CHAIR

CROSS-REFERENCE TO RELATED APPLICATIONS

The present application claims priority to and the benefit of U.S. Provisional Patent Application Ser. No. 63/489,071, entitled CHAIR, filed on Mar. 8, 2023, and U.S. Provisional Patent Application Ser. No. 63/496,618, entitled CHAIR, filed on Apr. 17, 2023, each of which is incorporated by reference in its entirety.

BACKGROUND

Field of the Invention

This application is generally directed towards furniture and, in particular, to chairs.

Description of Related Art

Conventional chairs typically include a chair seat and a backrest. The chair seat and backrest can be separate structures or part of a single structure. Chairs typically include legs to support the seat and backrest above a surface such as a floor.

Chairs may be constructed from a wide variety of materials such as wood, metal, and molded plastic. Conventional chairs may have a wide variety of designs depending on factors such as intended use, ergonomics, and appearance. In addition, chairs may have various functional considerations such as size, weight, durability, portability, and desired seating position.

Chairs may be constructed for added comfort, which may facilitate use of the chair over longer periods of time. For example, the chair seat and backrest may be contoured, padded, and constructed from flexible materials.

Folding chairs are also known, and folding chairs may be disposed in an unfolded or use position and a folded or collapsed position. It may be easier to transport and store folding chairs because the chairs may require less space in the folded position. Folding chairs may also facilitate transportation and storage because folded chairs may be easier to align and arrange.

Folding chairs are frequently used in assembly halls, banquet halls, convention centers, hotels, schools, churches, and other locations where large groups of people meet. Folding chairs may be positioned in an assortment of configurations and arrangements for seating. When the chairs are no longer needed for seating, the chairs may be folded for transportation or storage.

Folding chairs are typically lightweight, portable chairs that are used where permanent seating is not possible, practical, or desired. Folding chairs may be used during outdoor or indoor events such as performances, presentations, and sporting events. Folding chairs may also be used in the home when extra seating is needed such as for parties, playing games, and temporary seating for guests.

Traditional folding chairs include front legs and rear legs that are pivotally connected to allow the chair to move between folded and unfolded positions. Disadvantageously, some known folding chairs are not very sturdy, strong, durable, or well-made. In addition, some known folding chairs are difficult to use and may be challenging to secure in the use or collapsed positions. Some known folding chairs are also difficult to manufacture, and some known folding chairs are relatively flimsy. Further, some known folding chairs are uncomfortable to use and some know folding chairs may create one or more pinch points. These problems may be especially significant for chairs that are lightweight and comparatively inexpensive.

Conventional folding chairs may not be able to support a large amount of weight or force. Further, conventional folding chairs may be rather time-consuming to assemble. For example, known folding chairs may include numerous discrete parts that must be carefully assembled, which can undesirably increase the time required to manufacture the chairs. In addition, the manufacturing process may be relatively complex and involve multiple steps, and the manufacturing process may require certain portions of the chair to be assembled before other portions of the chair, which may make the process more difficult and tedious.

BRIEF SUMMARY

A need therefore exists for a chair that eliminates or decreases the above-described disadvantages and problems.

One aspect is a chair that may include a chair seat and a chair back or backrest. A frame may connect the seat and the backrest. The frame may include one or more legs that support the seat and backrest at a desired height or distance from a surface such as a floor. The legs may be attached to the seat and backrest, if desired. The frame may include a pair of front legs and a pair of rear legs. The legs may be pivotally connected, which may allow the chair to move between folded or collapsed and unfolded or use positions.

Another aspect is a chair that may be at least partially constructed from plastic. For example, the seat and/or backrest may be constructed from plastic, such as blow-molded or injection molded plastic. The seat and backrest may be separate components or integrally formed as part of a unitary, one-piece structure. The plastic components may be quickly and efficiently manufactured. The plastic components may have different shapes, sizes, configurations, and/or arrangements depending, for example, upon the intended use of the chair. Chairs including one or more plastic components may be durable, lightweight, easily manufactured, impact resistant, strong, and the like. It will be appreciated that all or portions of the chair may be constructed from plastic, and the plastic components may be manufactured by any suitable process or method, such a blow-molding, injection molding, rotary molding, and the like. It will also be apricated that all or portions of the chair may be constructed from other materials with appropriate properties and characteristic, such as metal. For example, the frame may be constructed from metals such as steel, aluminum, alloys, and the like.

Still another aspect is a chair that may be lightweight, and the chair may be readily portable. Advantageously, this may allow the chair to be used in a wide variety of situations and environments. This may also increase the potential uses of the chair and may allow the chair to be used for multiple different purposes.

Yet another aspect is a chair that may include a frame and the frame may allow the chair to support a significant amount of weight or force. For example, the frame may be constructed from a relatively durable material such as metal. In an example embodiment, at least a portion of the frame may be at least partially constructed from metal tubing, such as steel tubing, and the metal tubing may have a generally circular, oblong, oval, elongated, rounded, or another desired configuration.

Still yet another aspect is a chair that may be a folding chair, and the folding chair may be movable between a closed, folded, or collapsed position and an open, unfolded, or use position. The folding chair may include legs that are pivotally connected. For example, the chair may include front legs and rear legs, and the front and rear legs may be pivotally connected. In an example embodiment, a right front leg may be pivotally connected to a right rear leg, which may be disposed on a right side of the chair, and a left front leg may be pivotally connected to a left rear leg, which may be disposed on a left side of the chair. An upper portion of the front legs may be connected to the backrest.

A further aspect is a folding chair that may include legs that are generally aligned and/or disposed in a generally parallel configuration in the folded position. For example, when the chair is in the folded position, at least a portion of the front legs and at least a portion of the rear legs may be disposed in generally aligned, adjacent positions. In an example embodiment, the rear legs may be disposed inwardly of the front legs when the chair is in the folded position, and at least a portion of the rear legs and at least a portion of the front legs may be disposed in generally parallel, side-by-side configurations when the chair is in the folded position. Additionally, the rear legs may be at least substantially disposed between the front legs when the chair is in the folded position. Because the rear legs may be at least substantially disposed between the front legs when the chair is in the folded position, this may facilitate alignment and/or close spacing of the chairs in the collapsed position, which may allow the chairs to be stored and/or transported in a smaller space.

Another further aspect is a char that may include one or more brackets and the brackets may be attached to the frame. In an example embodiment, the brackets may be pivotally attached to the frame, such as pivotally attached to the front leg. The example bracket may have a generally U-shaped configuration with an outer portion, such as an outer wall, a lower portion, such as a lower wall, and an inner portion, such an inner wall. The bracket may be sized and configured to receive a portion of the seat, such as an outer wall, sidewall, and/or lip of the seat. For example, the seat may include a downwardly extending portion, such as a lip and/or sidewall, and the downwardly extending portion may be at least partially disposed in the bracket. For instance, at least a portion of the downwardly extending portion of the seat may be disposed between the outer wall and the inner wall of the bracket. A lower portion of the downwardly extending portion may contact a lower portion of the bracket. In an example embodiment, the outer, inner, and/or lower portions of the bracket may contact the outer, inner, and/or lower portions of the downwardly extending portion of the seat.

A still further aspect is a chair that may include a bracket with one or more attachment portions and the attachment portions may be sized and configured to facilitate connection of the bracket and the seat. For example, the bracket may include one or more inwardly extending attachment portions, such as tabs, and the inwardly extending attachment portions may be sized and configured to be at least partially disposed within attachment portions, such as receiving portions, in the seat. In an example embodiment, the inner portion of the bracket may include one or more inwardly extending attachment portions, such as two inwardly extending attachment portions. In this example, one inwardly extending attachment portion may be disposed towards a first portion of the bracket and another inwardly extending attachment portion may be disposed towards a second portion of the bracket. The inwardly extending attachment portions may be sized and configured to allow the seat to be inserted downwardly into the bracket, and the inwardly extending attachment portions may be sized and configured to prevent the seat from being inadvertently removed from the bracket. For example, a portion of the inwardly extending attachment portions and/or the receiving portions of the seat may bend or deform when the seat is being inserted into the bracket, and then the inwardly extending attachment portions and/or the receiving portions of the seat may at least partially revert and/or resiliently return towards the original configurations. The bracket and the seat may be sized and configured to allow the seat to be inserted downwardly into an upper portion to the bracket to connect the bracket and the seat. That is, in an example embodiment, the bracket may be sized and configured to allow the outer portion, such as the sidewall, of the seat to be inserted downwardly into an upper portion of the generally U-shaped bracket, rather than a sliding connection of the seat and bracket along the length of the bracket. Additionally, or alternatively, an axis may be aligned with a height of the bracket, the height being measured between a lower portion of the bracket and an upper portion of the bracket, and the seat and the bracket may be aligned long the axis when the seat is connected to the bracket.

Yet another further aspect is bracket that may include multiple support portions or surfaces, and the support surfaces may be sized and configured to support the seat. In an example embodiment, the bracket may include an inner portion, such as a sidewall, and the inner sidewall may include a first portion disposed towards a front portion of the bracket and a second portion disposed towards a rear portion of the bracket. An upper portion of the front portion of the inner sidewall and/or an upper portion of the rear portion of the inner sidewall of the bracket may be sized and configured to support a portion of the seat, such as the lower portion of the seat. The upper portion of the front, inner portion of the bracket may include a generally planar surface and the generally planar surface may be sized and configured to support a lower portion of the seat. The upper portion of the rear, inner portion of the bracket may include a generally planar surface and the generally planar surface may be sized and configured to support a lower portion of the seat. The lower portion of the bracket may include an inner surface and the inner surface may be sized and configured to support a portion of the seat, such as the lower portion of the sidewall. The outer portion of the bracket may be sized and configured to support a portion of the seat, such as an outer wall of the seat. For instance, the outer portion of the bracket may include an upper surface and the upper surface may be sized and configured to support an outer portion of the seat. In an example embodiment, the outer portion of the bracket may be at least partially disposed in a recess or opening in the outer wall of the seat. In some example embodiments, the outer portion of the bracket may also include an attachment portion, such as an inwardly extending attachment portion, and the inwardly extending attachment portion may be sized and configured to connect the bracket and seat. For example, the outer portion of the bracket may include an inwardly extending portion and the inwardly extending portion may be curved inwardly and/or downwardly. In greater detail, the inwardly extending portion on the outer portion of the bracket may have a generally rounded configuration, and the distal portion of the inwardly extending portion may be disposed towards the lower portion of the bracket and/or may be angled inwardly. The inwardly extending portion of the outer portion of the bracket and/or a portion of the seat may at least partially bend or deform when the seat is attached to the bracket. Once the seat is attached to the bracket, the inwardly extending portion on the outer portion of the bracket and/or a portion of the seat may revert or resiliently return, at least partially, to an initial configuration, which may help connect the seat and the bracket. The inwardly extending portion on the outer portion of the bracket may facilitate quick, easy, and/or secure attachment of the bracket and the seat.

Another aspect is a bracket may include an opening or a cutout, which may be disposed in an inner portion of the bracket such as the inner sidewall. The opening may extend longitudinally along a length of the bracket and the opening may extend downwardly relative to an upper portion of the inner sidewall of the bracket. At least a portion of the upper part of the opening may be open or exposed. The opening may include an end that may be disposed towards a front portion of the bracket, and the opening may include an opposing end that may be disposed towards a rear portion of the bracket. In an example embodiment, the opening may form at least a portion of a guide and the guide may facilitate folding and/or unfolding of the chair. For example, the opening may include a guide surface and the guide surface may have a generally planar or smooth surface. In an example embodiment, the guide surface may be at least partially formed by a lower portion of the opening and the guide surface may be disposed towards a lower portion of the bracket. The guide surface may include an inwardly extending portion that extends towards a central or middle portion of the chair. The inwardly extending portion may have a generally planar or smooth surface. A gap or space may be disposed between a front portion of the guide surface and a front portion of the opening. Additionally, or alternatively, a gap or space may be disposed between a rear portion of the guide surface and a rear portion of the opening. If desired, a downwardly extending notch may be disposed between the rear portion of the guide surface and a rear portion of the opening. The guide may be sized and configured to receive at least a portion of a guide member, and the guide may help control movement of the frame while the chair is folded and unfolded.

Still another aspect is a chair that may facilitate attachment of the seat by a friction, interference, and/or snap fit configuration. In an example embodiment, the bracket may be sized and configured to allow the seat to be inserted downwardly (relative to the bracket) into an upper portion of the bracket, and one or more portions of the bracket and/or seat may be sized and configured to at least partially bend or deform when the seat is attached to the bracket. Once the seat is attached to the bracket, then the portions of the bracket and/or seat may revert or resiliently return, at least partially, to an initial configuration, which may facilitate connection of the seat and the bracket.

Yet another aspect is a bracket that may include one or more attachment portions on a first portion of the bracket, such as an inner portion or inner wall, and one or more attachment portions on another portion of the bracket, such as an outer portion or outer wall. In an example embodiment, the inner portion of the bracket may include one or more inwardly extending attachment portions and the outer portion of the bracket may include one or more inwardly extending attachment portions. The inwardly extending attachment portions may be angled downwardly towards the lower portion of the bracket, which may facilitate the seat being inserted downwardly into the upper portion of the bracket and towards the lower portion of the bracket when the seat is being attached to the bracket.

Still yet another aspect is a chair that may include a seat with one or more attachment portions, and the attachment portions may facilitate attachment of the seat and the frame. The seat attachment portions, for example, may include one or more locking, engaging, and/or receiving portions that may be sized and configured to contact, abut, engage, interlock, attach, and/or connect with one or more attachment portions of the bracket. The seat attachment portions may be sized and configured to connect the seat and the frame using a friction, interference, and/or snap fit. This may allow the seat and the frame to be connected without the use of fasteners. It will be appreciated that one or more fasteners may be used, if desired, to attach the seat and the bracket.

A further aspect is a chair may that include brackets, and the brackets may be part of the frame or attached to the frame. In an example embodiment, a first bracket may be attached to a first front leg and a second bracket may be attached to a second front leg. The first and second brackets may be complementary, and the brackets may have mirror images. The first and second brackets may be disposed on opposing sides of the seat, and the first and second brackets may have corresponding shapes, sizes, configurations, and/or arrangements. It will be appreciated that the brackets may also have other shapes, sizes, configurations, and/or arrangements depending, for example, upon the intended use of the chair.

In an example embodiment, the brackets and the seat may include one or more attachment portions, such as outwardly extending portions (e.g., projections, protrusions, ridges, flanges, engaging positions, locking cogs, and teeth) and/or inwardly extending portions (e.g., slots, channels, grooves, and receiving portions). For example, the bracket may include one or more outwardly extending portions, and the seat may include one or more inwardly extending portions. Thus, the bracket and seat may include one or more attachment portions and these attachment portions may be sized and configured contact, abut, engage, interlock, attach, connect, and the like. One of ordinary skill in the art will appreciate, after reviewing this disclosure, that the seat and brackets may be connected in other suitable manners depending, for example, upon the intended use of the chair.

Another further aspect is a method of attaching a seat and a frame. The method may include connecting one or more brackets to the frame, and then connecting the seat to the brackets. Advantageously, this may allow the seat to be attached to the frame after the frame is at least partially or at least substantially assembled. For example, among other parts and components, the frame may include two front legs, two rear legs, and/or two brackets. In an example embodiment, the front and rear legs may be pivotally connected, and the brackets may be pivotally connected to the legs, such as the front legs. For instance, a rear portion of a first bracket may be pivotally connected to a first front leg and a rear portion of a second bracket may be pivotally connected to a second front leg. In addition, one or more crossmembers may be attached to the legs, such as a lower crossmember connected to the front legs and/or a lower crossmember connected to the rear legs. In addition, an upper crossmember may be connected to the legs, such as an upper portion of the rear legs. In this example embodiment, the seat may be connected to the frame after the legs, brackets, and/or crossmembers are assembled. In an example embodiment, the attachment portions of the seat and/or the attachment portions of the brackets may be sized and configured to allow the seat to be connected to the frame when the frame is in the folded or collapsed position. For instance, the seat may be generally positioned above an upper portion of the brackets and portions of the seat, such as outer walls and/or sidewalls, may be inserted into the brackets. The seat may be pushed down relative to the upper portion of the brackets so that at least a portion of the seat may be disposed in the brackets. In this example embodiment, the sides or sidewalls of the seat may be connected to the brackets, which may allow the seat and the frame to be connected. Because the seat may be attached to the frame while the frame is partially or substantially assembled and/or the seat may be attached to the frame while the frame is in the folded position, manufacturing and/or assembly of the chair may be facilitated. After reviewing this disclosure, one of ordinary skill in the art will appreciate that the seat does not have to be attached to a partially or substantially assembled frame, and the seat may be attached to the frame when the frame is in the open or unfolded position.

A still further aspect is a chair that may include an upper crossmember, and the upper crossmember may be connected to an upper portion of the legs, such as an upper portion of the rear legs. The upper crossmember may have a tubular configuration and the upper crossmember may be securely connected to the upper portion of the rear legs, such as by welding. In an example embodiment, the upper crossmember may be movable or slidable relative to the seat, such as a bottom portion of the seat, while the chair is folded and/or unfolded. One or more stops may be used to control movement of the crossmember. For example, one or more of the stops may be used to prevent movement of the crossmember, and the stops may be used to maintain the chair in the folded and/or unfolded positions. Additionally, or alternatively, one or more guides may be used to control movement of the crossmember, and the guides may be at least partially formed by the seat and/or the brackets. For instance, an upper portion of the guides may be at least partially formed by a lower surface of the seat and a lower portion of the guides may be at least partially formed by the brackets. The guides may include an opening disposed between the lower portion of the seat and a portion of the bracket. A guide member may be at least partially disposed in the opening of the guide, and the guide member may move within the opening of the guide while the chair is folded and/or unfolded. In an example embodiment, the guide member may be a portion of the upper crossmember, such as an end of the upper crossmember. Additionally, or alternatively, the guide member could be attached to the upper crossmember and/or an upper portion of the rear legs. For example, the guide members could be connected to the ends of the upper crossmember, and the guide members may include outwardly extending portions such as pins, posts, connectors, studs, and the like. In an example embodiment, the guide members may be studs and the studs may be attached to the ends of the upper crossmember. The studs may include a body and an enlarged end, such as a head, and the studs may be at least partially disposed in the guides. For example, the body of the stud may be disposed in the opening of the guide, and the head may be disposed in a receiving portion, which may help position and/or maintain the stud within the guide. Advantageously, the studs and/or guides may help control movement of the upper crossmember, which may allow the chair to be easily folded and unfolded. Additionally, the studs may allow the guides to have a small opening (such as about ¼ inch or less), which may eliminate pinch points, and the studs may allow the upper crossmember to move relative to the lower portion of the chair. The studs may allow the crossmember to be constructed from relatively large diameter tubes or rods, which may provide robust and significant support for the seat, such as a front portion of the seat, without increasing the size of the opening in the guides. The studs may be securely connected to the crossmember, such as my welding, which may allow the chair to support a large amount of force or weight. In contrast, previous known folding chairs used small diameter crossmembers to help prevent pinch points, and the small diameter crossmembers required tight tolerances, which significantly complicated the manufacturing and assembly process. Significantly, the studs, crossmembers, brackets, and seats disclosed herein do not require the tight tolerances of previous known chairs. Instead, the studs, crossmembers, brackets, and seats disclosed herein provide increased support for the seat and facilitate faster and easier manufacturing and/or assembly of the chair.

Yet another further aspect is a chair that may include a seat with one or more surfaces sized and configured to facilitate folding and unfolding of the chair. For example, the seat may include one or more surfaces that form portions of the guides, and the lower portion of the seat may be configured to have the same general shape and configuration as the upper crossmember, which may help eliminate pinch points. After reviewing this disclosure, one of ordinary skill in the art will appreciate that the seat and/or brackets may include other suitable features and components, such as cogs, tabs, ramps, buttons, projections, locking members, and the like.

Another aspect is a chair that may include pivotally connected legs. For example, the chair may include a pair of front legs and a pair of rear legs, and the back legs may be disposed inside the front legs. When the chair is disposed in the folded position, the rear legs may be at least substantially disposed between the front legs. The rear legs may include an offset portion and the offset portion may facilitate folding of the chair. For instance, the upper portion of the rear legs may include inwardly extending offset portions. When the chair is in the folded position, the lower portion of the rear legs may be generally aligned, parallel, and disposed in a side-by-side configuration with a lower portion of the front legs. The upper offset portion of the rear legs may be generally aligned and parallel to an upper portion of the front legs, and the upper offset portion of the rear legs may be spaced apart from the upper portion of the front legs by a gap when the chair is in the folded position. A portion of the bracket and/or seat may be disposed in the gap between the upper offset portion of the rear legs and the upper portion of the front legs when the chair is in the folded position. The rear portion of the seat may include one or more cutouts, grooves, receiving portions, and the like, which may receive at least a portion the upper offset portion of the rear legs when the chair is in the folded position. In an example embodiment, in the folded position, the upper offset portion of the rear legs may be at least partially disposed in receiving portions of the seat, the brackets may be generally aligned with the lower portion of the rear legs along an axis, and/or the brackets, the rear legs, and at least a portion of the seat may be disposed between the front legs.

Still another aspect is a folding chair that may be movable between folded and unfolded positions. Advantageously, the frame may be at least substantially or completely assembled, and then the seat may be connected to the frame. In contrast, previously known folding chairs required the seat to be attached before the frame was substantially or completely assembled. Some previously known chairs required the seat to be attached to a seat bracket before the rear legs were assembled and/or connected to the frame. It was often difficult to attach the seat in these previously known chairs because the seat was typically attached at an angle relative to the frame and the seat was usually longitudinally inserted into the bracket. After the seat was attached in these previously known chairs, it was often difficult to attach the rear legs. The folding chair disclosed herein, however, may allow the seat to be attached to the fully or at least substantially assembled frame. In addition, the seat may be attached when the frame is in the folded position. For example, if the frame is disposed in a horizontal or vertical configuration, the seat may be disposed in a corresponding horizontal or vertical configuration and aligned with the brackets. The lower portion of the seat may contact the upper portions of the brackets, and the seat may be pushed into and connected to the brackets, which may allow the seat to be attached using a friction, interference, and/or snap fit. The seat may be securely connected to the brackets by one or more attachment portions, gripping members, and/or locking members. In an example embodiment, the seat may not be moved longitudinally along a length of the bracket while the seat is being attached to the bracket.

Yet another aspect is a folding chair that may include a backrest, a seat, and a frame. The frame may include a first leg assembly with a front leg and a rear leg, and a second leg assembly may include a front leg and a rear leg. An upper crossmember may connect the upper portion of the rear leg of the first leg assembly and the upper portion of the rear leg of the second leg assembly. A first bracket may be connected to the front leg of the first leg assembly, and a second bracket may be connected to the front leg of the second leg assembly. The first bracket may form a portion of a first guide and the second bracket may form a portion of a second guide. The guides may be sized and configured to guide the upper crossmember as the chair is moved between the folded and unfolded positions. The seat may also form a portion of the guides. For example, a first portion of the guide may be formed by a portion of the seat, and a second portion of the guide may be formed by a portion of the bracket. The guides may include an opening and a receiving portion. In an example embodiment, the ends of the upper crossmember may include guide members, such as studs, and the bodies of the studs may be disposed within an elongated opening of the guides. The studs may have an enlarged head and the head may be disposed within a receiving portion. Advantageously, the guides, guide members, brackets, crossmembers, and/or seat may allow a strong and sturdy chair to be constructed.

Still yet another aspect is a chair than may include a backrest attached to a frame. The backrest and/or the frame may include one or more connecting members, which may include locking, engaging, and/or receiving portions, and the connecting members may be sized and configured to contact, abut, engage, interlock, attach, connect, and the like with each other to connect the backrest and the frame. The connecting members may be sized and configured to connect the backrest and the frame using a friction, interference, and/or snap fit. This may allow the backrest to be attached to the frame without requiring the use of one or more fasteners. Fasteners, however, could be used if desired. In an example embodiment, the connecting members may include one or more locking, engaging, or receiving portions, such as projections, engaging portions, locking cogs, teeth, slots, channels, grooves, and the like. One or more of the connecting members may extend from an open, upper portion of the frame, and one or more of the connecting portions may be disposed along a length of the frame. One or more connecting members may be spaced apart from an end of the frame. For example, the upper portion of the frame, such as an upper portion of the front legs, may include a slot or opening. The opening may be disposed on an inner surface of the upper portion of the frame, and one or more of the connecting members may be disposed at least proximate the opening. In an example embodiment, the backrest may include one or more connecting members that are sized and configured to contact, abut, engage, interlock, attach, connect, and the like with one or more corresponding connecting members of the frame. The connecting members may be sized and configured to bend or deform when the backrest is attached to the frame. Once the backrest is attached to the frame, the connecting members may at least partially revert or return to their initial configurations, which may help retain the backrest in the desired position. The connecting members may include narrowed or tapered portions, which may help secure the backrest in a fixed position. The connecting members may also include other features, such as inwardly and/or outwardly extending protrusions, dovetail portions, teeth, and the like, which may help securely attach the backrest and the frame.

A further aspect is a method of attaching a backrest to a frame. The method may include connecting the connecting members of the frame and the connecting members of the backrest. For example, the connecting members of the backrest may be positioned to contact, engage, abut., interlock, and/or be attached to connecting members of the frame. In an example embodiment, a portion of the backrest may be inserted into openings in the upper portion of the frame. The connecting members of the backrest, such as outwardly and/or inwardly extending portions, may contact, engage, abut., interlock, and/or be attached to connecting members of the frame, such as receiving portions or projections. In an example embodiment, the sides of the backrest may be aligned with openings, such as slots, disposed an upper portion of the frame, and the backrest may be inserted and/or positioned such that the connecting members of the frame and the connecting members of the backrest allow the backrest and the frame to be connected. If the backrest is constructed from plastic, such as blow-molded plastic, the connecting members of the backrest may be integrally formed with the backrest as part of a unitary, one-piece structure. The connecting members of the frame may be formed in the frame during the manufacturing process. The connecting members of the frame and/or the connecting members of the backrest may also be separate parts and/or components depending, for example, upon the intended use of the chair. The connecting members of the frame and/or the connection members of the backrest may allow the backrest and the frame to be connected using a friction, interference, and/or snap fit.

Another aspect is a folding chair that may be capable of moving between a folded position and an unfolded position. The folding chair may include a frame, and a seat may include a first set of one or more receiving portions that may be disposed on a first side of the seat and a second set of one or more receiving portions that may be disposed on a second side of the seat. A first bracket may be attached to a first side of the frame, the first bracket may include one or more attachment portions sized and configured to engage the first set of one or more receiving portions of the seat as the seat is inserted from an upper portion of the first bracket towards a lower portion of the first bracket, the one or more attachment portions of the first bracket and the first set of one or more receiving portions of the seat may connect the first side of the seat to the first bracket, and a second bracket may be attached to a second side of the frame, the second bracket may include one or more attachment portions sized and configured to engage the second set of one or more receiving portions of the seat as the seat is inserted from an upper portion of the second bracket towards a lower portion of the second bracket, the one or more attachment portions of the second bracket and the second set of one or more receiving portions of the seat may connect the second side of the seat to the second bracket.

Yet another aspect is a folding chair that may include a frame with a right front leg attached to a right rear leg and a left front leg attached to a left rear leg, the first bracket may be pivotally attached to the right front leg and the second bracket may be pivotally attached to the left front leg, and the seat may be attached to an at least substantially assembled frame. The seat may be attached to the first bracket along a first axis that may be generally vertically aligned with a height of the first bracket, and the seat may be attached to the second bracket along a second axis that may be generally vertically aligned with a height of the second bracket. The seat may be attached to the first bracket and the second bracket while the first bracket and the second bracket are attached to the frame, and the frame may be disposed in a folded position. The seat may be attached to the first bracket and the second bracket while the first bracket and the second bracket are attached to the frame, and the frame may be disposed in an unfolded position. The one or more attachment portions of the first bracket may extend inwardly and downwardly towards a lower surface of the first bracket, and the one or more attachment portions of the second bracket may extend inwardly and downwardly towards a lower surface of the second bracket. The seat may be connected to the first bracket and the second bracket while the frame is disposed in a folded configuration and the frame is at least substantially assembled. An attachment portion of the one or more attachment portions of the first bracket may include a tab that extends downwardly and inwardly towards a lower surface of the first bracket, an attachment portion of the one or more attachment portions of the second bracket may include a tab that extends downwardly and inwardly towards a lower surface of the second bracket, and the seat may not be moved parallel to a length of the first bracket or the second bracket to attach the seat to the brackets. The seat may be positioned above the upper portion of the first bracket and the upper portion of the second bracket when attaching the seat to the first bracket and the second bracket, the first set of one or more receiving portions of the seat may be aligned with the one or more attachment portions of the first bracket, the second set of one or more receiving portions of the seat may be aligned with the one or more attachment portions of the second bracket, the first set of one or more receiving portions of the seat may engage the one or more attachment portions of the first bracket when the seat is attached to the first bracket, and the second set of one or more receiving portions of the seat may engage the one or more attachment portions of the second bracket when the seat is attached to the second bracket. The first bracket may include an inner wall and an outer wall, the second bracket may include an inner wall and an outer wall, the inner wall of the first bracket may include two attachment portions of the one or more attachment portions and the outer wall of the first bracket may include one attachment portion of the one or more attachment portions, and the inner wall of the second bracket may include two attachment portions of the one or more attachment portions and the outer wall of the second bracket may include one attachment portion of the one or more attachment portions.

Another aspect is a method of assembling a portion of a folding chair. The method may include providing a frame with a first front leg, a first rear leg that may be connected to the first front leg, a second front leg, and a second rear leg that may be connected to the second front leg. A first bracket may be connected to the first front leg, the first bracket may include a first axis extending at an upward angle from a lower portion of the first bracket, and a second bracket may be connected to the second front leg, the second bracket may include a second axis extending at an upward angle from a lower portion of the second bracket. A seat may be connected to the first bracket and the second bracket, the seat may be connected to the first bracket along the first axis and the seat may be connected to the second bracket along the second axis.

Yet another aspect is a method of assembling a folding chair may include inserting a first portion of the seat from an upper portion of the first bracket towards a lower portion of the first bracket to connect the first portion of the seat to the first bracket, inserting a second portion of the seat from an upper portion of the second bracket towards a lower portion of the second bracket to connect the second portion of the seat to the second bracket. The method may include providing the first bracket with one or more inwardly and downwardly extending attachment portions, providing the second bracket with one or more inwardly and downwardly extending attachment portions, providing the seat with a first sidewall with one or more receiving portions sized and configured to receive the one or more attachment portions of the first bracket when the seat is attached to the first bracket, and providing the seat with a second sidewall with one or more receiving portions sized and configured to receive the one or more attachment portions of the second bracket when the seat is attached to the second bracket. The seat may be connected to the first bracket and the second bracket when the frame is at least substantially assembled. The seat may be connected to the first bracket and the second bracket when the frame is disposed in a folded position. The method may include positioning the seat above the upper portion of the first bracket when the seat is to be attached to the first bracket, positioning the seat above the upper portion of the second bracket when the seat is to be attached to the second bracket, the seat may include a first set of one or more attachment portions that may be aligned with one or more attachment portions of the first bracket, the seat may include a second set of one or more attachment portions that may be aligned with one or more attachment portions of the second bracket, the first set of one or more attachment portions of the seat may engage the one or more attachment portions of the first bracket when the seat is attached to the first bracket, and the second set of one or more attachment portions of the seat may engage the one or more attachment portions of the second bracket when the seat is attached to the second bracket. The method may include providing the first bracket with an inner sidewall and an outer sidewall, the inner sidewall of the first bracket may include two attachment portions, the attachment portions may include a tab that extends downwardly and inwardly towards a lower surface of the first bracket, providing the second bracket with an inner sidewall and an outer sidewall, the inner sidewall of the second bracket may include two attachment portions, the attachment portions may include a tab that extends downwardly and inwardly towards a lower surface of the second bracket, providing the seat with a first sidewall and two attachment portions may be disposed in the first sidewall, the two attachment portions of the first bracket and the two attachment portions of the first sidewall may connect the seat to the first bracket, and providing the seat with a second sidewall and two attachment portions disposed in the second sidewall, the two attachment portions of the second bracket and the two attachment portions of the second sidewall may connect the seat to the second bracket.

Another aspect is a method of manufacturing a portion of a folding chair that may be movable between a folded position and an unfolded position. The method may include providing an at least substantially assembled frame, the frame may include a first side including a first front leg and a first rear leg, and a second side may include a second front leg and a second rear leg, connecting a first bracket to the first side of the frame, the first bracket may include one or more attachment portions that extend downwardly towards a lower portion of the first bracket, connecting a second bracket to the second side of the frame, the second bracket may include one or more attachment portions that extend downwardly towards a lower portion of the second bracket, providing a seat that may include a first sidewall with one or more attachment portions, and a second sidewall may include one or more attachment portions, aligning the one or more attachment portions of the first sidewall of the seat with the one or more attachment portions of the first bracket, aligning the one or more attachment portions of the second sidewall of the seat with the one or more attachment portions of the second bracket, disposing the first sidewall of the seat proximate an upper portion of the first bracket, disposing the second sidewall of the seat proximate an upper portion of the second bracket, inserting the first sidewall of the seat into the first bracket along an axis from an upper portion of the first bracket towards the lower portion of the first bracket, inserting the second sidewall of the seat into the second bracket along an axis from an upper portion of the second bracket towards the lower portion of the second bracket, engaging the one or more attachment portions of the first bracket and the one or more attachment portions of the first sidewall to connect the seat to the first bracket, and engaging the one or more attachment portions of the second bracket and the one or more attachment portions of the second sidewall to connect the seat to the second bracket.

Yet another aspect is a method of manufacturing a portion of a folding chair that includes attaching the seat to the first bracket and the second bracket when the frame is in a folded position. The one or more attachment portions of the first bracket may include portions that extend inwardly and downwardly relative to an inner portion of the first bracket, the one or more attachment portions of the second bracket may include portions that extend inwardly and downwardly relative to an inner portion of the second bracket, the one or more attachment portions of the first sidewall of the seat may be receiving portions that receive the inwardly and downwardly portions of the first bracket when the seat is connected to the first bracket, and the one or more attachment portions of the second sidewall of the seat may be receiving portions that receive the inwardly and downwardly portions of the second bracket when the seat is connected to the second bracket.

These and other aspects, features, and advantages of the present invention will become more fully apparent from the following brief description of the drawings, the drawings, the detailed description of preferred embodiments, and appended claims.

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships, and configurations of the invention, the drawings are not intended to limit the scope of the claimed invention. The invention will be described and explained with additional specificity and detail through the use of the accompanying drawings in which:

DETAILED DESCRIPTION

Figure 1:
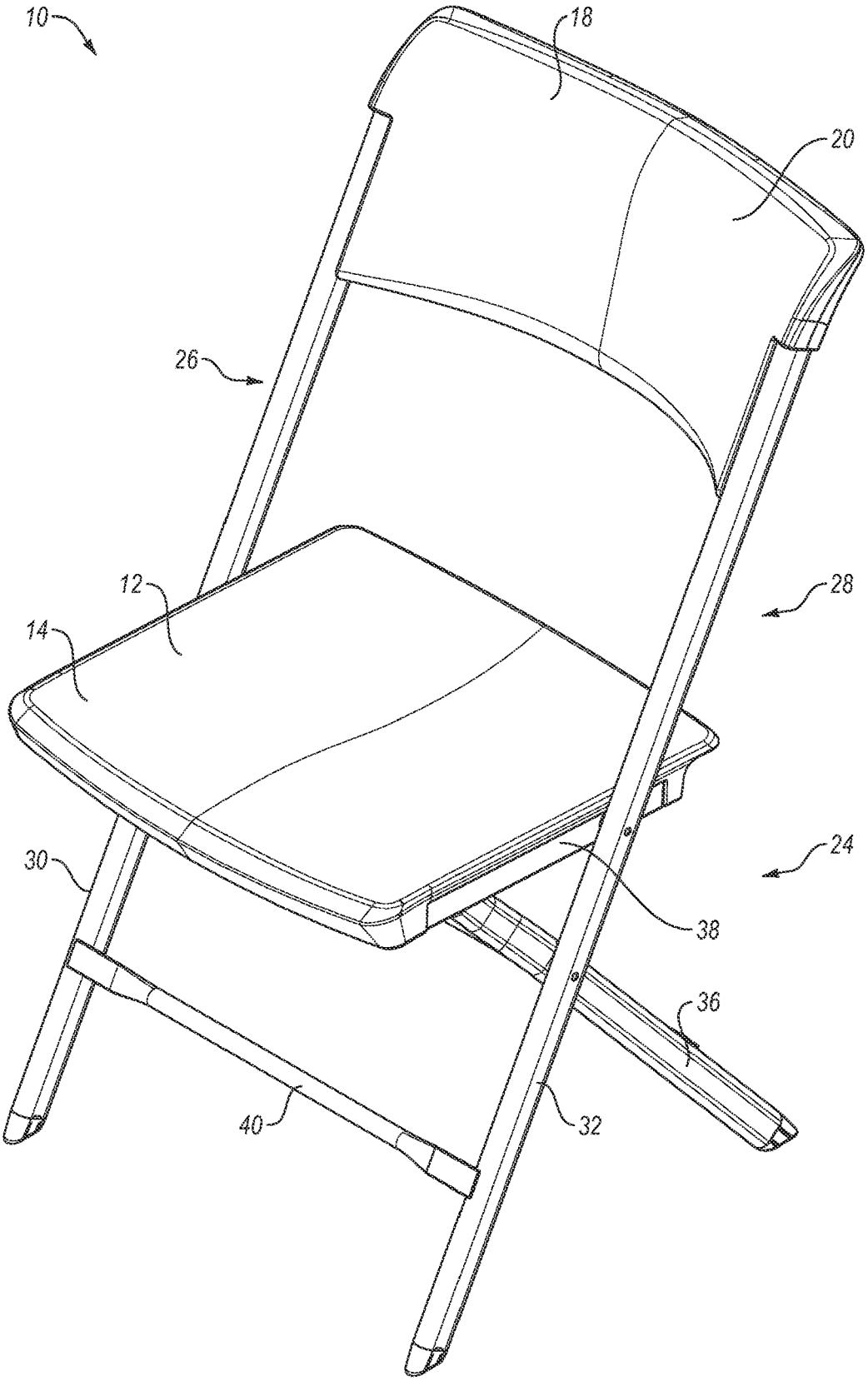
FIG. 1 is an upper perspective view of an example chair.
Figure 2:
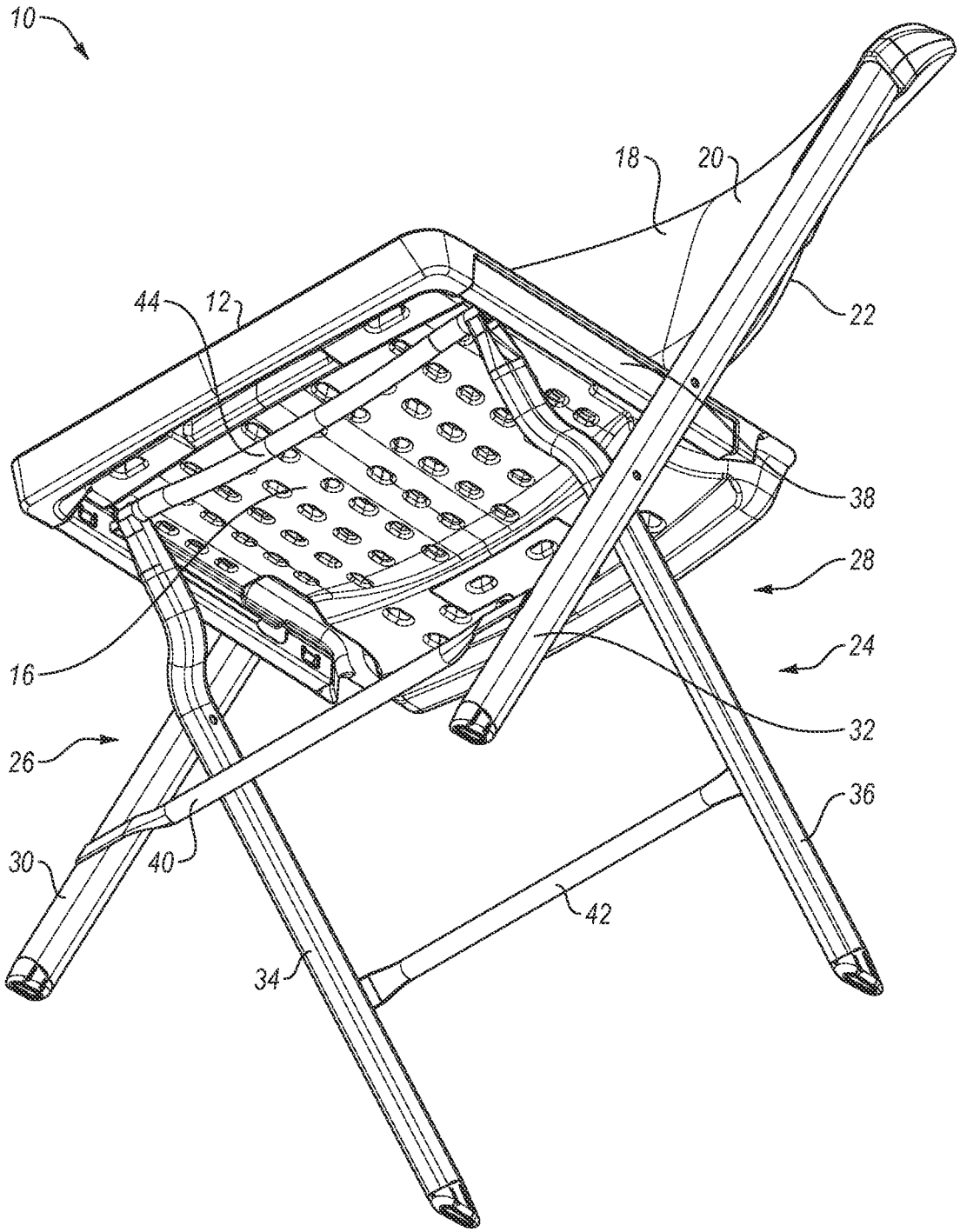
FIG. 2 is a lower perspective view of the chair shown in FIG. 1.
Figure 3:
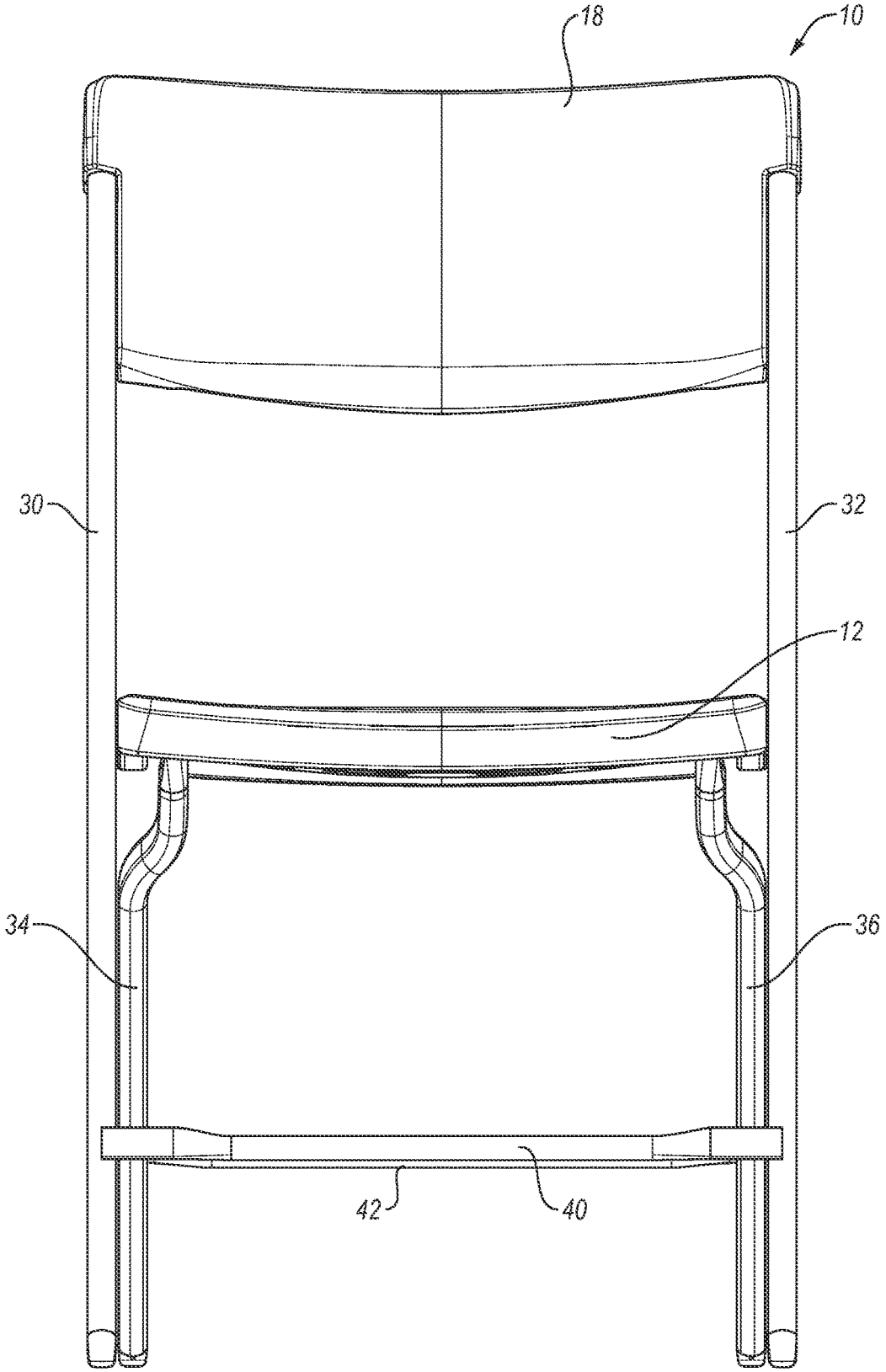
FIG. 3 is a front view of the chair shown in FIG. 1.
Figure 4:
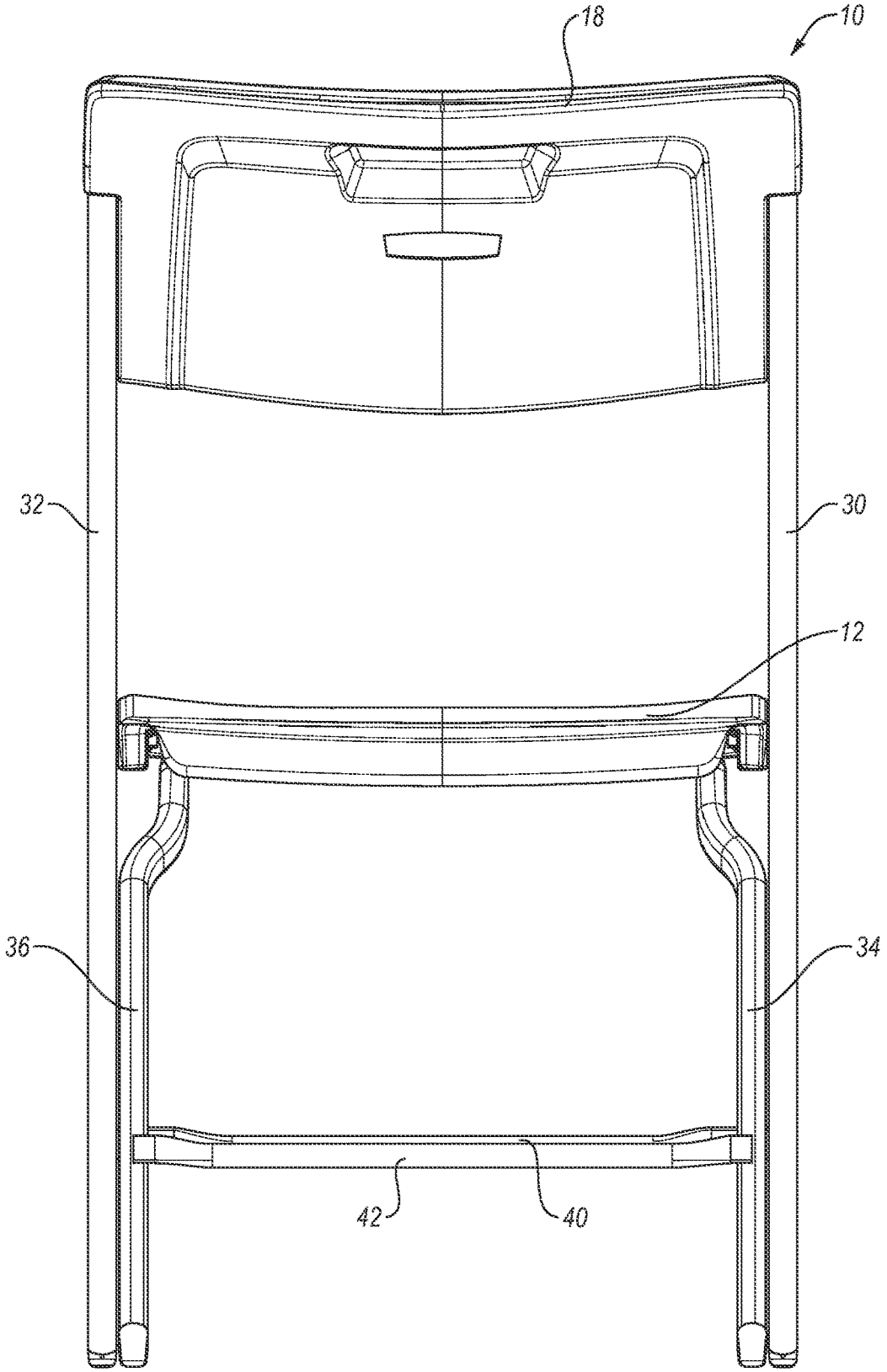
FIG. 4 is a rear view of the chair shown in FIG. 1.
Figure 5:
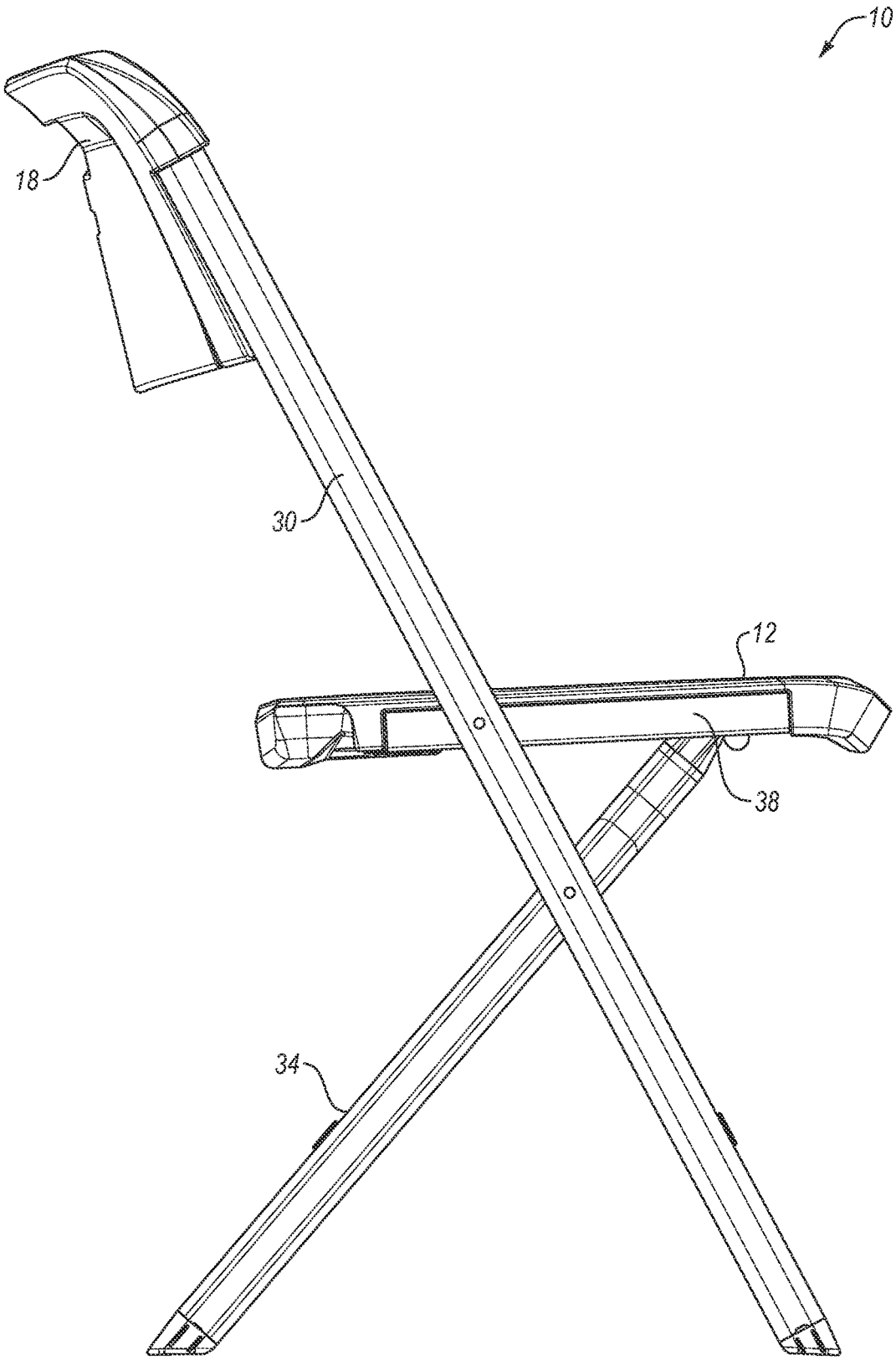
FIG. 5 is a left side view of the chair shown in FIG. 1.
Figure 6:
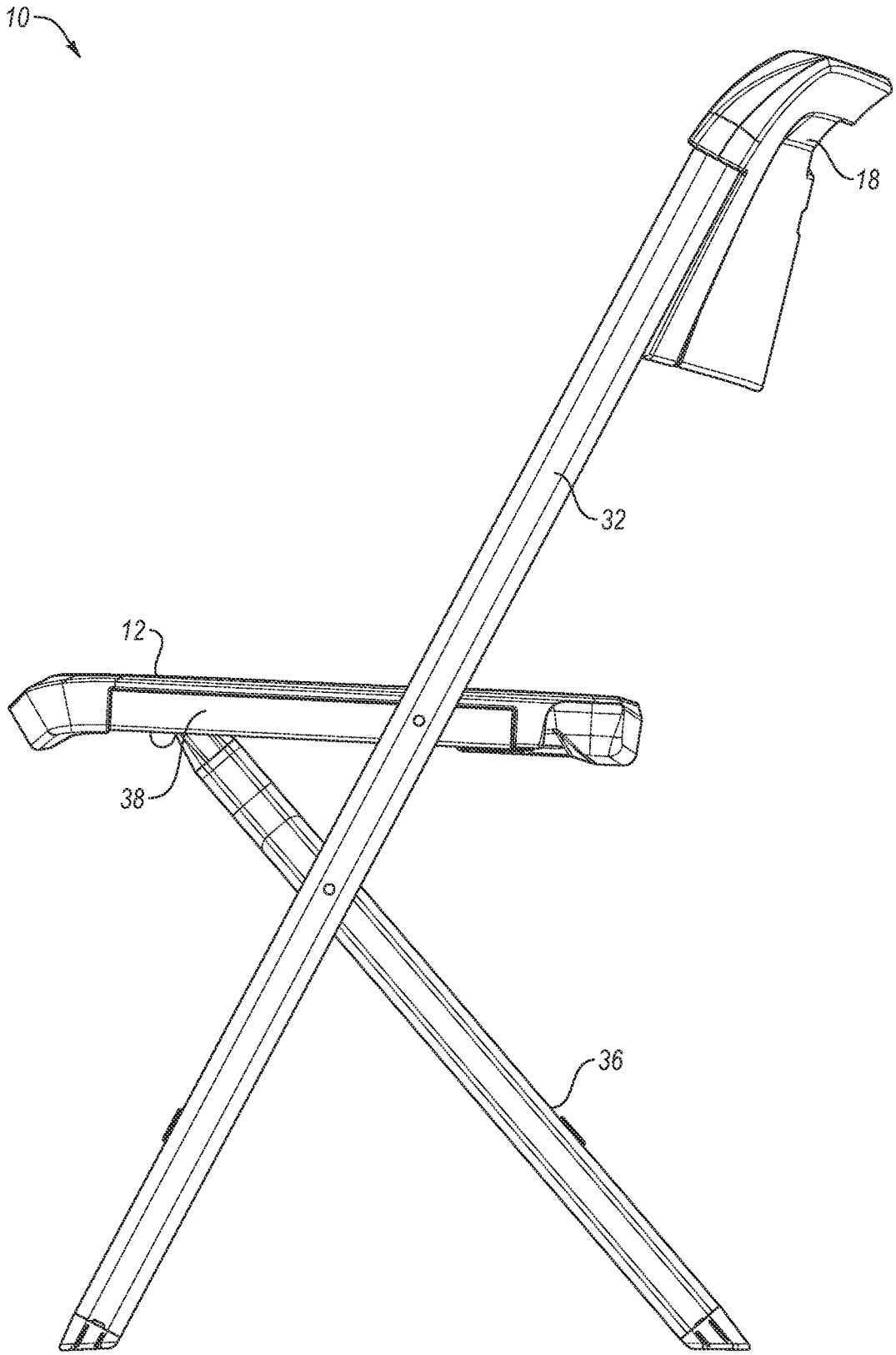
FIG. 6 is a right side view of the chair shown in FIG. 1.
Figure 7:
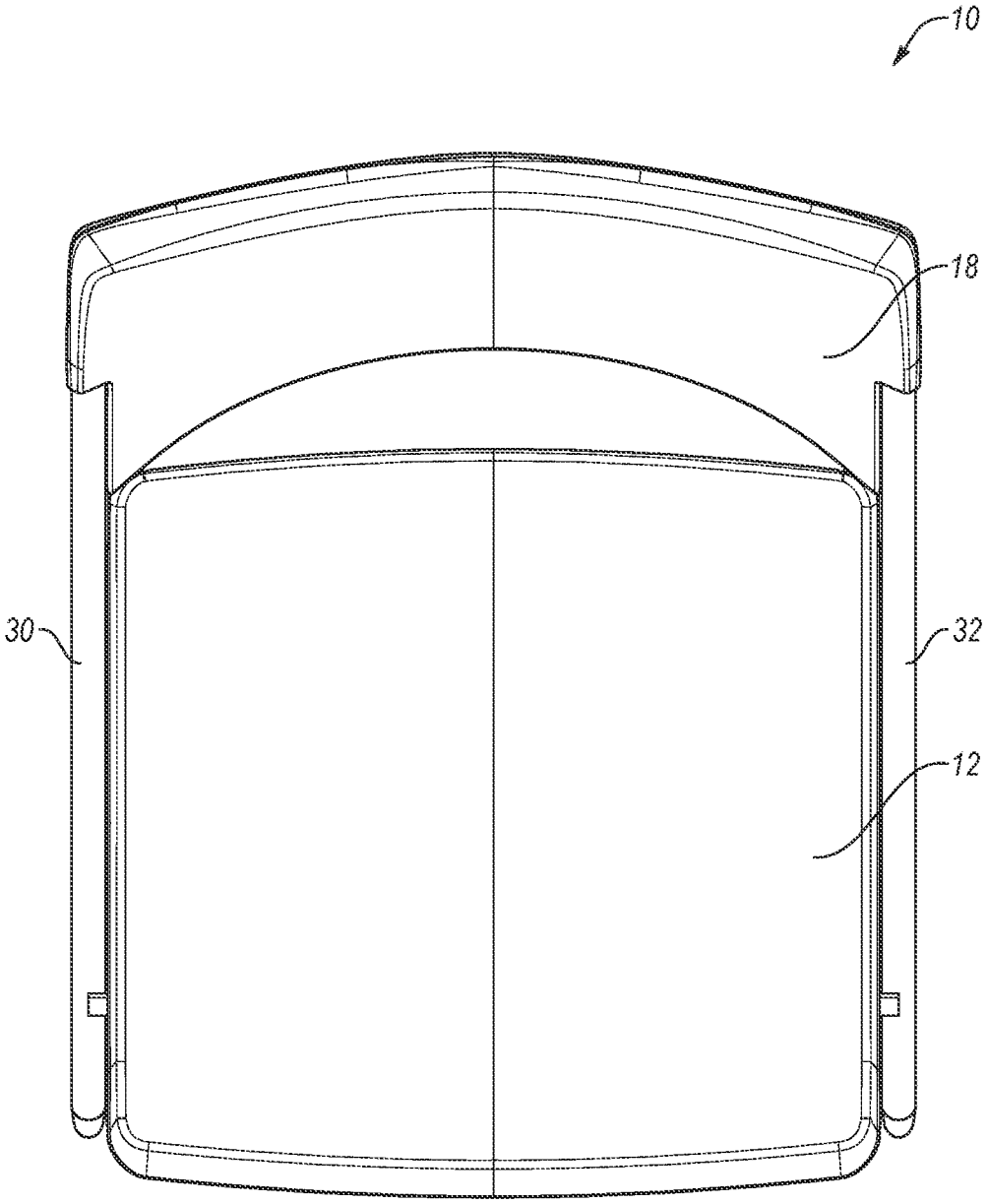
FIG. 7 is a top view of the chair shown in FIG. 1.
Figure 8:
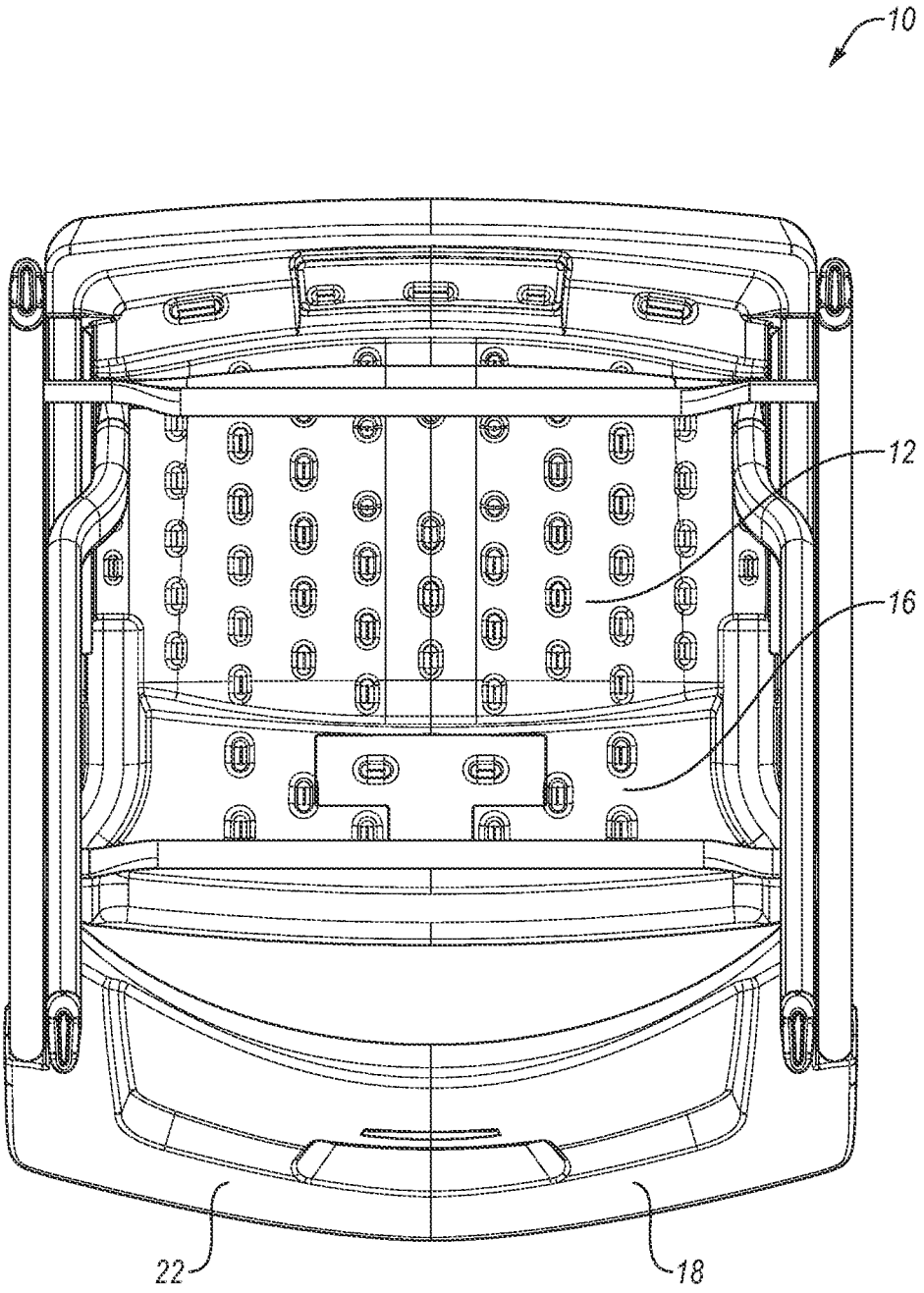
FIG. 8 is a bottom view of the chair shown in FIG. 1.

The present invention is generally directed towards chairs. The principles of the present invention, however, are not limited to chairs. It will be understood that, in light of the present disclosure, the chairs disclosed herein may have a variety of shapes, sizes, configurations, and arrangements. It will also be understood that chairs may include any suitable number and combination of features, components, aspects, and the like. In addition, while the chairs shown in the accompanying figures are illustrated as having particular styles, it will be appreciated the chairs may have other suitable styles and/or configurations. Further, the chair disclosed herein may have other configurations and arrangements such as glider chairs, stacking chairs, and the like.

Additionally, to assist in the description of various example embodiments of the chairs, words such as top, bottom, front, rear, sides, right, and left are used to describe the accompanying figures which may be, but are not necessarily, drawn to scale. It will further be appreciated the chairs may be disposed in a variety of desired positions or orientations, and used in numerous locations, environments, and arrangements. A detailed description of example embodiments of the chairs now follows.

FIGS. 1-8 illustrate an example embodiment of a chair 10, and the chair may include a seat 12. The seat 12 may have an upper portion or surface 14 and a lower portion or surface 16. The chair 10 may include a back or backrest 18, which may have a front portion or surface 20 and a rear portion or surface 22. A frame 24 may support the seat 12 and the backrest 18. The frame 24 may include a right side portion 26 and a left side portion 28, and the frame may include one or more supports or legs, which may be used to support the chair 10 above a surface such as a floor or the ground. In an example embodiment, the chair may include a right front leg 30, a left front leg 32, a right rear leg 34, and a left rear leg 36. The right front leg 30 and the right rear leg 34 may form a right leg assembly, which may be disposed on the right side of the chair 10, and the left front leg 32 and the left rear leg 36 may for a left leg assembly, which may be disposed on the left side of the chair. The right front leg 30 and the right rear leg 34 may be pivotally connected, and the left front leg 32 and the left rear leg 36 may be pivotally connected. The legs 30, 32, 34, 36 may be pivotally connected by fasteners, pins, rivets, and the like. After reviewing this disclosure, one of ordinary skill in the art will appreciate that the chair 10 may have any suitable number of legs and the legs may have assorted sizes, shapes, configurations, and arrangements depending, for example, upon the intended use of the chair.

The chair 10 may include other parts and components, such as one or more brackets 38, and the brackets may be used to connect the seat 12 to the chair 10. For instance, a bracket 38 may be connected to the right front leg 30 and a bracket 38 may be connected to the left front leg 32. The brackets 38 may be part of the frame 24, or the brackets may be attached to the frame. The brackets 38 may be pivotally connected to the legs 30, 32 by fasteners, pins, rivets, and the like. One of ordinary skill in the art, after reviewing this disclosure, will appreciate that the chair 10 may include other parts and components, such as armrests and the like.

The chair 10 may be sized and configured for use by a single person, but the chair could also be smaller, such as a kid's chair, or larger, such as a two-person chair. The chair 10 may have other suitable designs depending, for example, upon its intended appearance, aesthetics, and the like. It will be understood that the chair 10 could have a variety of suitable shapes, sizes, and configurations, depending, for example, upon the intended use of the chair.

At least a portion of the chair 10 may be constructed from plastic, such as blow-molded plastic. For example, the seat 12 and/or backrest 18 may be constructed from blow-molded plastic. Advantageously, the blow-molded plastic seat 12 and backrest 18 may allow a strong, durable, and/or lightweight chair 10 to be quickly and efficiently manufactured. The seat 12 and backrest 18 could also be formed by other methods or processes such as injection molding, extrusion molding, vacuum forming, tumble molding, rotary molding, and the like. The seat 12 and backrest 18 may also be manufactured from different processes. For example, the seat 12 could be constructed from blow-molded plastic and the backrest 18 could be formed from vacuum or injection molded plastic. One of ordinary skill in the art, after reviewing this disclosure, will appreciate that any suitable portions of the chair 10 can be constructed from plastic. One of ordinary skill in the art, after reviewing this disclosure, will also appreciate that the chair 10, including the seat 12 and the backrest 18, may be constructed from other suitable materials such as wood, fabric, leather, nylon, acrylic, and the like.

One or more portions of the chair 10, such as the frame 24, the legs 30, 32, 34, and 36, and/or the brackets 38, may be constructed from strong and durable materials, such as metal. In an example embodiment, the frame 24, the legs 30, 32, 34, and 36, and the brackets 38 may be constructed from steel. If the frame 24, the legs 30, 32, 34, and 36, and the brackets 38 are constructed from steel, the chair 10 may be strong, sturdy, and able to support a significant amount of weight.

In an example embodiment, the legs 30, 32, 34, and 36 may be constructed from hollow metal tubes, and the metal tubing may be bent or formed into the desired shapes and configurations. For example, the legs 30, 32, 34, and 36 may have a generally oblong configuration with generally flat or planar sections and rounded sections. The legs 30, 32, 34, and 36 could have other suitable sizes, shapes, configurations, and/or arrangements, such as circular, square, rectangular, oval, and the like. The legs 30, 32, 34, and 36 may also be constructed from other materials with appropriate characteristics. After reviewing this disclosure, one of ordinary skill in the art will appreciate that the frame 24, legs 30, 32, 34, and 36, and brackets 38 may be constructed from other materials and have other suitable sizes, shapes configurations, and arrangements depending, for example, upon the intended use of the chair 10.

Figure 9:
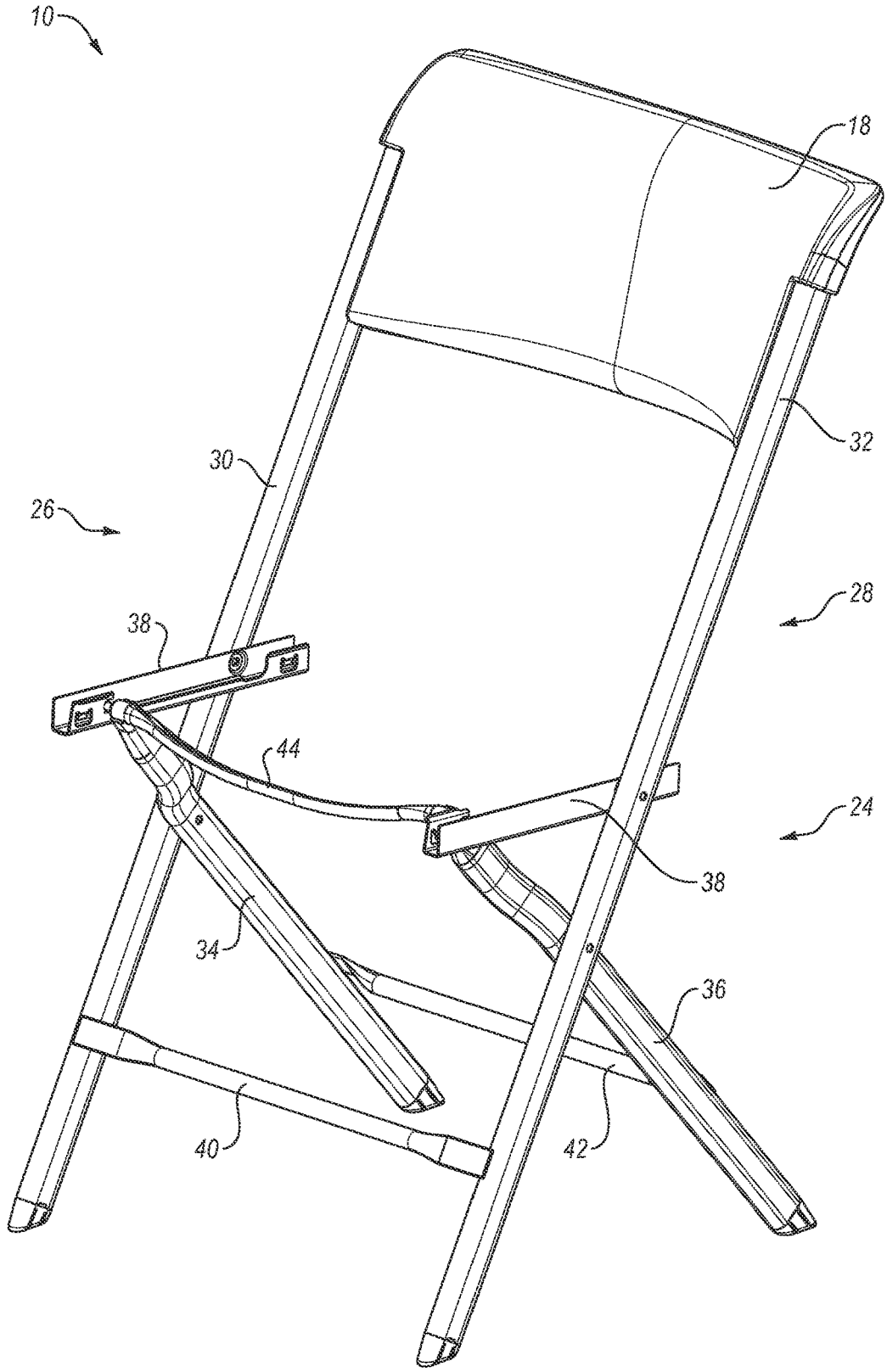
FIG. 9 is an upper perspective view of an example chair frame.

As shown in FIG. 9, for example, the chair 10 may include one or more crossmembers, and the crossmembers may be connected to portions of the frame 24, such as the legs 30, 32, 34, and 36. For example, a front lower crossmember 40 may be connected to the front legs 30, 32, and a rear lower crossmember 42 may be connected to the rear legs 34, 36. An upper crossmember 44 may be connected to an upper portion of the legs, such as an upper portion of the rear legs 34, 36. The example crossmembers 40, 42, 44 may be attached to the legs 30, 32, 34, 36 in a fixed position, such as by welding, and the crossmembers may be formed by a tube, bar, or the like. In an example embodiment, the lower crossmembers 40, 42 may have a generally tubular configuration and the ends of the crossmembers may be flattened or compressed, which may facilitate attachment of the crossmembers to the legs 30, 32, 34, 36. The lower crossmembers 40, 42 may form at least a portion of a stop, which may help prevent unintended movement of the chair 10. For instance, the front lower crossmember 40 may create a stop when folding the chair 10 into the collapsed position.

The upper crossmember 44 may have a generally tubular configuration, and the upper crossmember may be constructed from metal tubing with a relatively larger diameter, such as between ¼ inches and ½ inch. In an example embodiment, the upper portion of the rear legs 34, 36 may include rounded or curved portions, such as cutouts or recesses, and the upper crossmember 44 may be at least partially disposed in the recesses. The upper crossmember 44 may be securely connected to the legs 34, 36, such as by welding, fusing, bonding, and the like. The upper crossmember 44 may have an arched or curved configuration, and the arched configuration of the crossmember 44 may at least partially correspond to a curved portion of the lower surface 16 of the seat 12. For example, a portion of the lower surface 16 of the seat 12 may curve downwardly, and an arched portion of the upper crossmember 44 may curve downwardly. The downwardly curved portion of the upper crossmember 44 and the downwardly curved lower surface 16 of the seat 12 may generally match or be similar. Thus, a nominal distance between the upper crossmember 44 and the lower surface 16 of the seat 12 may be generally constant. The nominal distance between the upper crossmember 44 and the lower surface 16 of the seat 12 may reduce or eliminate pinch points and, because the nominal distance may be small, such as ¼ inch or less, the upper crossmember may support a portion of the seat.

The upper portion of the rear legs 34, 36 and the upper crossmember 44 may be movable relative to the seat 12. For example, the upper portion of the rear legs 34, 36 and the upper crossmember 44 may be slidable relative to the lower portion 16 of the seat 12. In an example embodiment, the upper portion of the rear legs 34, 36 and the upper crossmember 44 may be slidable relative to the lower portion 16 of the seat 12 while the chair 10 is folded and unfolded. The movement of the upper portion of the rear legs 34, 36 and/or the upper crossmember 44 may be controlled, which may allow the chair 10 to be easily folded and unfolded.

Figure 10:
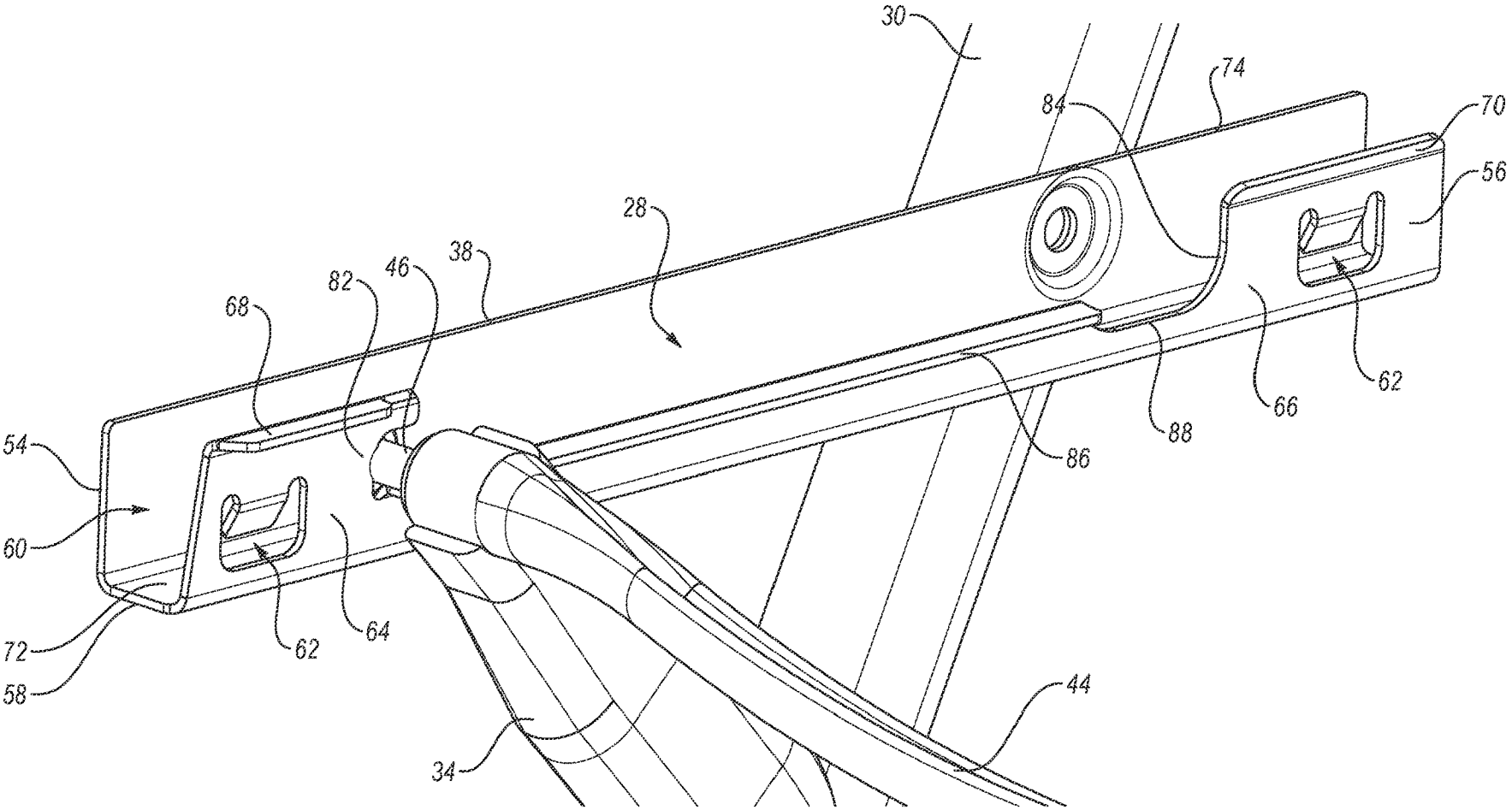
FIG. 10 is an enlarged perspective view of a portion of the chair frame shown in FIG. 9.
Figure 11:
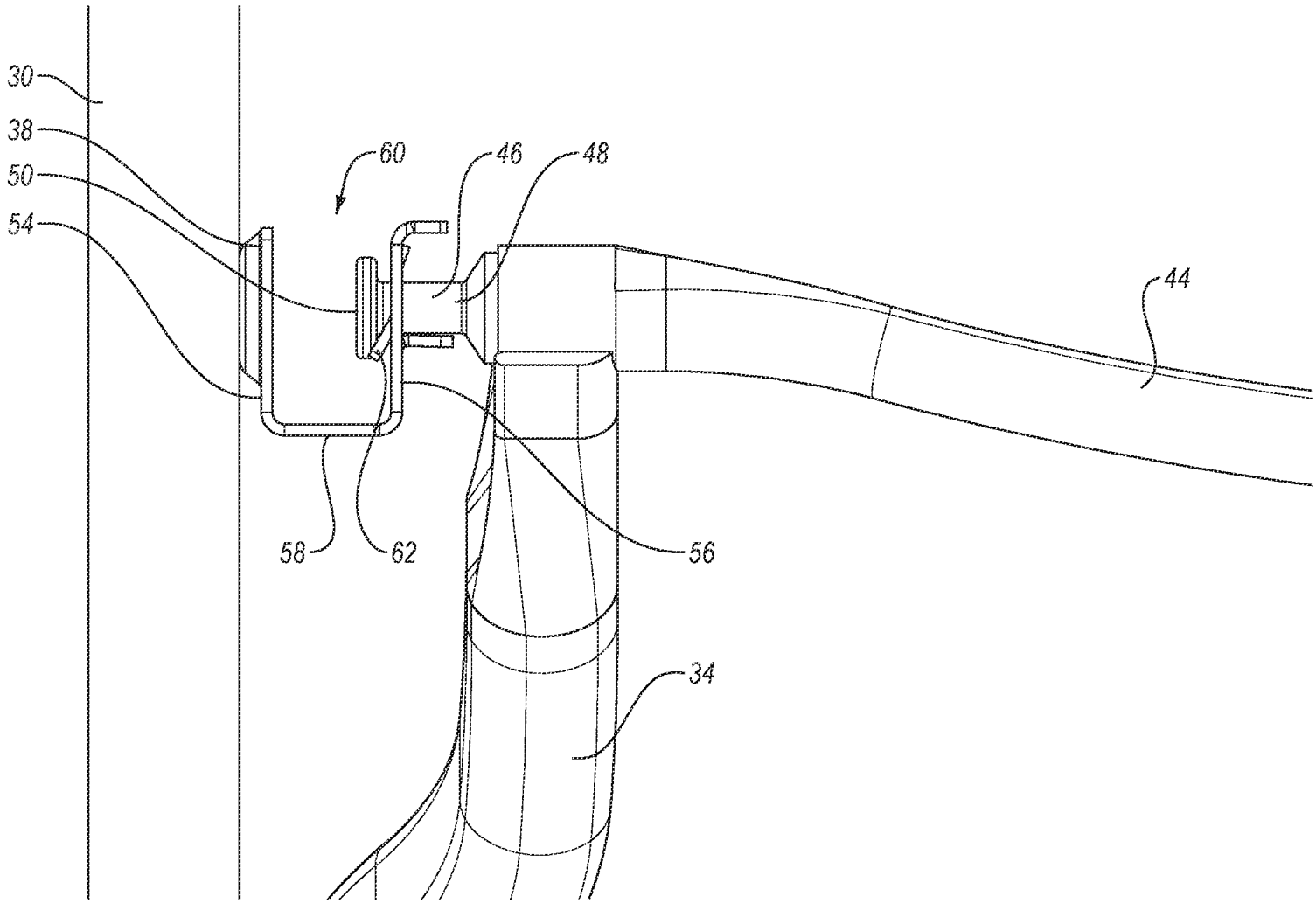
FIG. 11 is an enlarged front view of a portion of the chair frame shown in FIG. 9.
Figure 12:
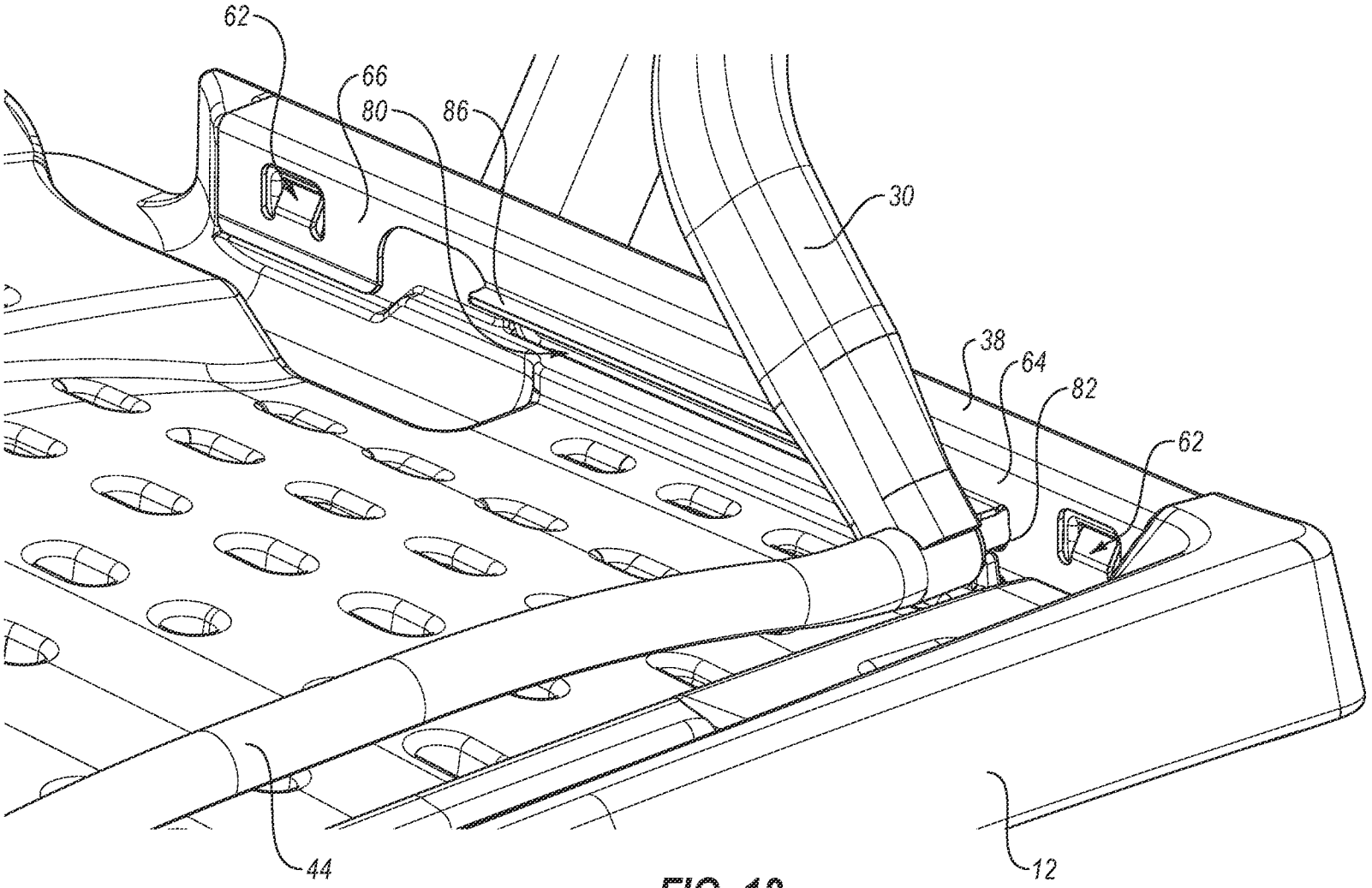
FIG. 12 is an enlarged front, lower perspective view of a portion of the chair frame shown in FIG. 9.
Figure 13:
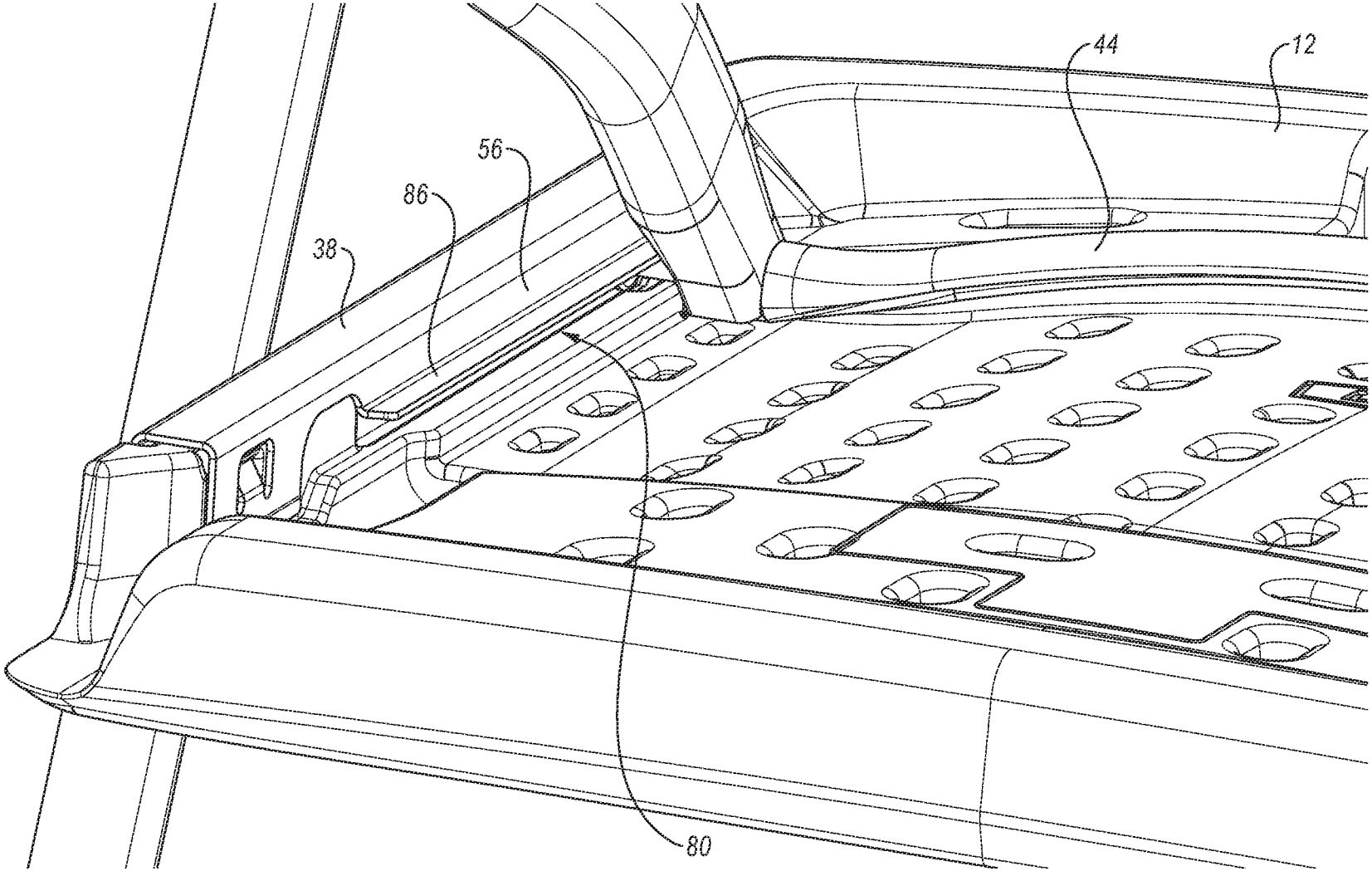
FIG. 13 is an enlarged rear, lower perspective view of a portion of the chair frame shown in FIG. 9.

In an example embodiment, such as shown in FIGS. 10-12, the upper crossmember 44 may include one or more guide members 46, and a guide member may be attached to each end of the upper crossmember. For example, a guide member 46 may be at least partially disposed, inserted into, or connected to an end of the upper crossmember 44, and the guide member may include a body 48 and an enlarged end such as a head 50. For instance, the guide member 46 may be a stud, and the stud may be inserted into an end of the upper crossmember 44. The stud 46 may be securely attached to the upper crossmember 44 by welding, fusing, bonding, adhesives, and the like. The stud 46 may include an elongated body 48 and an enlarged head 50.

The guide member 46 may be movable or slidable within a guide 52, and the guide may be formed by at least a portion of the bracket 38 and/or a portion of the seat 12, such as a downwardly extending portion of the lower surface 16 of the seat. In an example embodiment, when the chair 10 is folded and unfolded, the guide members 46 and the guide 52 may at least partially control movement of the upper crossmember 44 and/or the rear legs 34, 36.

In an example embodiment, the bracket 38 may have a generally U-shaped configuration with walls 54, 56, and a connecting portion 58. For example, as shown in FIGS. 10-19, the wall 54 may be an outer wall, such as an outer sidewall, and the wall 56 may be an inner wall, such as an inner sidewall. The connecting portion 58 may form a lower portion of the bracket 38. The bracket 38 may include an interior portion 60, and the interior portion may be at least partially disposed between the walls 54, 56.

Figure 14:
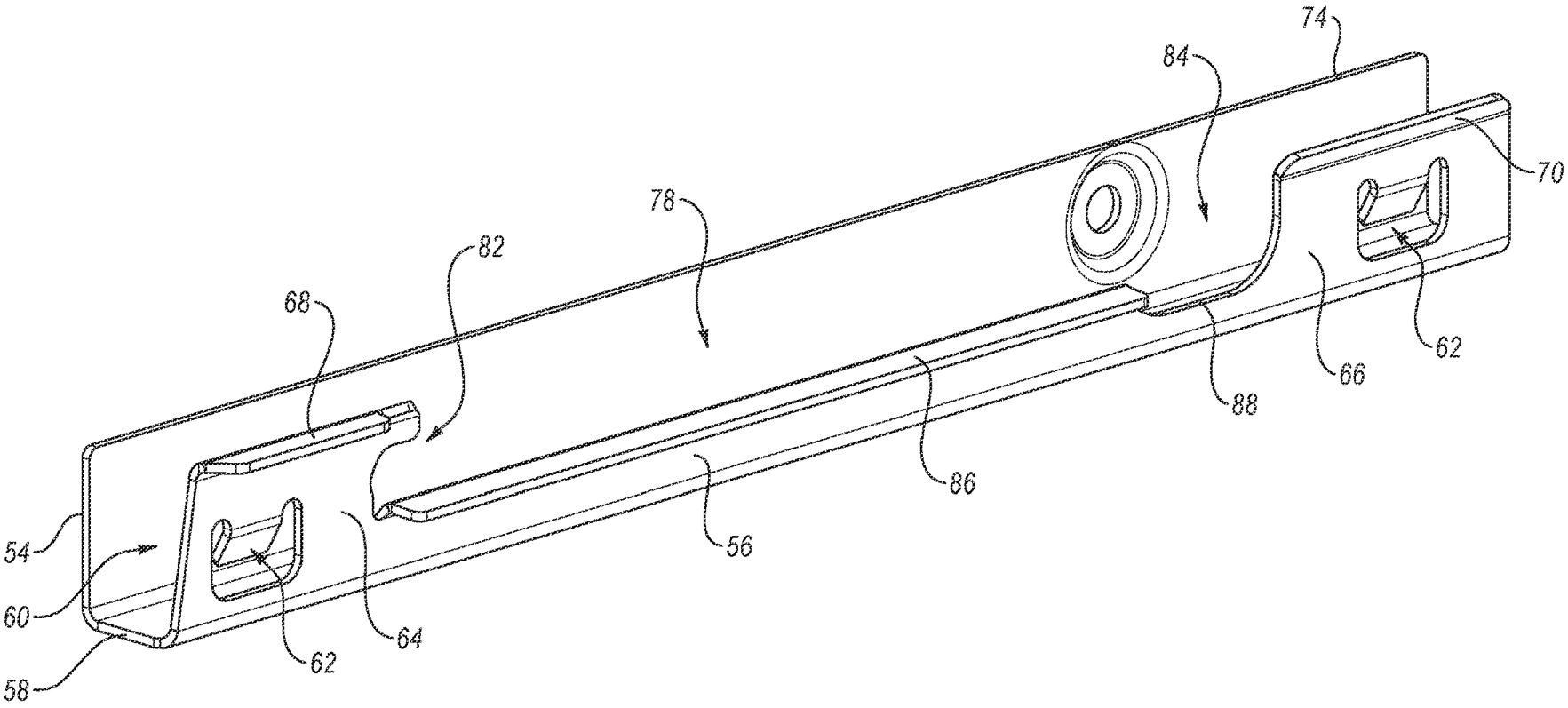
FIG. 14 is a front perspective view of an example bracket.
Figure 15:
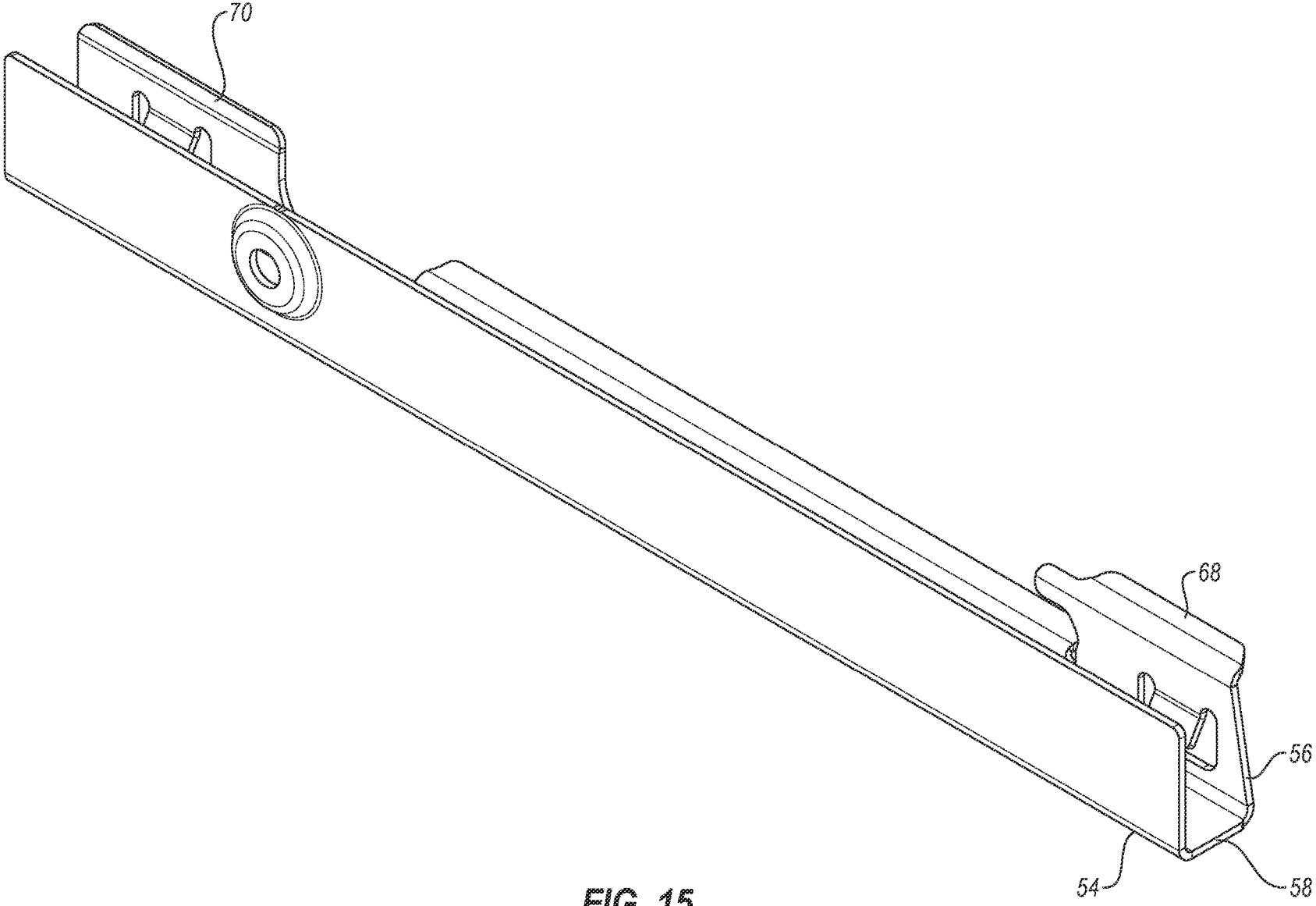
FIG. 15 is a rear perspective view of the bracket shown in FIG. 14.
Figure 16:
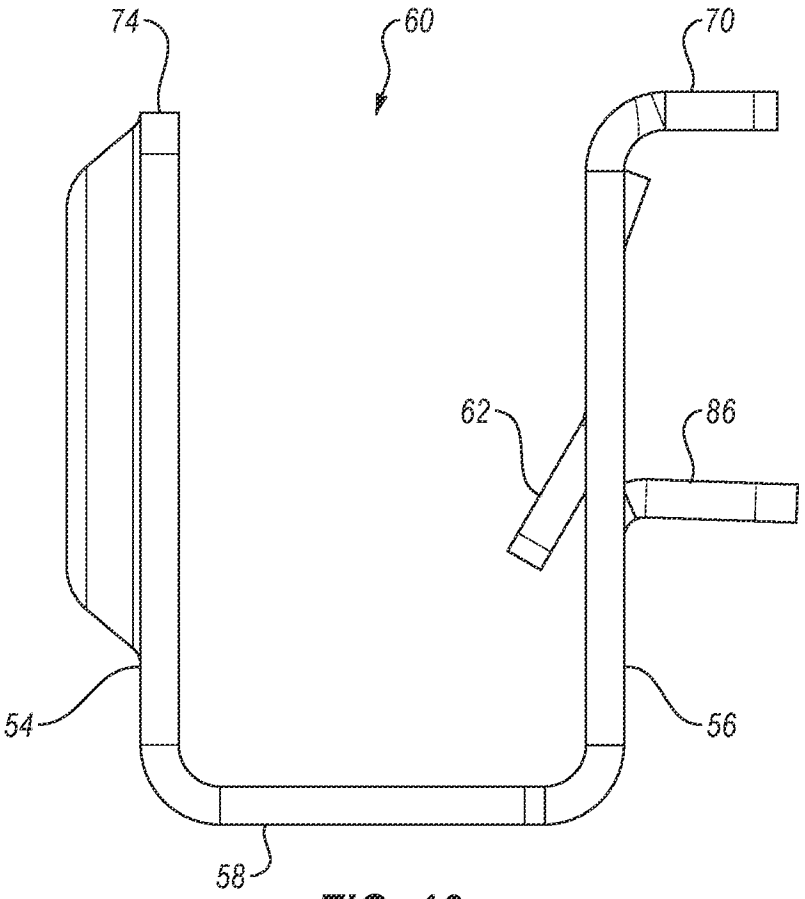
FIG. 16 is a front view of the example bracket shown in FIG. 14.
Figure 17:
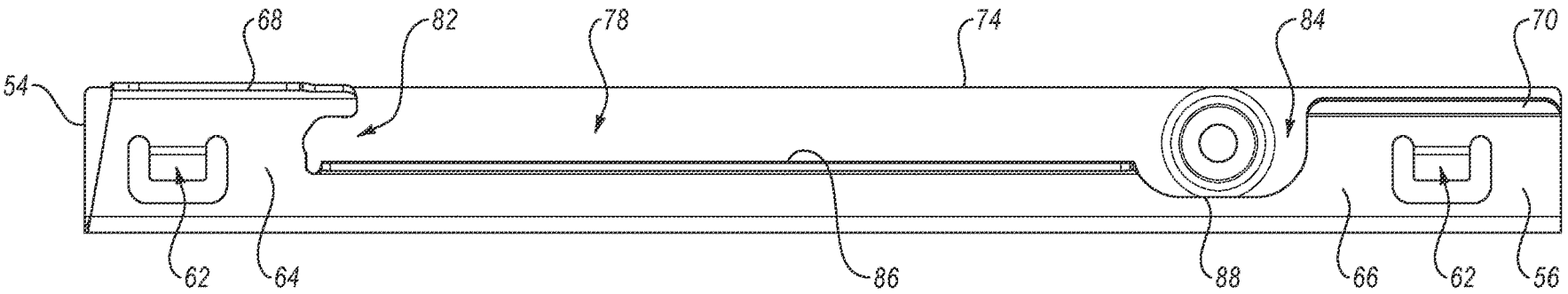
FIG. 17 is a right side view of the example bracket shown in FIG. 14.
Figure 18:
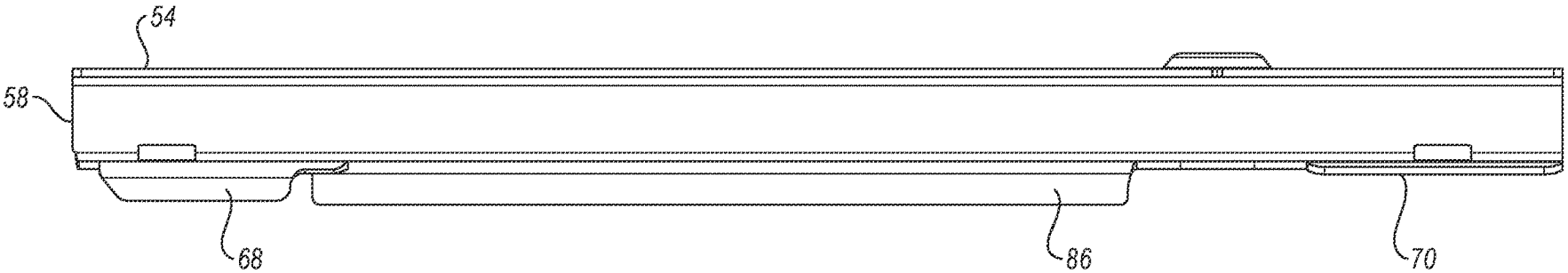
FIG. 18 is a top view of the example bracket shown in FIG. 14.
Figure 19:
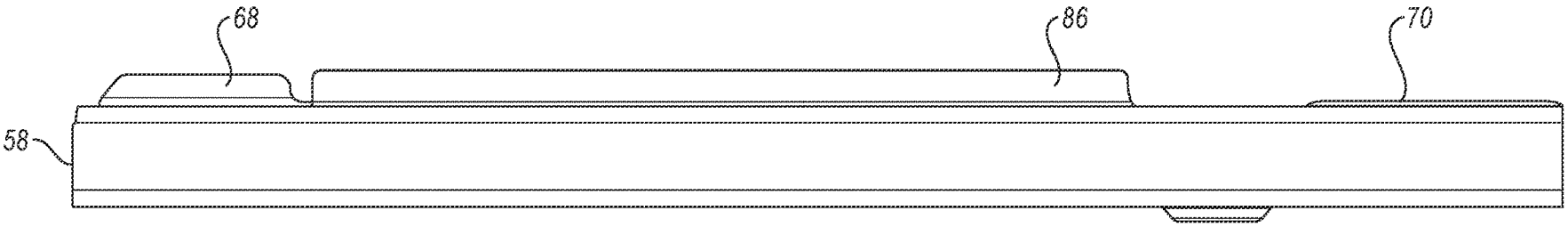
FIG. 19 is a bottom view of the example bracket shown in FIG. 14.
Figure 20:
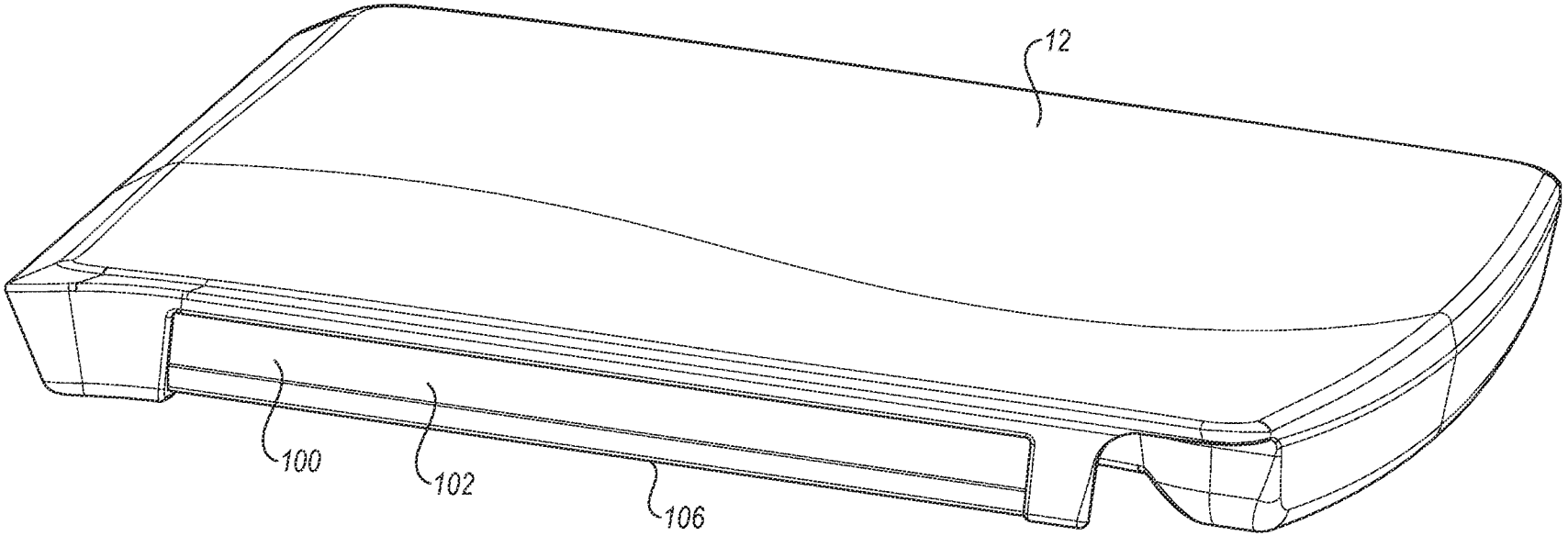
FIG. 20 is an upper perspective view of an example seat.
Figure 21:
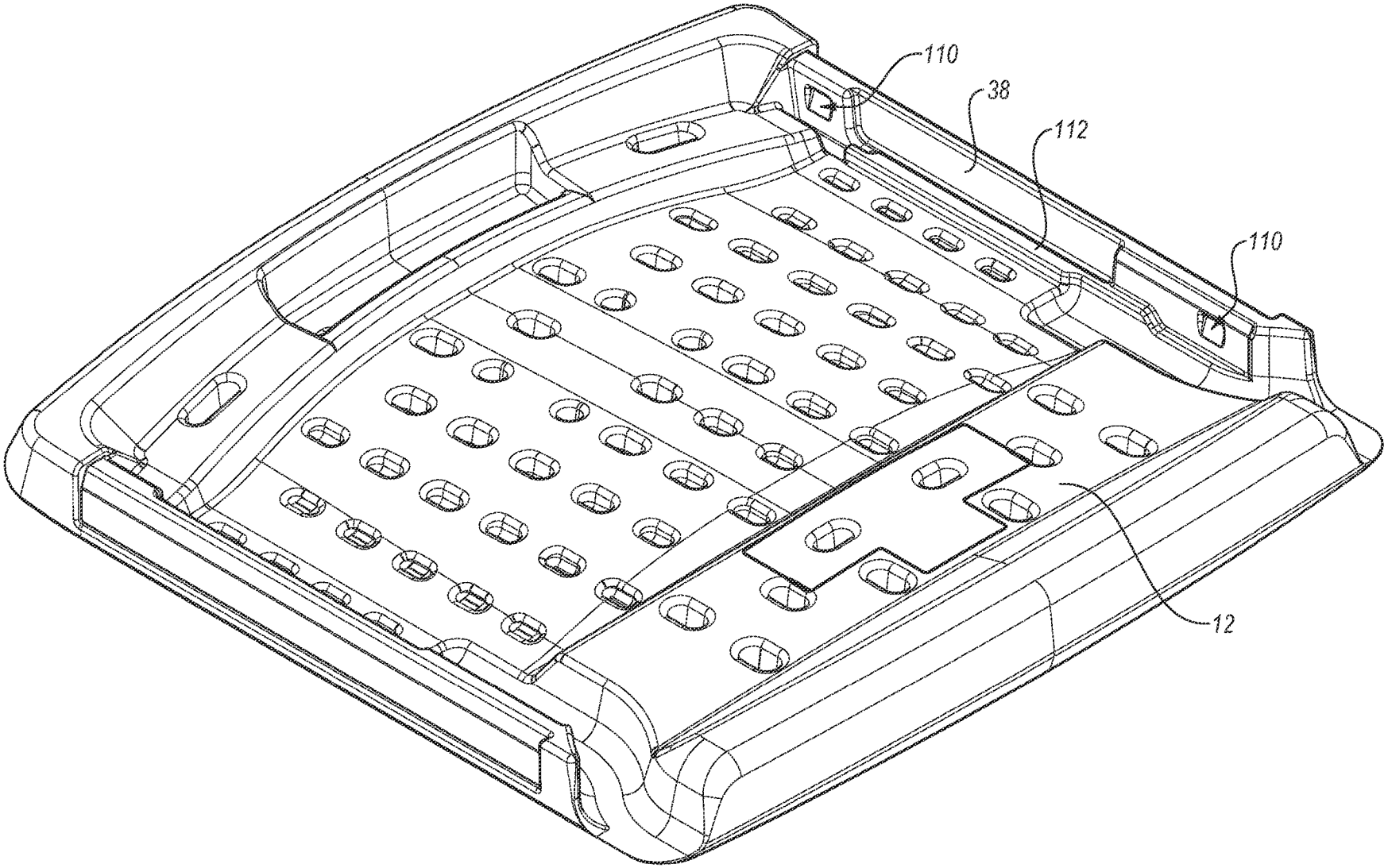
FIG. 21 is a lower perspective view of the seat shown in FIG. 20.
Figure 22:
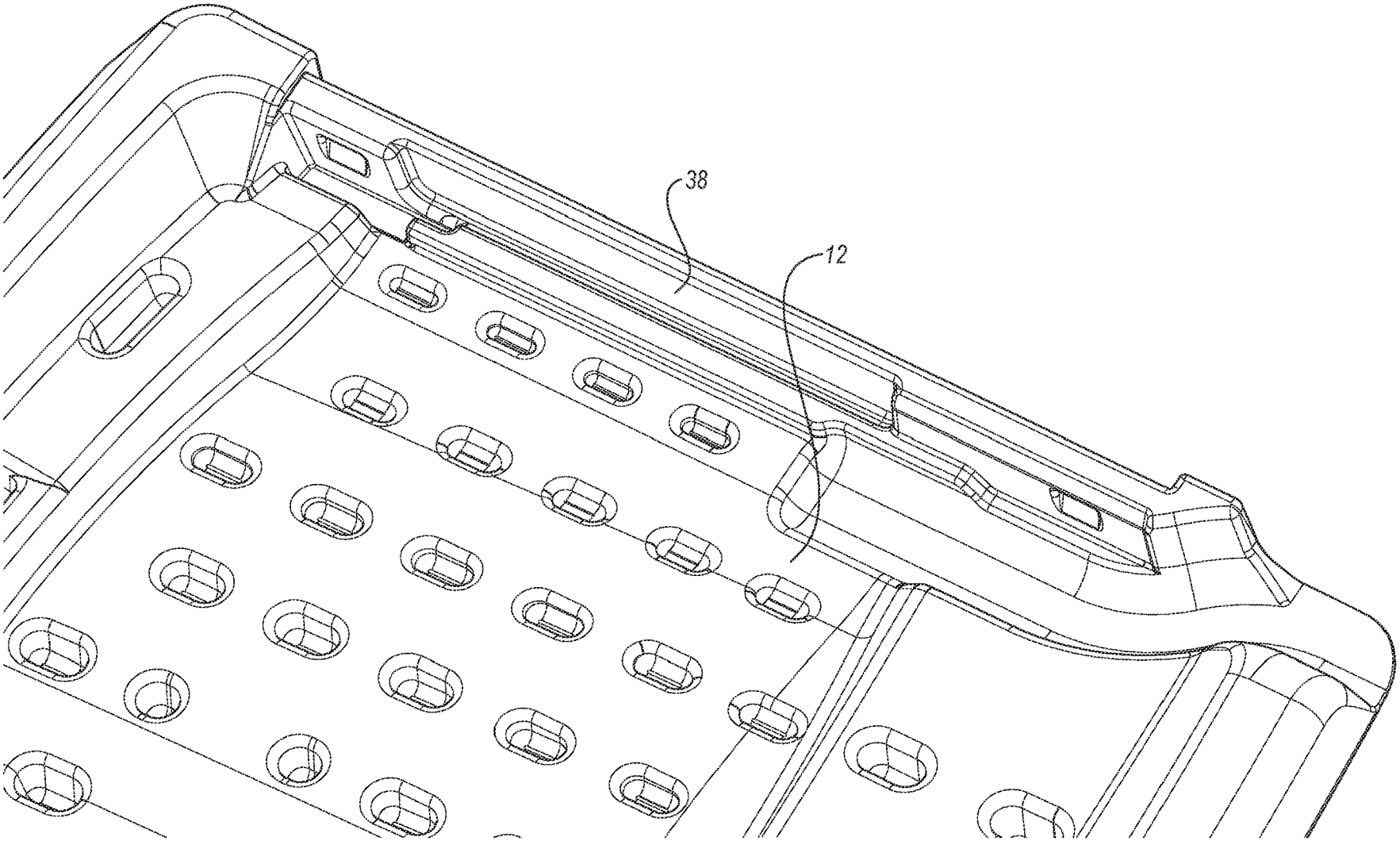
FIG. 22 is an enlarged lower perspective view of a portion of the seat shown in FIG. 20.
Figure 23:
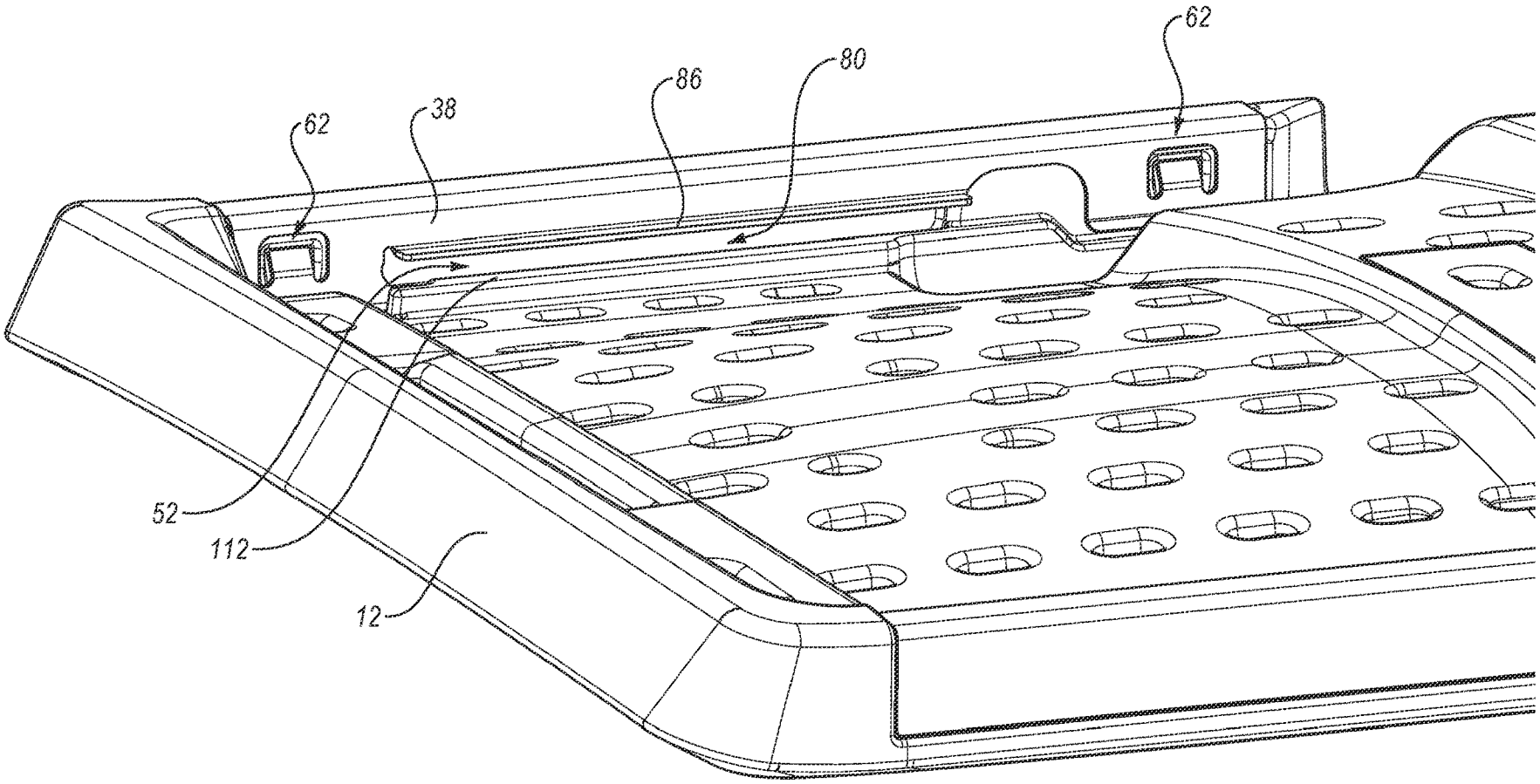
FIG. 23 is another enlarged lower perspective view of a portion of the seat shown in FIG. 20.
Figure 24:
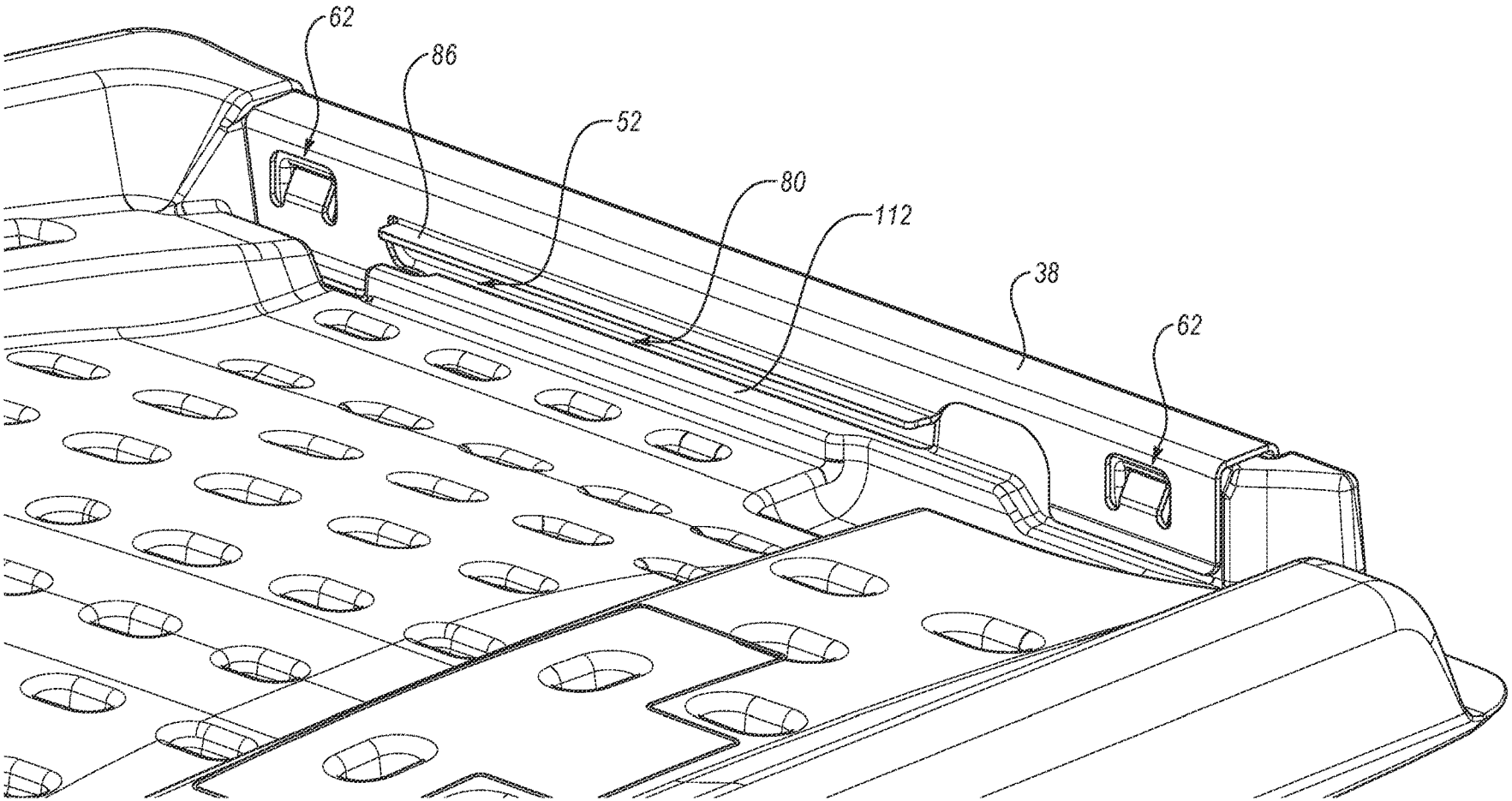
FIG. 24 is another enlarged lower perspective view of a portion of the seat shown in FIG. 20.
Figure 25:
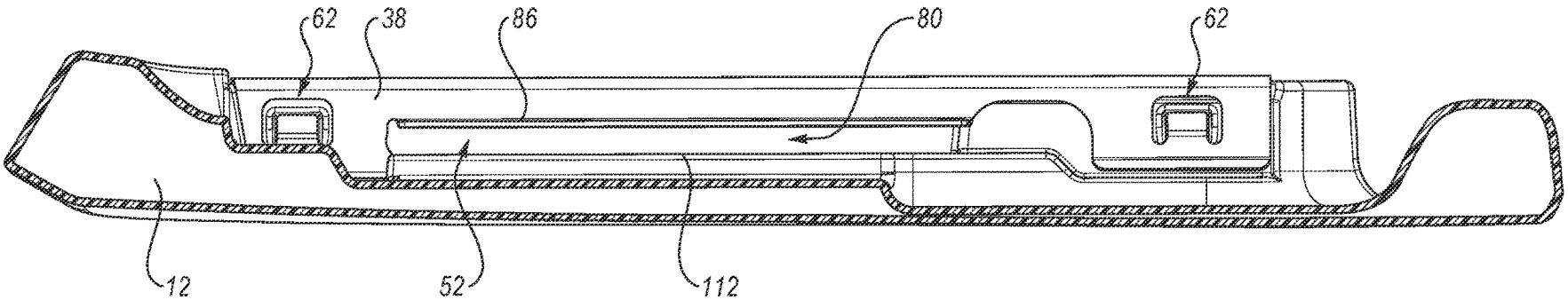
FIG. 25 is a cross-sectional side view of a portion of the seat shown in FIG. 20.

The bracket 38 may include one or more attachment portions 62 and the attachment portions may be sized and configured to facilitate attachment of the bracket and the seat 12. In an example embodiment, such as shown in FIG. 14, the attachment portions 62 may include one or more inwardly extending portions, such as tabs, and the inwardly extending attachment portions may be sized and configured to be at least partially disposed within corresponding attachment portions, such as receiving portions, of the seat 12. As shown in the accompanying figures, the inner sidewall 56 of the bracket 38 may include one or more attachment portions 62, such as two attachment portions. One attachment portion 62 may be disposed towards or proximate a front portion of the bracket 38, and another attachment portion may be disposed towards or proximate a rear portion of the bracket. The attachment portions 62 may be sized and configured to allow the seat 12 to be inserted downwardly relative to an upper portion of the bracket 38, and the attachment portions may be sized and configured to prevent the seat from being unintentionally removed from the bracket. For example, the seat 12 may be inserted downwardly relative to an upper portion of the bracket, the attachment portions 62 may include inwardly extending tabs, and the inwardly extending attachment portions may be disposed in corresponding receiving portions in the seat 12. A portion of the seat 12 and/or a portion of the attachment portions 62 may bend or deform while the seat is inserted into the bracket 38, and then seat and/or attachment portions may at least partially revert and/or resiliently return to the original configurations, which may help connect the bracket 38 and the seat 12.

The bracket 38 may include multiple support portions, such as support surfaces, which may be sized and configured to support the seat 12. In an example embodiment, the inner sidewall 56 of the bracket 38 may include a first portion 64, which may be disposed towards or proximate a front portion of the bracket, and a second portion 66, which may be disposed towards or proximate a rear portion of the bracket. An upper portion 68 of the front portion 64 of the bracket 38 may be sized and configured to support a portion of the seat 12, and an upper portion 70 of the rear portion 66 of the bracket may be sized and configured to support a portion of the seat. For example, the upper portion 68 of the front portion 64 of the bracket 38 may include an inwardly extending portion, which may have a generally planar upper surface, and the inwardly extending portion may be sized and configured to support the seat 12. The upper portion 70 of the rear portion 66 of the bracket 38 may include an inwardly extending portion, which may have a generally planar upper surface, and the inwardly extending portion may be sized and configured to support the seat 12.

The lower portion 58 of the bracket 38 may include an inner surface 72 and the inner surface may be sized and configured to support a portion of the seat 12, such as a lower portion of the downwardly extending lip or sidewall. The outer sidewall 54 of the bracket 38 may be sized and configured to contact, engage, abut., interlock, and/or be attached to a portion of the seat 12, such as an outer portion of the seat. For instance, the outer sidewall 54 of the bracket 38 may include an upper portion 74 and the upper portion may be sized and configured to contact, abut, connect, engage, interlock, and/or be disposed in a portion of the seat 12, such as a recess portion and/or attachment portion. Thus, in an example embodiment, the upper portion 74 of the outer sidewall 54 of the bracket 38 may be at least partially disposed in recessed portion of the seat 10, which may also be referred to as an attachment portion.

Figure 41:
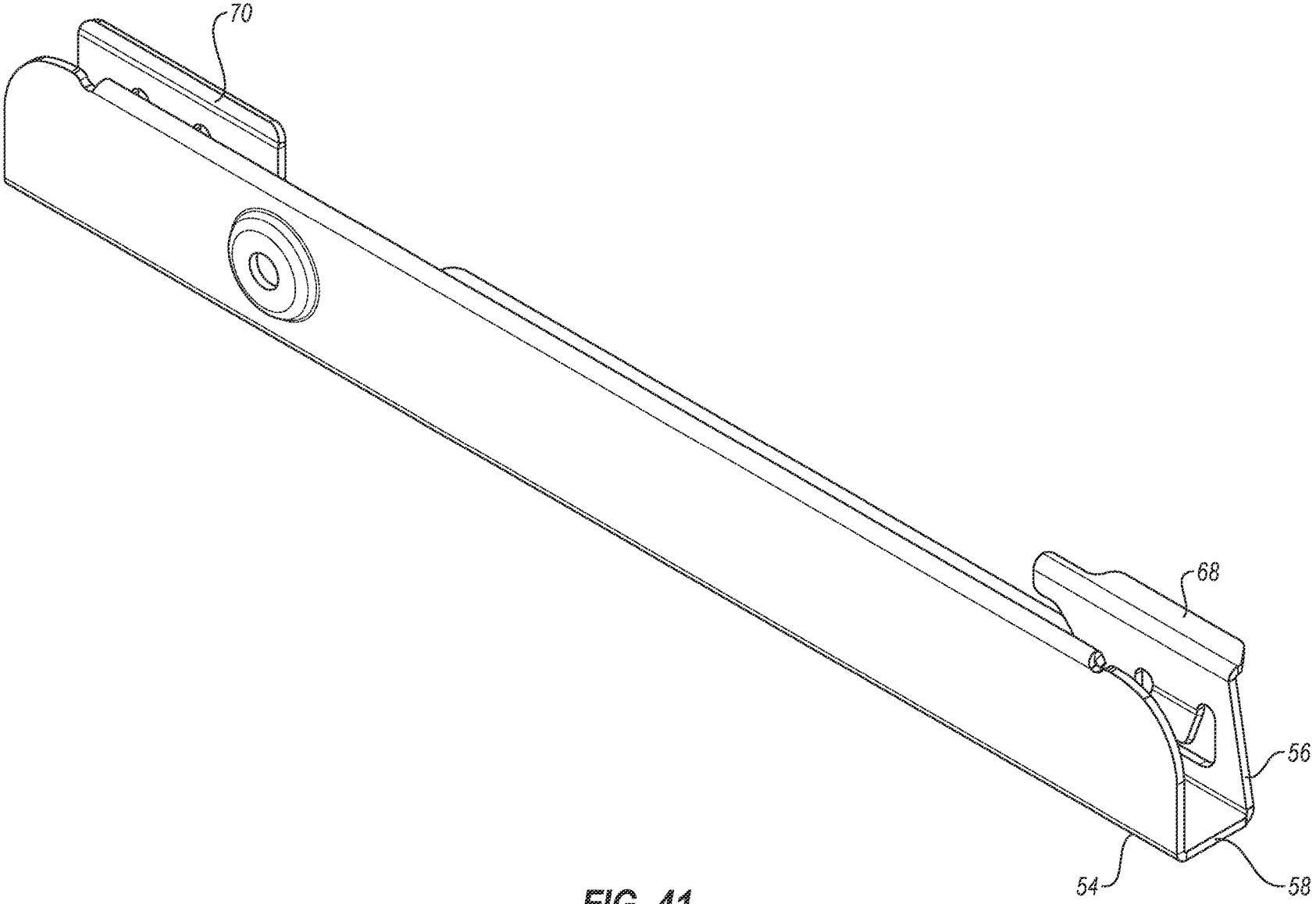
FIG. 41 is a rear perspective view of the bracket shown in FIG. 40.
Figure 42:
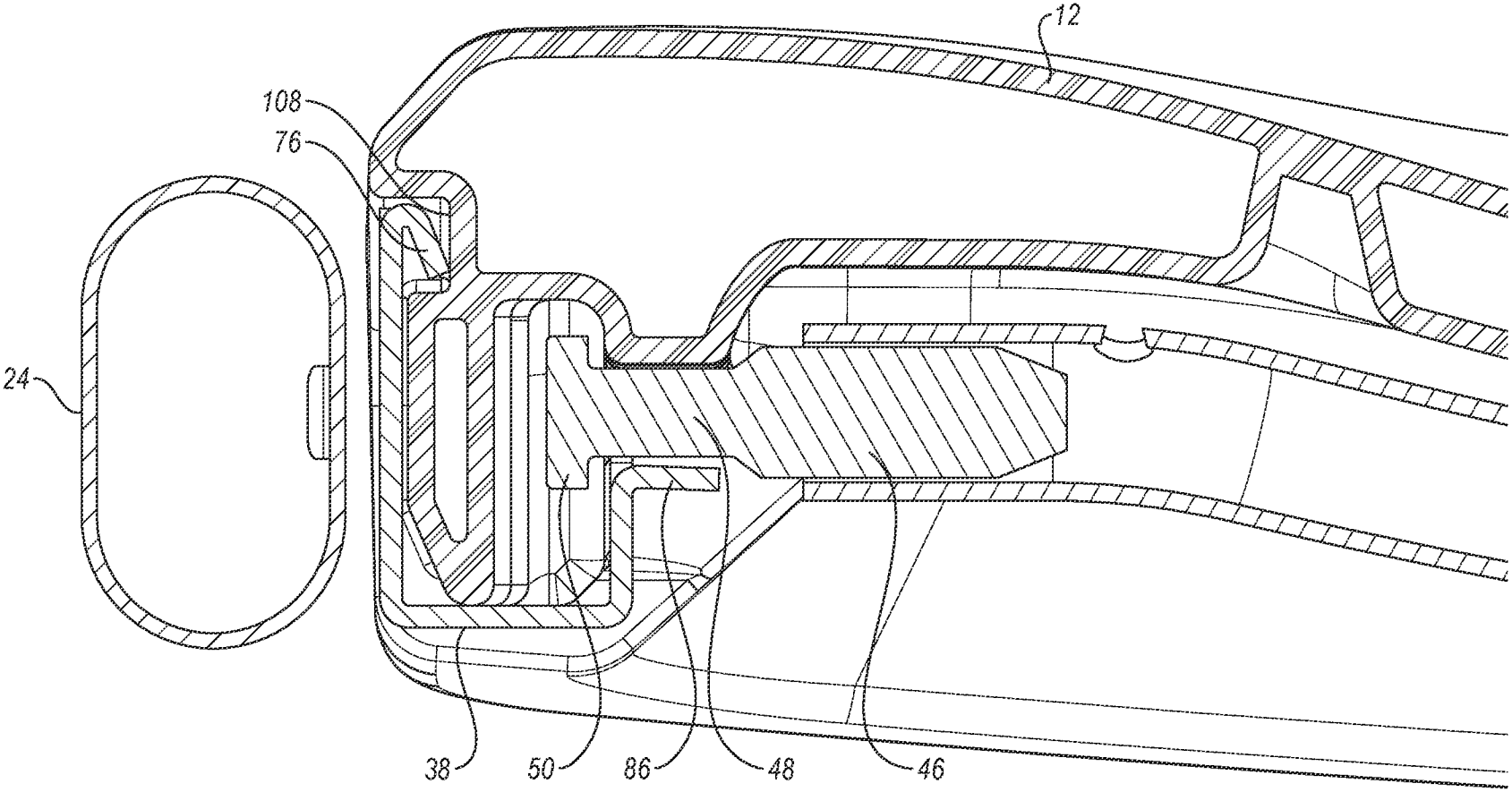
FIG. 42 is an enlarged cross-sectional side view of another embodiment of a chair seat attached to a frame.

The upper portion 74 of the outer sidewall 54 of the bracket 38 may be disposed in a recess in an outer wall or sidewall of the seat 12. The upper portion 74 of the outer sidewall 54 of the bracket 38 may include an attachment portion 76, such as inwardly extending portion, which may be curved inwardly and downwardly. The attachment portion 76, such as shown in FIGS. 41-42, may be sized and configured to help connect the bracket 38 and the seat 12. For example, the attachment portion 76 may have a generally rounded or curved configuration, and a distal end of the attachment portion may be angled inwardly and/or towards the lower portion 58 of the bracket 38. In an example embodiment, at least a portion of the attachment portion 76 may be sized and configured to be disposed in attachment portion of the seat 12, such as a groove, channel, or receiving portion. The attachment portion 76 may extend at least substantially or entirely along a length of the bracket 38. The attachment portion 76 and/or a portion of the seat 12 may bend or deform while the seat is attached to the bracket 38. Once the seat 12 is attached to the bracket 38, then the attachment portion 76 may be disposed in an attachment portion of the seat, such as a groove or receiving portion, and the attachment portion 76 and/or the seat may revert and/or resiliently return, at least partially, to an initial configuration, which may help connect the seat and the bracket. The attachment portion 76 may be sized and configured to allow the seat 12 and the bracket 38 to be connected by a friction, interference, and/or snap fit. After reviewing this disclosure, one of ordinary skill in the art will appreciate that the attachment portion 76 could have any desired length, the bracket could include any number of attachment portions, the attachment portion could have other shapes, sizes, configurations, and arrangements, and the attachment portion is not required.

The bracket 38 may include an opening or a cutout 78, which may be disposed in the inner sidewall 56 of the bracket. The opening 78 may extend longitudinally along a length of the bracket 38, and the opening may extend downwardly relative to an upper portion of the bracket. An upper portion of the opening 78 may be open or exposed, and the lower portion of the opening may be spaced apart from the lower surface 16 of the seat 12 by a gap 80. The opening 78 may include a front potion 82 disposed towards a front portion of the bracket 38 and the opening may include a rear portion 84 disposed towards a rear portion of the bracket.

The opening 78 may form at least a portion of the guide 52. For example, the guide 52 may include a lower portion 86 and the lower portion may have a generally planar or smooth upper surface. The lower portion 86 of the guide 52 may include an inwardly extending portion. A gap or space may be disposed between a front portion of the inwardly extending portion 86 and the front portion 82 of the opening 78. A gap or space may also be disposed between a rear portion of the inwardly extending portion 86 and the rear portion 84 of the opening 78. A downwardly extending notch 88 may be disposed between the rear portion of the inwardly extending portion 86 and the rear portion 84 of the opening 78. The guide 52 may be sized and configured to receive at least a portion of the guide member 46, and the guide may facilitate folding and unfolding of the chair 10.

In an example embodiment, the seat 12 and the bracket 38 may be attached by a friction, interference, and/or snap fit configuration. The bracket 38 may allow the seat 12 to be inserted downwardly into an upper portion of the bracket, and one or more portions of the bracket and/or seat may be sized and configured to bend or deform when the seat is attached to the bracket. Once the seat 12 is attached to the bracket 38, then the portions of the bracket and/or seat may revert or resiliently return, at least partially, to an initial configuration, which may facilitate connection of the seat and the bracket.

As shown in the accompanying figures, the inner sidewall 56 of the bracket 38 may include one or more attachment portions, such as the attachment portions 62. In an example embodiment, the inner sidewall 56 of the bracket 38 may include two inwardly extending attachment portions 62. The attachment portions 62 may extend inwardly and may be angled downwardly towards the lower portion 58 of the bracket 38, which may facilitate insertion of the seat 10 downwardly relative to the upper portion of the bracket. Thus, in an example embodiment, the bracket 38 may include multiple attachment portions, such as attachment portions 62, the attachment portions may extend inwardly and downwardly.

The brackets 38 may include one or more support surfaces and the support surfaces may be sized and configured to support the seat 12. For example, the upper portion 68 of the front portion 64 of the bracket 38, the upper portion 70 of the rear portion 66 of the bracket, the inner surface 72 of the lower portion 58 of the bracket, and/or the upper portion 74 of the outer sidewall 54 of the bracket may include one or more surfaces or portions that are sized and configured to support the seat 12. Advantageously, the multiple support surfaces may allow the seat 12 to be firmly supported.

As shown in the accompanying figures, the brackets 38 may include one or more angled portions, such as the upper portion 68 of the front portion 64 of the bracket 38, the upper portion 70 of the rear portion 66 of the bracket, the upper portion 74 of the outer sidewall 54 of the bracket, and/or the lower portion 86 of the guide 52. The angled portions 68, 70, 74, and/or 86, which may be referred to as flanges, may increase the stiffness and rigidity of the bracket. The flanges may facilitate attachment of the bracket 38 and seat 12 because, for example, the flanges may be disposed in receiving portions and/or the flanges may be sized and configured to contact, engage, abut., interlock, and/or be attached a particular portion of the seat 12. Because the flanges may be disposed on opposing sides of the bracket 38, the bracket may have considerable strength and rigidity.

The chair 10 may include one or more stops, and the stops may be used to control movement of the legs 30, 32, 34, 36 and/or the upper crossmember 44 relative to the seat 12. For example, the stops may abut, contact, or engage the crossmember 44 and/or the guide members 46 when the chair 10 is in a particular configuration. For instance, the upper crossmember 44 and/or the guide members 46 may abut, contact, or engage one or more of the stops when the chair 10 is in the unfolded or use position. The upper crossmember 44 and/or the guide members 46 may abut, contact, or engage one or more of the stops when the chair is in the folded or collapsed positions. In an example embodiment, the front portion 82 of the opening 78 may form a stop, such as when the chair 10 is in the use or unfolded position. In an example embodiment, the front lower crossmember 40 may form a stop, such as when the chair 10 is in the folded or collapsed position.

As shown in FIGS. 20-25 and 30-34, the seat 12 may include a generally downwardly extending portions, such as sidewalls 100, and the sidewalls may be sized and configured to be connected to the bracket 38. The sidewall may include an outer surface 102, an inner surface 104, and a lower surface 106. The sidewall 100 may include one or more reinforcement portions 108, such as inwardly extending protrusions, and the reinforcement portions may be disposed in the outer surface 102 of the sidewall 100. The sidewall 100 may include one or more attachment portions 110, and the attachment portions may be receiving portions that are sized and configured to receive at least a portion of the attachment portions 62 of the bracket 38. The lower portion 16 of the seat 12 may include a guide surface 112, and the guide surface may extend downwardly. In an example embodiment, the guide surface 112 may be disposed in the inner surface 104 of the sidewall 100 and the guide surface may have a generally planar configuration. The guide surface 112 may be spaced apart from the lower portion 86 of the opening 78 in the bracket by a distance, which may be generally constant, to form at least a portion of the guide 52. Thus, a lower portion of the guide 52 may be formed by a portion of the bracket 38, such as the lower portion 86 of the opening 78, and the upper portion of the guide may be formed by a portion of the seat 12, such as the guide surface 112. After reviewing this disclosure, one of ordinary skill in the art will appreciate that any suitable portions of the bracket 38 and/or the seat 12 may be used to form all or portions of the guide 52.

Figure 26:
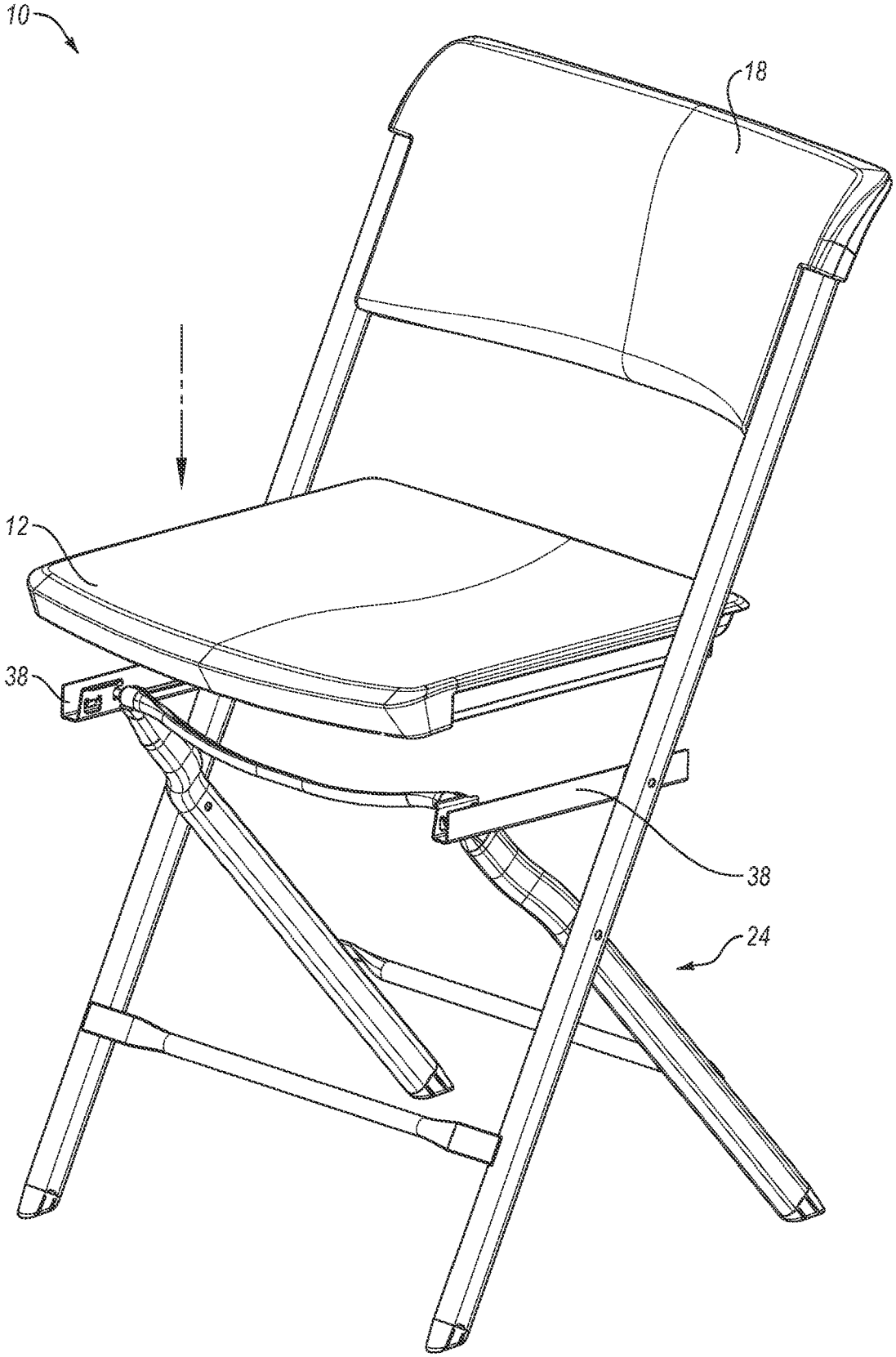
FIG. 26 is an upper perspective view of an example chair, illustrating the seat being attached to the frame when the frame is in an assembled configuration.
Figure 27:
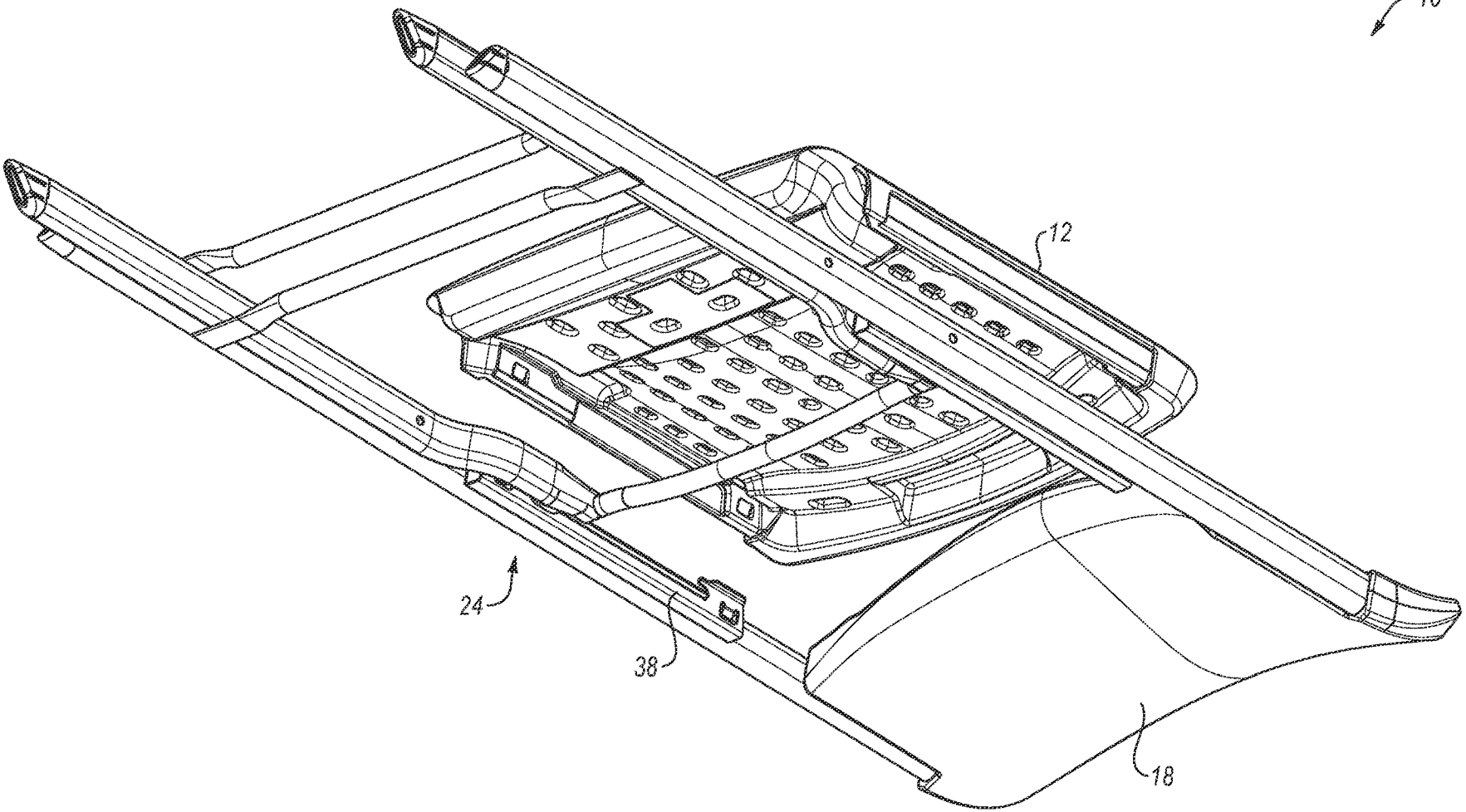
FIG. 27 is a lower perspective view of an example chair, illustrating the seat spaced apart from the frame by a distance and the edges of the seat aligned with the brackets.
Figure 28:
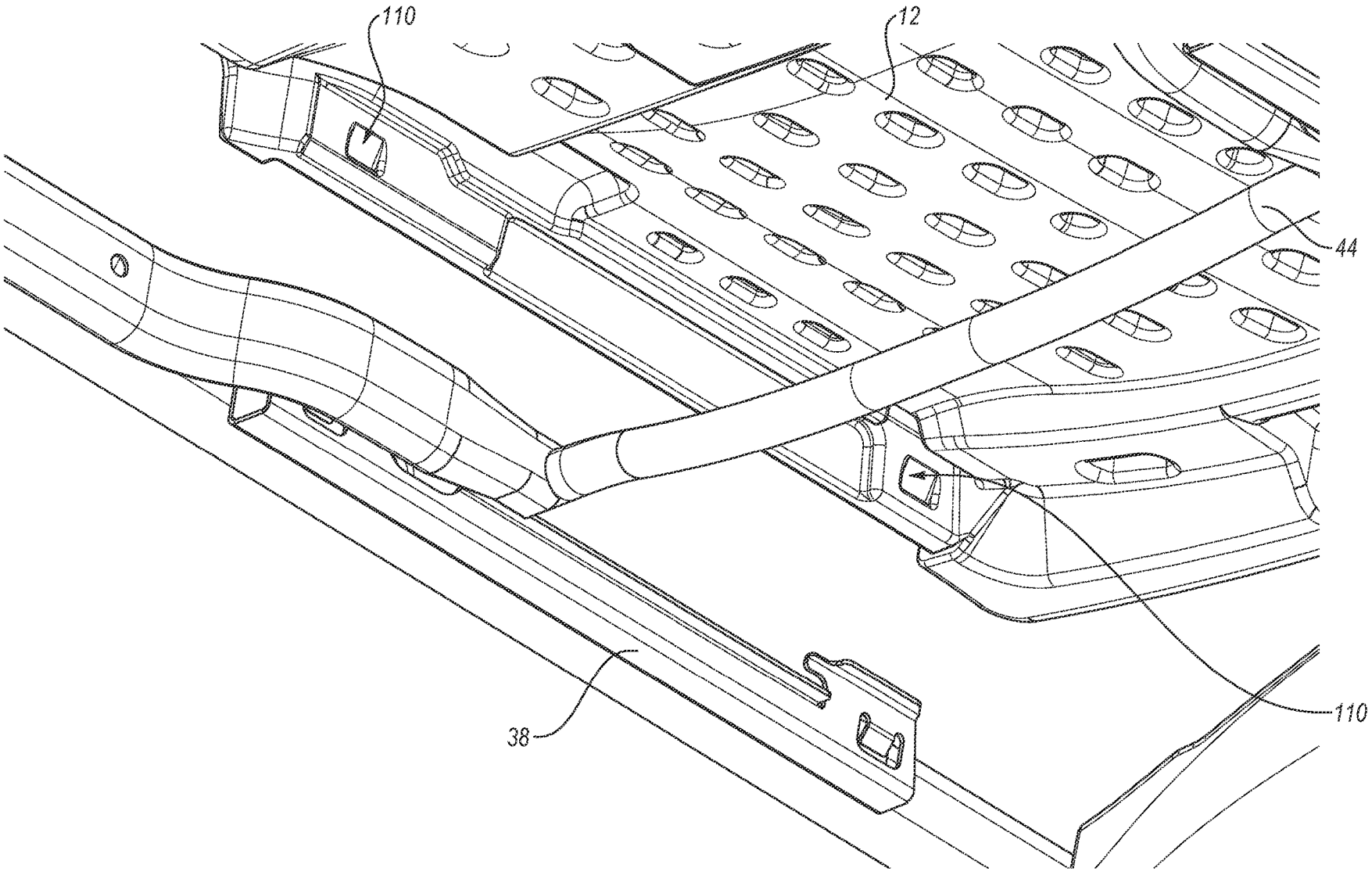
FIG. 28 is an enlarged lower perspective view of a portion of the chair shown in FIG. 27.
Figure 29:
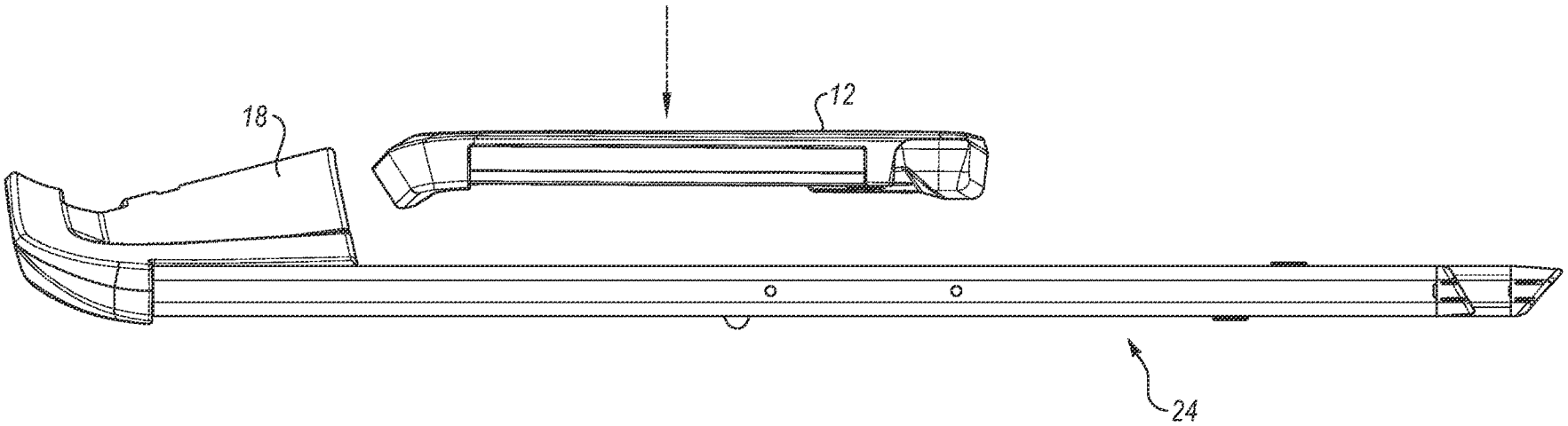
FIG. 29 is a side view of the chair shown in FIG. 27, illustrating the frame in a folded configuration and the seat sized and configured to be attached to the frame.
Figure 30:
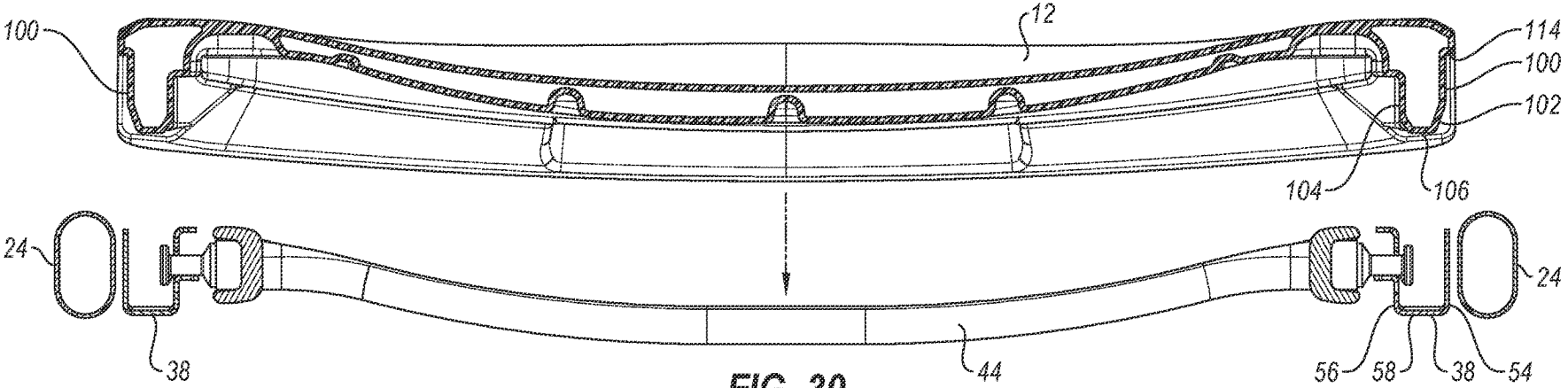
FIG. 30 is a cross-sectional side view of a portion of the seat and frame shown in FIG. 29, illustrating the seat being attached to the frame.
Figure 31:
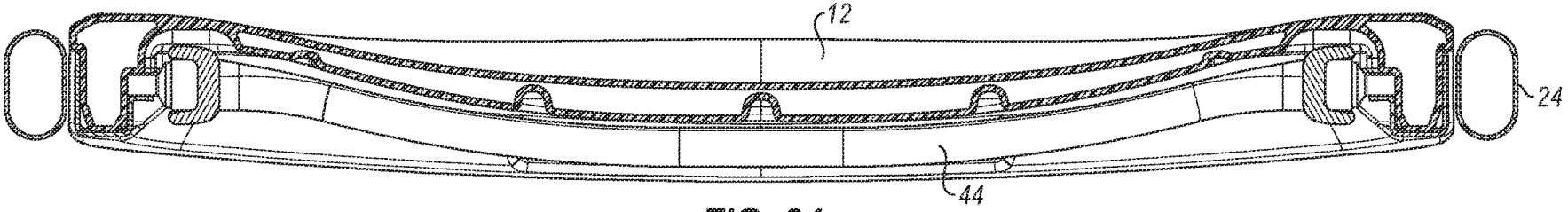
FIG. 31 is a cross-sectional side view of the seat and frame shown in FIG. 30, illustrating the seat attached to the frame.
Figure 32:
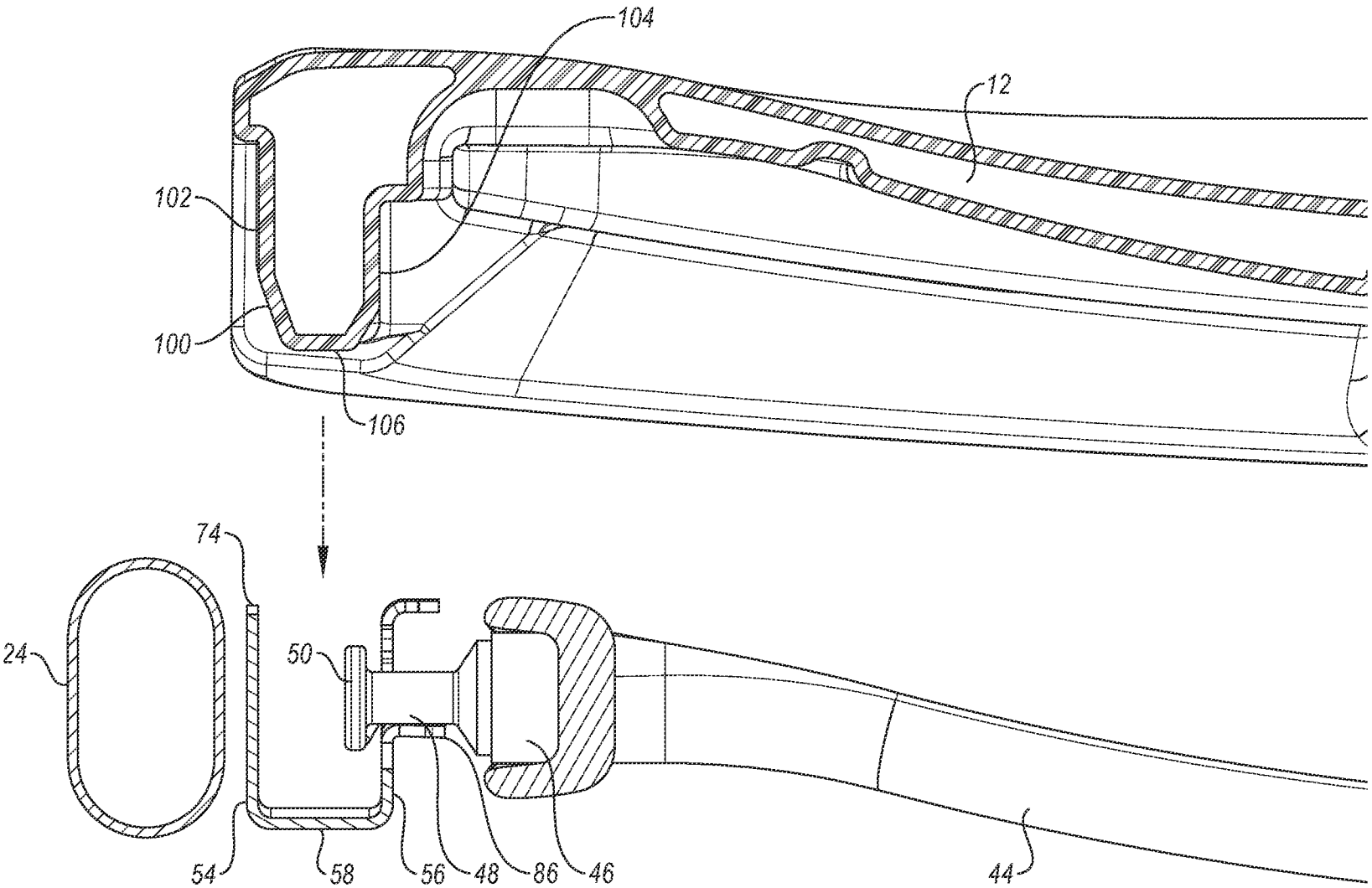
FIG. 32 is an enlarged cross-sectional side view of a portion of the seat and frame shown in FIG. 30, illustrating the seat being attached to the frame.
Figure 33:
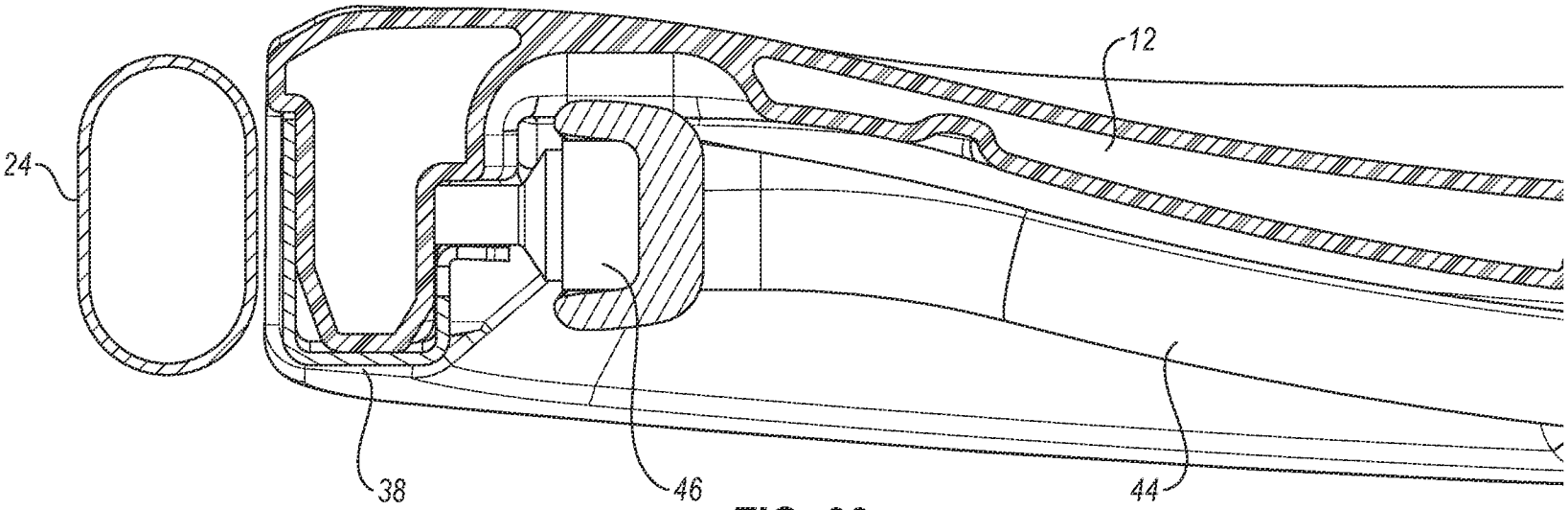
FIG. 33 is an enlarged cross-sectional side view of the portion of the seat and frame shown in FIG. 32, illustrating the seat attached to the frame.
Figure 34:
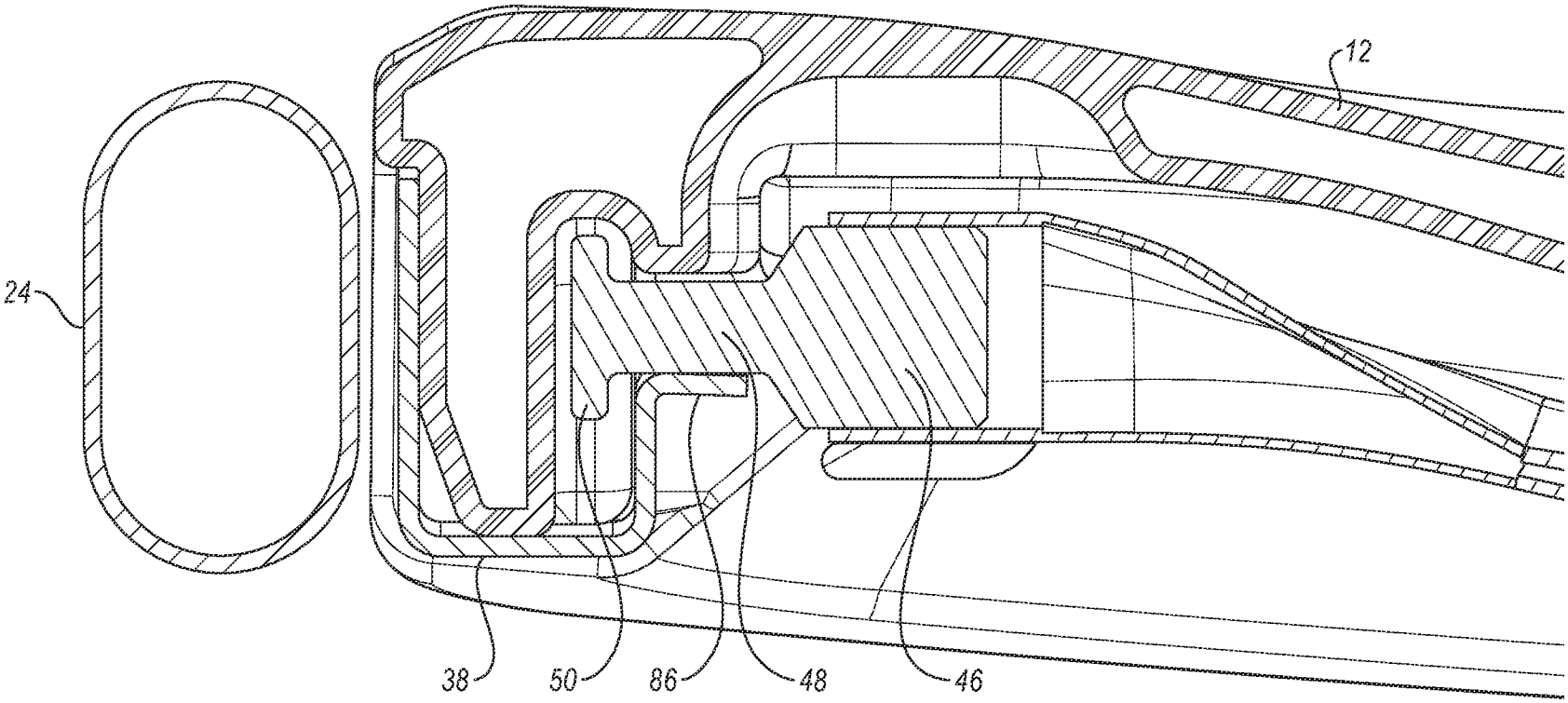
FIG. 34 is another enlarged cross-sectional view of a portion of the seat and frame shown in FIG. 32, illustrating the seat attached to the frame.
Figure 35:
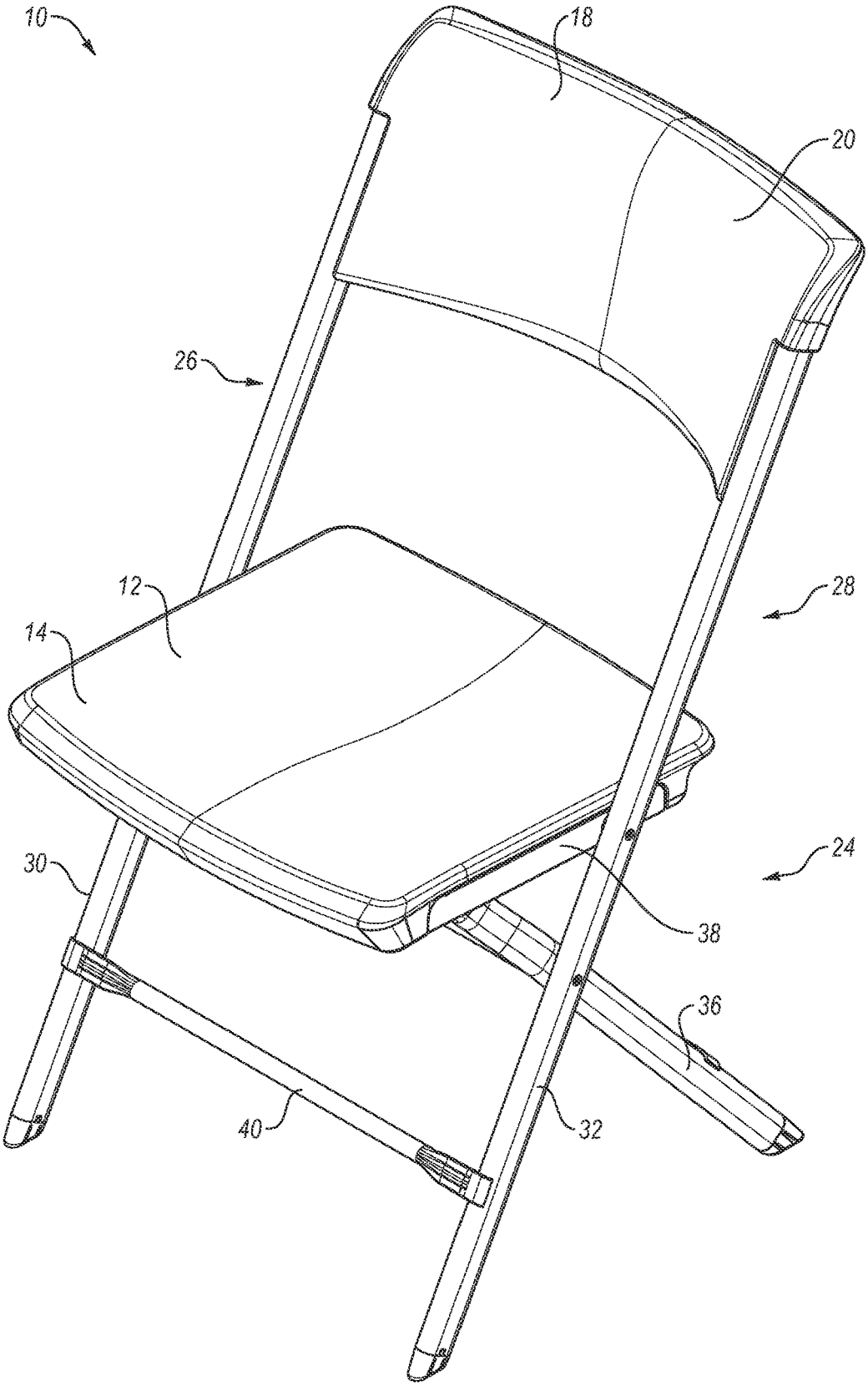
FIG. 35 is an upper perspective view of another embodiment of an example chair.
Figure 36:
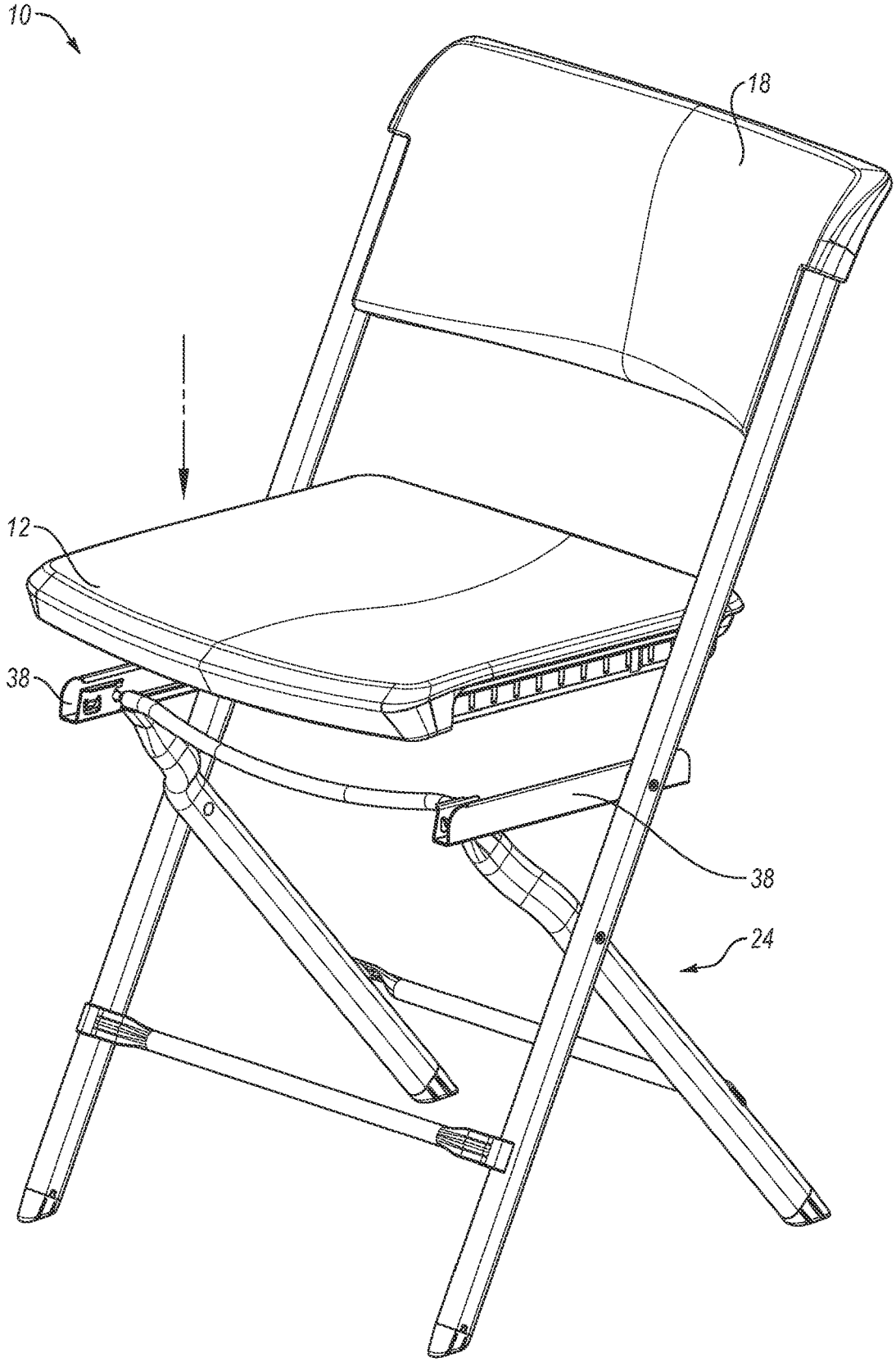
FIG. 36 is an upper perspective view of the chair shown in FIG. 35, illustrating the seat being attached to the frame when the frame is in an assembled configuration.
Figure 37:
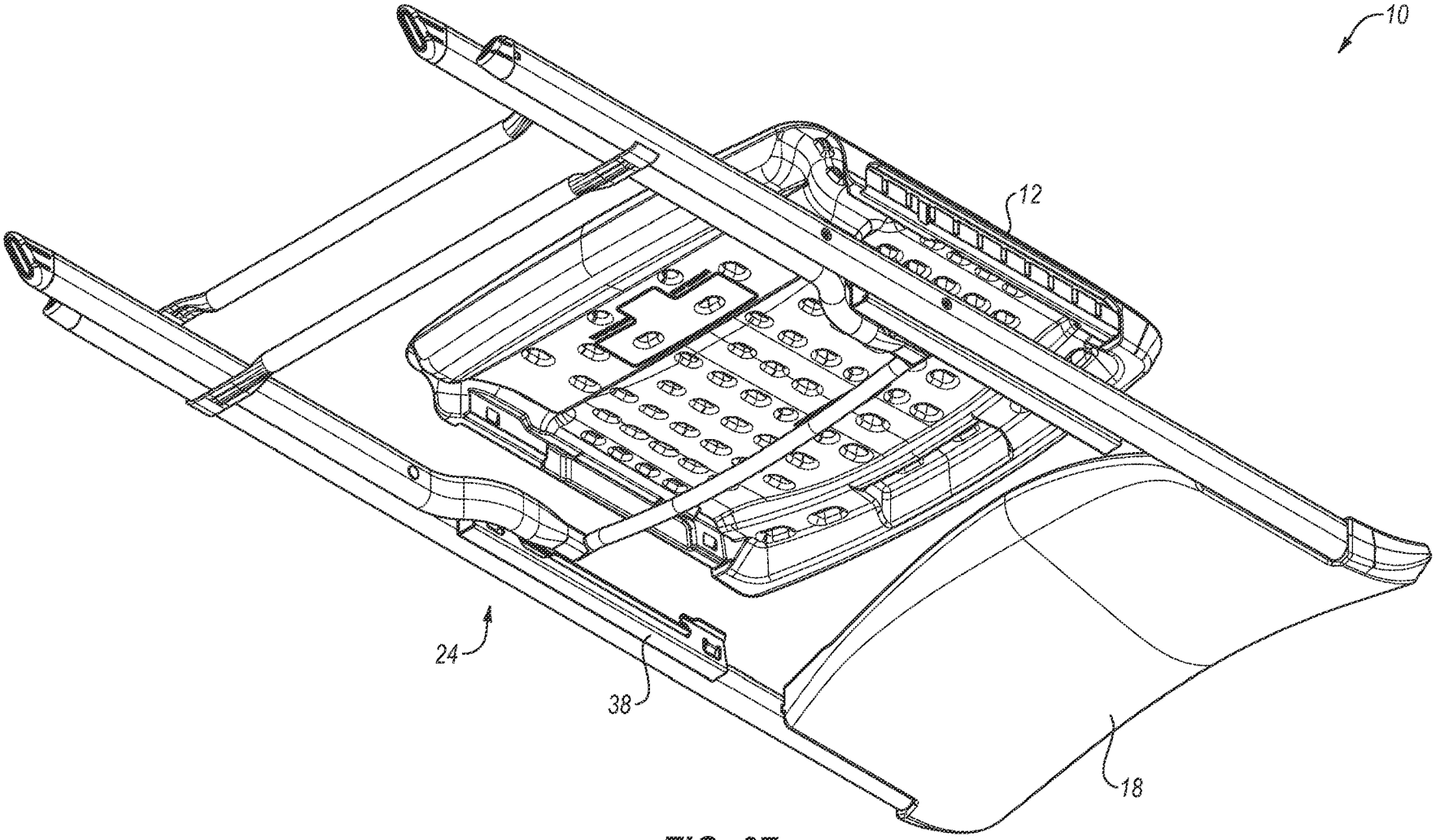
FIG. 37 is a lower perspective view of the chair shown in FIG. 35, illustrating the seat spaced apart from the frame by a distance and the edges of the seat aligned with the brackets.
Figure 38:
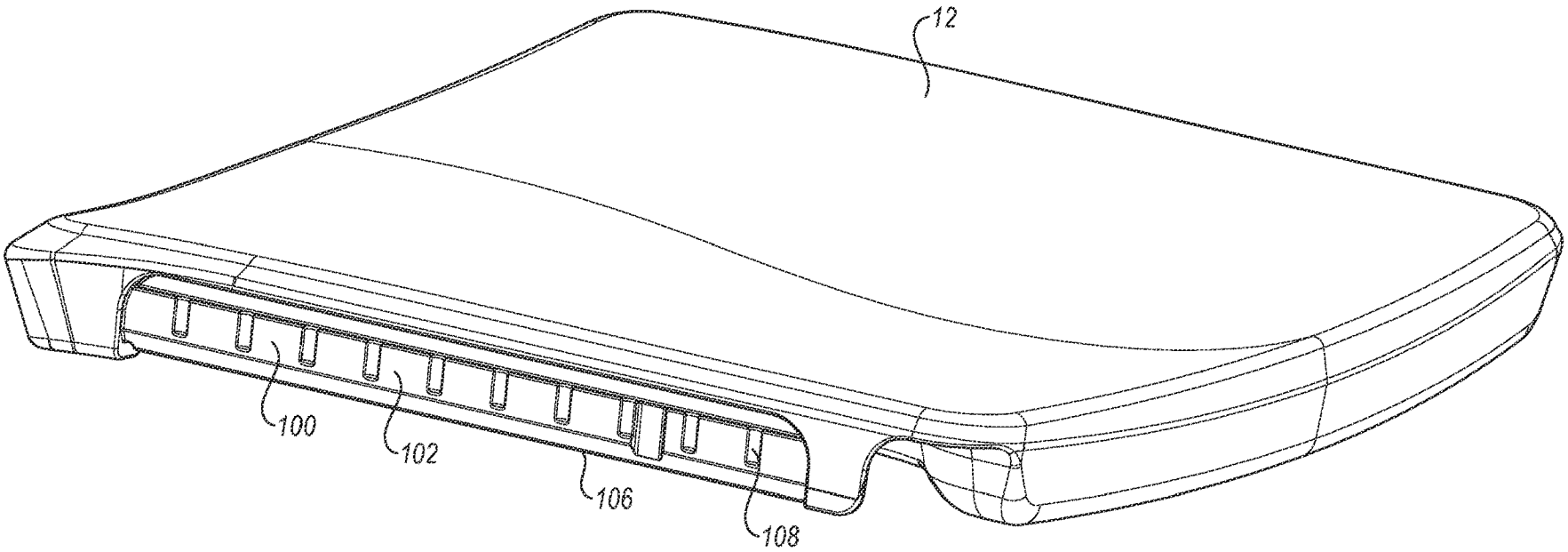
FIG. 38 is an upper perspective view of another embodiment of an example chair seat.
Figure 39:
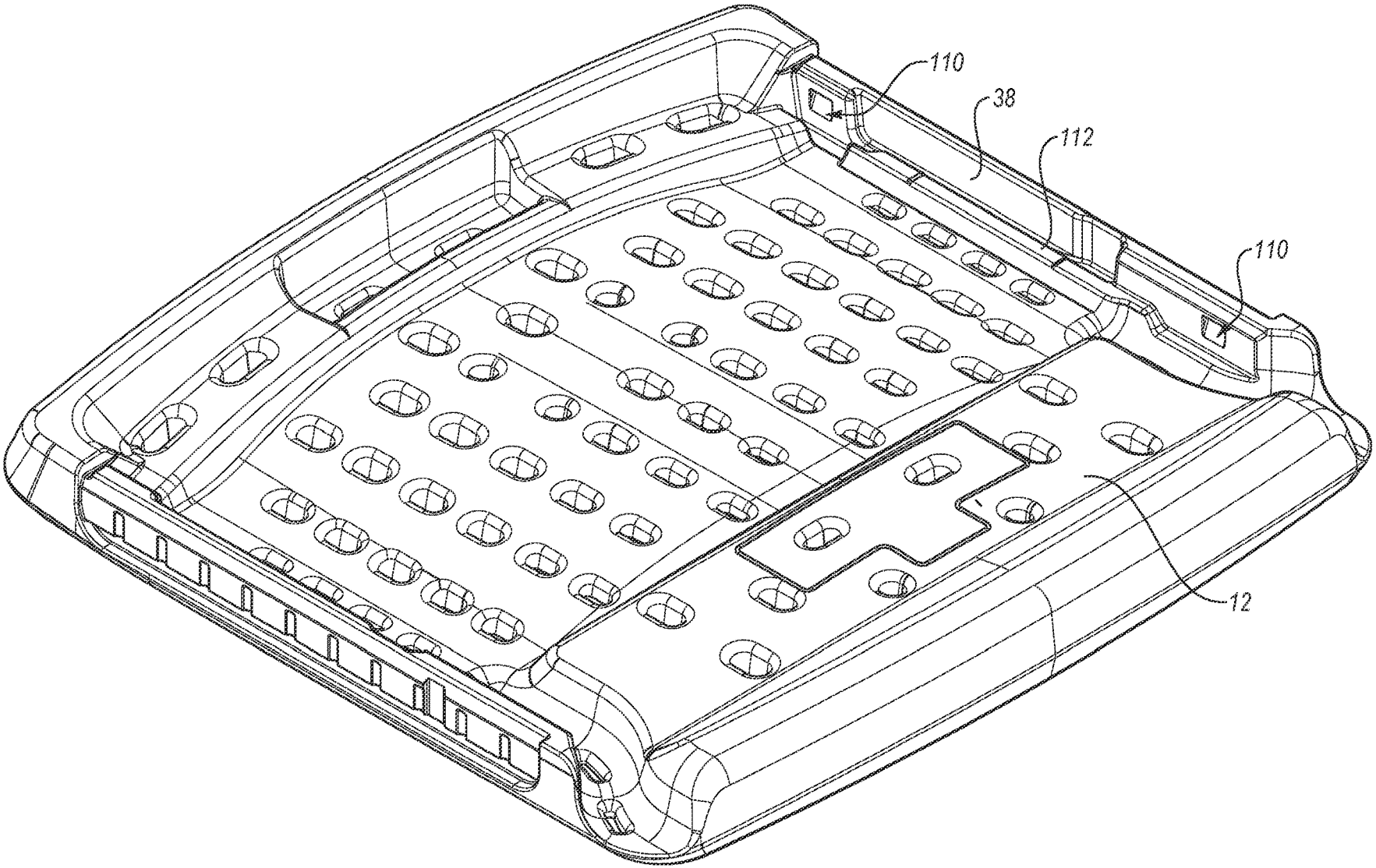
FIG. 39 is a lower perspective view of the chair seat shown in FIG. 38.
Figure 40:
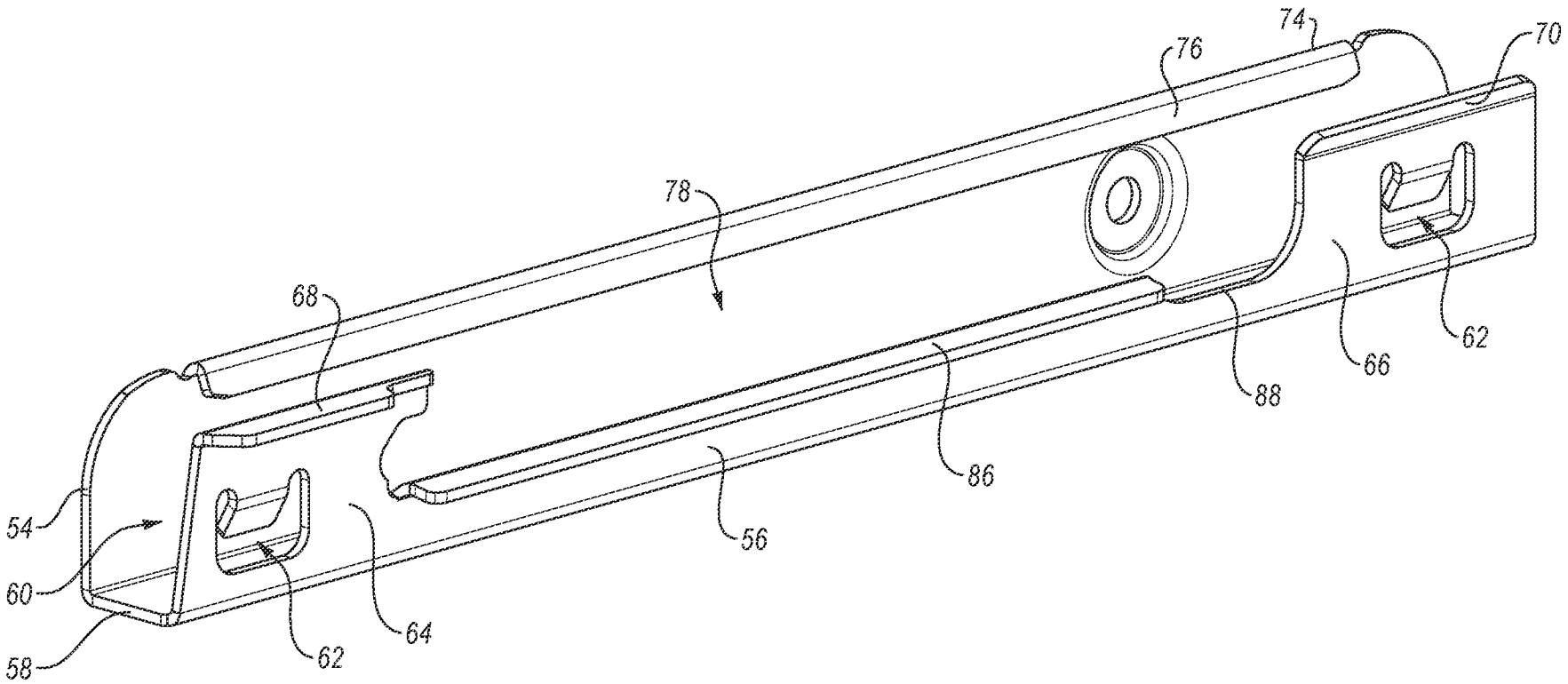
FIG. 40 is a front perspective view of another embodiment of an example bracket.

As shown in the accompanying figures, the sidewalls 100 of the seat 12 may abut, contact, or engage the brackets 38. In an example embodiment, the seat 12 may be inserted into an upper portion of the brackets 38. For example, as shown in FIG. 26, the seat 12 may be connected to a substantially or fully assembled frame 24, and the seat may be attached to the brackets 38 when the chair 10 is in the unfolded configuration. Additionally, and/or alternatively, the seat 12 may be connected to the brackets 38 when the chair 10 is in the folded configuration, such as shown in FIGS. 27-29. In either configuration, the attachment portions 62 of the brackets 38 may be generally aligned with the attachment portions 110 of the seat 12, and the seat may be inserted into the upper portions of the brackets until the lower surface 106 of the sidewall 100 is disposed at least proximate the lower portion 58 of the bracket. In this example embodiments, the inwardly extending attachment portions 62 of the bracket 38 may be disposed in the receiving portion of the attachment portion 110 of the seat, which may help secure the seat and brackets.

As shown in FIGS. 30-34, the upper portion 74 of the outer wall 54 of the bracket 38 may include an attachment portion 76 and the attachment portion may be sized and configured to be connected to an attachment portion 114 of the seat 12, such as a receiving portion. For example, a distal portion of the attachment portion 76 may extend downwardly and inwardly, and the distal portion of the attachment portion may be disposed in the receiving portion 114 of the seat, which may help connect the seat 10 and the brackets 38.

One of ordinary skill in the art will appreciate after reviewing this disclosure that the chair may have different shapes, sizes, configurations, and/or arrangements. For example, as shown in FIGS. 35-42, the bracket 38 may have a different size, shape, configuration, and arrangement. In this example embodiment, the bracket 38 may have a generally U-shaped configuration with an outer portion 54, such as an outer sidewall, an inner portion 56, such an inner sidewall, and a lower portion 58, such as a connecting portion. The bracket 38 may include two attachment portions 62 disposed in the inner sidewall 56, which may one attachment portion disposed in a first portion 64 of the bracket and another attachment portion disposed in a second portion 66 of the bracket. The upper portion 68 of the first portion 64 of the bracket 38 may extend inwardly towards an inner portion of the seat 12, and the upper portion of the first portion of the bracket may facilitate positioning of the bracket and/or may support a portion of the seat. The upper portion 70 of the second portion 66 of the bracket 38 may extend inwardly towards an inner portion of the seat 12, and the upper portion of the second portion of the bracket may facilitate positioning of the bracket and/or may support a portion of the seat. The upper portion 74 of the outer sidewall 54 of the bracket 38 may include an attachment portion 76, and the attachment portion may extend downwardly towards the lower portion 58 of the bracket. As shown in the accompanying figures, the upper portion 74 of the outer sidewall 54 of the bracket may include rounded corners or angled corners. In addition, the attachment portion 76 may extend along a portion of a length of the bracket 38 or the attachment portion may extend an entire the length of the bracket. Thus, one of ordinary skill in the art will appreciate that the chair 10, and its parts and components, may have different shapes, sizes, configurations, and/or arrangements.

Figure 43:
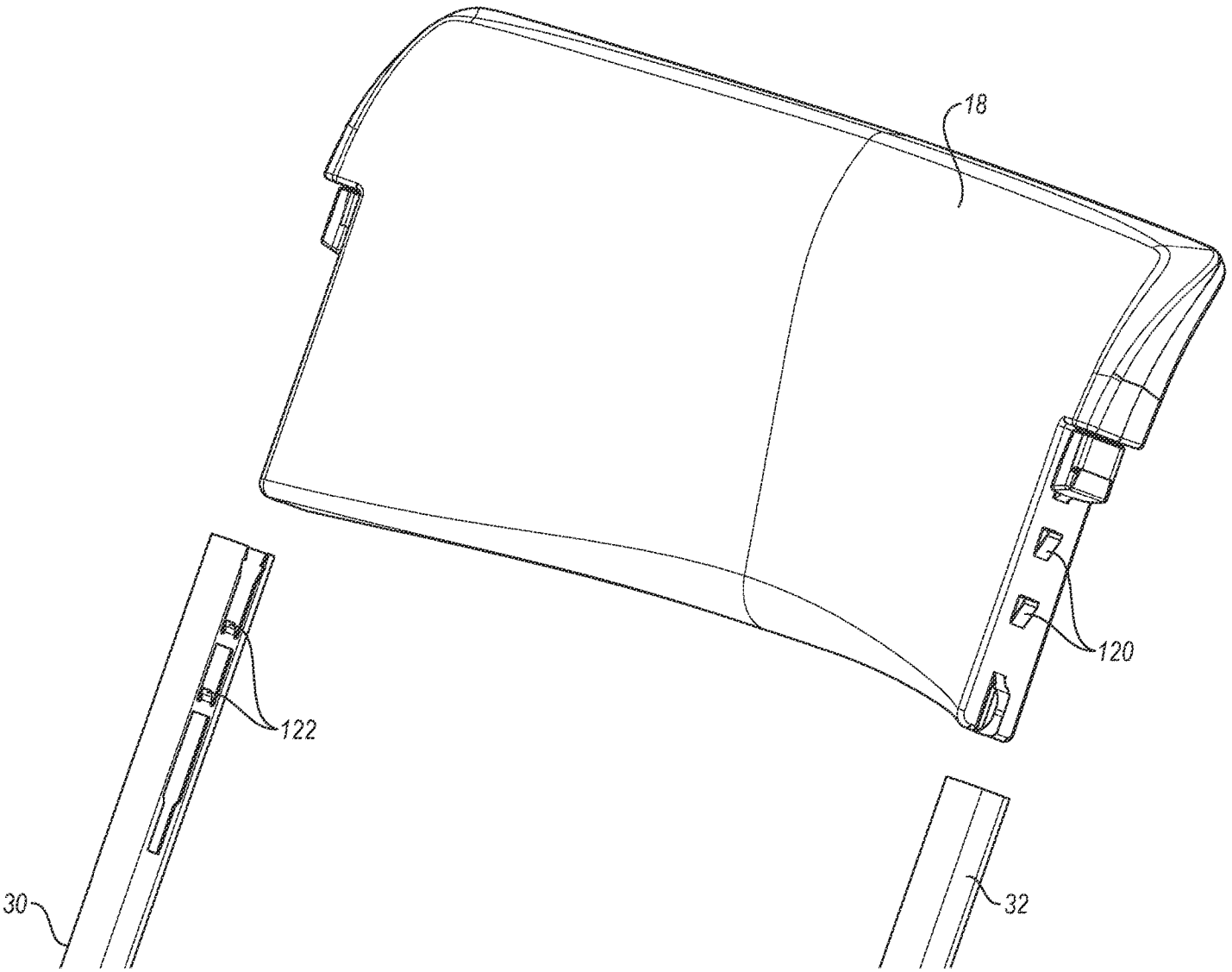
FIG. 43 is a perspective view of a backrest and an upper portion of the frame.

As shown in FIG. 43, the backrest 18 may include one or more attachment portions 120 and the attachment portions may be disposed along opposing sides of the backrest. The frame 24 may include one or more attachment portions 122 and the attachment portions may be disposed in inner portions of the right and left front legs 30, 32. The seat attachment portions 120 may be sized and configured to contact, abut, engage, interlock, attach, connect, and the like with corresponding frame attachment portions 122 to connect the backrest 18 to the frame 24.

One of ordinary skill in the art will appreciate after reviewing this disclosure that the chair 10 and components of the chair may have other suitable shapes, sizes, configurations, and arrangements depending, for example, upon the intended use of the chair. One of ordinary skill in the art will appreciate the chair 10 may include any suitable number or combination of features or aspects, but these features or aspects may not be required.

For example, the chair 10 may have other suitable embodiments such as shown in U.S. patent application Ser. No. 18/599,168, filed Mar. 7, 2024, which is incorporated by reference it its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A folding chair capable of moving between a folded position and an unfolded position, the folding chair comprising:

a frame;

a seat including a first set of one or more receiving portions disposed on a first side of the seat and a second set of one or more receiving portions disposed on a second side of the seat;

a first bracket attached to a first side of the frame, the first bracket including one or more attachment portions sized and configured to engage the first set of one or more receiving portions of the seat as the seat is inserted from an upper portion of the first bracket towards a lower portion of the first bracket, the one or more attachment portions of the first bracket and the first set of one or more receiving portions of the seat connecting the first side of the seat to the first bracket; and a second bracket attached to a second side of the frame, the second bracket including one or more attachment portions sized and configured to engage the second set of one or more receiving portions of the seat as the seat is inserted from an upper portion of the second bracket towards a lower portion of the second bracket, the one or more attachment portions of the second bracket and the second set of one or more receiving portions of the seat connecting the second side of the seat to the second bracket;

wherein an attachment portion of the one or more attachment portions of the first bracket includes a tab that extends downwardly and inwardly towards a lower surface of the first bracket; and wherein an attachment portion of the one or more attachment portions of the second bracket includes a tab that extends downwardly and inwardly towards a lower surface of the second bracket.

2. The folding chair of claim 1, wherein the frame comprises a right front leg attached to a right rear leg and a left front leg attached to a left rear leg;

wherein the first bracket is pivotally attached to the right front leg and the second bracket is pivotally attached to the left front leg; and wherein the seat is attached to an at least substantially assembled frame.

3. The folding chair of claim 1, wherein the seat is attached to the first bracket along a first axis that is generally vertically aligned with a height of the first bracket; and wherein the seat is attached to the second bracket along a second axis that is generally vertically aligned with a height of the second bracket.

4. The folding chair of claim 1, wherein the seat is attached to the first bracket and the second bracket while the first bracket and the second bracket are attached to the frame;

and wherein the frame is disposed in a folded position.

5. The folding chair of claim 1, wherein the seat is attached to the first bracket and the second bracket while the first bracket and the second bracket are attached to the frame;

and wherein the frame is disposed in an unfolded position.

6. The folding chair of claim 1, wherein the one or more attachment portions of the first bracket extend inwardly and downwardly towards a lower surface of the first bracket; and wherein the one or more attachment portions of the second bracket extend inwardly and downwardly towards a lower surface of the second bracket.

7. The folding chair of claim 1, wherein the seat is connected to the first bracket and the second bracket while the frame is disposed in a folded configuration and the frame is at least substantially assembled.

8. The folding chair of claim 1, wherein the seat is not moved parallel to a length of the first bracket or the second bracket to attach the seat to the first bracket and the second bracket.

9. The folding chair of claim 1, wherein the seat is positioned above the upper portion of the first bracket and the upper portion of the second bracket when attaching the seat to the first bracket and the second bracket;

wherein the first set of one or more receiving portions of the seat are aligned with the one or more attachment portions of the first bracket;

wherein the second set of one or more receiving portions of the seat are aligned with the one or more attachment portions of the second bracket;

wherein the first set of one or more receiving portions of the seat engage the one or more attachment portions of the first bracket when the seat is attached to the first bracket; and wherein the second set of one or more receiving portions of the seat engage the one or more attachment portions of the second bracket when the seat is attached to the second bracket.

10. The folding chair of claim 1, wherein the first bracket includes an inner wall and an outer wall;

wherein the second bracket includes an inner wall and an outer wall;

wherein the inner wall of the first bracket includes two attachment portions of the one or more attachment portions and the outer wall of the first bracket includes one attachment portion of the one or more attachment portions; and wherein the inner wall of the second bracket includes two attachment portions of the one or more attachment portions and the outer wall of the second bracket includes one attachment portion of the one or more attachment portions.

11. A method of assembling a portion of a folding chair, the method comprising:

providing a frame including a first front leg, a first rear leg connected to the first front leg, a second front leg, and a second rear leg connected to the second front leg;

connecting a first bracket to the first front leg, the first bracket including a first axis extending at an upward angle from a lower portion of the first bracket;

connecting a second bracket to the second front leg, the second bracket including a second axis extending at an upward angle from a lower portion of the second bracket; and connecting a seat to the first bracket and the second bracket, the seat being connected to the first bracket along the first axis and the seat being connected to the second bracket along the second axis;

wherein the seat is connected to the first bracket and the second bracket when the frame is disposed in a folded position.

12. The method of claim 11, wherein the connecting the seat to the first bracket and the second bracket comprises:

inserting a first portion of the seat from an upper portion of the first bracket towards a lower portion of the first bracket to connect the first portion of the seat to the first bracket; and inserting a second portion of the seat from an upper portion of the second bracket towards a lower portion of the second bracket to connect the second portion of the seat to the second bracket.

13. The method of claim 11, further comprising: providing the first bracket with one or more inwardly and downwardly extending attachment portions;

providing the second bracket with one or more inwardly and downwardly extending attachment portions;

providing the seat with a first sidewall with one or more receiving portions sized and configured to receive the one or more attachment portions of the first bracket when the seat is attached to the first bracket; and providing the seat with a second sidewall with one or more receiving portions sized and configured to receive the one or more attachment portions of the second bracket when the seat is attached to the second bracket.

14. The method of claim 11, wherein the seat is connected to the first bracket and the second bracket when the frame is at least substantially assembled.

15. The method of claim 11, wherein the first bracket includes one or more tabs that extend downwardly and inwardly towards a lower surface of the first bracket; and wherein the second bracket includes one or more tabs that extends downwardly and inwardly towards a lower surface of the second bracket.

16. The method of claim 11, further comprising:

positioning the seat above an upper portion of the first bracket when the seat is to be attached to the first bracket;

positioning the seat above an upper portion of the second bracket when the seat is to be attached to the second bracket;

wherein the seat includes a first set of one or more attachment portions that are aligned with one or more attachment portions of the first bracket;

wherein the seat includes a second set of one or more attachment portions that are aligned with one or more attachment portions of the second bracket;

wherein the first set of one or more attachment portions of the seat engage the one or more attachment portions of the first bracket when the seat is attached to the first bracket; and wherein the second set of one or more attachment portions of the seat engage the one or more attachment portions of the second bracket when the seat is attached to the second bracket.

17. The method of claim 11, further comprising:

providing the first bracket with an inner sidewall and an outer sidewall, the inner sidewall of the first bracket including two attachment portions, the attachment portions including a tab that extends downwardly and inwardly towards a lower surface of the first bracket;

providing the second bracket with an inner sidewall and an outer sidewall, the inner sidewall of the second bracket including two attachment portions, the attachment portions including a tab that extends downwardly and inwardly towards a lower surface of the second bracket;

providing the seat with a first sidewall and two attachment portions disposed in the first sidewall, the two attachment portions of the first bracket and the two attachment portions of the first sidewall connecting the seat to the first bracket; and providing the seat with a second sidewall and two attachment portions disposed in the second sidewall, the two attachment portions of the second bracket and the two attachment portions of the second sidewall connecting the seat to the second bracket.

18. A method of manufacturing a portion of a folding chair that is movable between a folded position and an unfolded position, the method comprising:

providing an at least substantially assembled frame, the frame comprising:

a first side including a first front leg and a first rear leg; and a second side including a second front leg and a second rear leg;

connecting a first bracket to the first side of the frame, the first bracket including one or more attachment portions that extend downwardly towards a lower portion of the first bracket;

connecting a second bracket to the second side of the frame, the second bracket including one or more attachment portions that extend downwardly towards a lower portion of the second bracket;

providing a seat, the seat comprising:

a first sidewall including one or more attachment portions; and a second sidewall including one or more attachment portions;

aligning the one or more attachment portions of the first sidewall of the seat with the one or more attachment portions of the first bracket;

aligning the one or more attachment portions of the second sidewall of the seat with the one or more attachment portions of the second bracket;

disposing the first sidewall of the seat proximate an upper portion of the first bracket;

disposing the second sidewall of the seat proximate an upper portion of the second bracket;

inserting the first sidewall of the seat into the first bracket along an axis from an upper portion of the first bracket towards the lower portion of the first bracket;

inserting the second sidewall of the seat into the second bracket along an axis from an upper portion of the second bracket towards the lower portion of the second bracket;

engaging the one or more attachment portions of the first bracket and the one or more attachment portions of the first sidewall to connect the seat to the first bracket; and engaging the one or more attachment portions of the second bracket and the one or more attachment portions of the second sidewall to connect the seat to the second bracket.

19. The method of claim 18, further comprising attaching the seat to the first bracket and the second bracket when the frame is in a folded position.

20. The method of claim 18, wherein the one or more attachment portions of the first bracket include portions that extend inwardly and downwardly relative to an inner portion of the first bracket;

wherein the one or more attachment portions of the second bracket include portions that extend inwardly and downwardly relative to an inner portion of the second bracket;

wherein the one or more attachment portions of the first sidewall of the seat are receiving portions that receive the portions that extend inwardly and downwardly relative to the inner portion of the first bracket when the seat is connected to the first bracket; and wherein the one or more attachment portions of the second sidewall of the seat are receiving portions that receive the portions that extend inwardly and downwardly relative to the inner portion of the second bracket when the seat is connected to the second bracket.

* * * * *